US007927390B2

(12) United States Patent
Fujimura et al.

(10) Patent No.: US 7,927,390 B2
(45) Date of Patent: Apr. 19, 2011

(54) STABLE AQUEOUS SUSPENSION LIQUID OF FINELY DIVIDED DIAMOND PARTICLES, METALLIC FILM CONTAINING DIAMOND PARTICLES AND METHOD OF PRODUCING THE SAME

(75) Inventors: Tadamasa Fujimura, Yokohama (JP); Masato Sone, Koganei (JP); Valeri Yu Dolmatov, Mettalstroy (RU); Shigeru Shiozaki, Machida (JP)

(73) Assignee: Tadamasa FUJIMURA, Yokohama (JP)

( * ) Notice: Subject to any disclaimer, the term of this patent is extended or adjusted under 35 U.S.C. 154(b) by 0 days.

(21) Appl. No.: 12/461,135

(22) Filed: Aug. 3, 2009

(65) Prior Publication Data

US 2010/0069513 A1 Mar. 18, 2010

Related U.S. Application Data

(62) Division of application No. 11/335,734, filed on Jan. 20, 2006, now Pat. No. 7,585,360, which is a division of application No. 10/231,441, filed on Aug. 30, 2002, now Pat. No. 7,115,325.

(30) Foreign Application Priority Data

Aug. 30, 2001 (JP) ..... 2001-262303
Jun. 13, 2002 (JP) ..... 2002-173167

(51) Int. Cl.

| | |
|---|---|
| ***B24D 3/02*** | (2006.01) |
| ***C09C 1/68*** | (2006.01) |
| ***C09K 3/14*** | (2006.01) |
| ***B01J 3/06*** | (2006.01) |
| ***C25D 15/00*** | (2006.01) |

(52) U.S. Cl. ..... 51/307; 423/446; 205/110

(58) Field of Classification Search ..... 51/307; 106/1.05; 423/446; 501/56; 205/110

See application file for complete search history.

(56) References Cited

U.S. PATENT DOCUMENTS 3,663,475 A * 5/1972 Figiel ..... 516/32

(Continued)

FOREIGN PATENT DOCUMENTS

EP 0 574 587 12/1993

(Continued)

OTHER PUBLICATIONS

Paul S. DeCarli, et al.; Formation of Diamond by Explosive Shock; Science, 1961, vol. 133, pp. 1821-1822.

A. E. Aleksenskii, et al.; Effect of Hydrogen on the Structure of Ultradisperse Diamond; Physics of the Solid State, 2000, vol. 42, No. 8, pp. 1575-1578.

(Continued)

*Primary Examiner* — Jerry Lorengo
*Assistant Examiner* — Pegah Parvini
(74) *Attorney, Agent, or Firm* — Westerman, Hattori, Daniels & Adrian, LLP

(57) ABSTRACT

An aqueous suspension liquid of finely divided diamond particles comprising 0.05 to 160 parts by weight of a finely divided diamond particles in 1000 parts of water, wherein; (i) the finely divided diamond particles have an element composition consisting mainly of 72 to 89.5% by weight of carbon, 0.8 to 1.5% of hydrogen, 1.5 to 2.5% of nitrogen, and 10.5 to 25.0% of oxygen; (ii) and, almost all of said diamond particles are in the range of 2 nm to 50 nm in diameters thereof (80% or more by number average, 70% or more by weight average), (iii) and, said finely divided diamond particles exhibit a strongest peak of the intensity of the Bragg angle at 43.9° (2θ±2°), strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation when dried, (iv) and, specific surface area of said diamond particles when dry state powder is not smaller than $1.50\times10^5$ $m^2/kg$, and substantially all the surface carbon atoms of said particles are bonded with hetero atoms, and the total absorption space of said powder is 0.5 $m^3/kg$ or more, when dried. The diamond particles are very active and dispersible in aqueous liquid in stable, and have essentially same mechanical properties as that of usual diamonds.

11 Claims, 37 Drawing Sheets

U.S. PATENT DOCUMENTS

| | | | | |
|---|---|---|---|---|
| 5,204,210 | A | 4/1993 | Jansen et al. | |
| 5,411,758 | A | 5/1995 | Simpson | |
| 5,861,349 | A * | 1/1999 | Vereschagin et al. | 501/86 |
| 5,916,955 | A | 6/1999 | Vereschagin et al. | |
| 2004/0011433 | A1 | 1/2004 | Shiozaki et al. | |
| 2004/0214159 | A1 | 10/2004 | Fujimura et al. | |

FOREIGN PATENT DOCUMENTS

| | | |
|---|---|---|
| JP | 63-33988 | 7/1988 |
| JP | 63-303806 | 12/1988 |
| JP | 1-234311 | 9/1989 |
| JP | 2-141414 | 5/1990 |
| JP | 3-271109 | 12/1991 |
| JP | 4-83525 | 3/1992 |
| JP | 4-333599 | 11/1992 |
| RU | 2 161 840 | 1/2001 |
| RU | 2 206 503 | 6/2003 |
| RU | 2 223 220 | 9/2003 |
| RU | 2 225 879 | 3/2004 |
| RU | 2 228 347 | 5/2004 |

OTHER PUBLICATIONS

K. Iakoubovskii, et al.; Structure and defects of detonation synthesis nanodiamond; Diamond and Related Materials, 2000, vol. 9, pp. 861-865.

Vladimir L. Kuznetsov, et al.; Onion-like carbon from ultra-disperse diamond; Chemical Physics Letters, 1994, vol. 222, pp. 343-348.

T. Jiang, et al.; FTIR Study of Ultradispersed Diamond Powder Synthesized by Explosive Detonation; Carbon, 1995, vol. 33, No. 12, pp. 1663-1671.

Dolmatov V. Yu, et al; Industrial Synthesis of Detonation Nanodiamonds and the Technologies on Their Basis.

Dolmatov V. Yu, et al; New Generation of Metal-Diamond Galvanic Coatings on the Basis of Detonation Synthesis Nanodiamonds.

Nano-Carbon Specs TU 05121441-275-95; Joint Stock Company "Diamond Centre", pp. 1-26.

Chen et al., "Spherical Nanometer-sized Diamond Obtained From Detonation," Diamond and Related Materials 9 (2000) 1722-1725.

Lee et al., "Effects of Direct Current and Pulse-Plating on the Co-Deposition of Nickel and Nanometer Diamond Powder," Surface and Coating Technology 120-121 (1999) 607-611.

* cited by examiner

| Ch. | Particle diameter (μm) | Total (%) | Amount in channel (%) | Ch. | Particle diameter (μm) | Total (%) | Amount in channel (%) | Ch. | Particle diameter (μm) | Total (%) | Amount in channel (%) |
|---|---|---|---|---|---|---|---|---|---|---|---|
| 1 | 0.10 | 0.00 | 0.00 | 21 | 3.02 | 52.18 | 11.33 | 41 | 91.09 | 100.00 | 0.00 |
| 2 | 0.12 | 0.00 | 0.00 | 22 | 3.58 | 63.65 | 11.47 | 42 | 108.01 | 100.00 | 0.00 |
| 3 | 0.14 | 0.00 | 0.00 | 23 | 4.24 | 74.63 | 10.98 | 43 | 128.07 | 100.00 | 0.00 |
| 4 | 0.17 | 0.00 | 0.00 | 24 | 5.03 | 83.98 | 9.35 | 44 | 151.86 | 100.00 | 0.00 |
| 5 | 0.20 | 0.00 | 0.00 | 25 | 5.97 | 91.07 | 7.09 | 45 | 180.07 | 100.00 | 0.00 |
| 6 | 0.23 | 0.00 | 0.00 | 26 | 7.07 | 96.02 | 4.95 | 46 | 213.51 | 100.00 | 0.00 |
| 7 | 0.28 | 0.00 | 0.00 | 27 | 8.39 | 98.77 | 2.75 | 47 | 253.17 | 100.00 | 0.00 |
| 8 | 0.33 | 0.00 | 0.00 | 28 | 9.95 | 99.99 | 1.22 | 48 | 300.19 | 100.00 | 0.00 |
| 9 | 0.39 | 0.01 | 0.01 | 29 | 11.79 | 100.00 | 0.01 | 49 | 355.95 | 100.00 | 0.00 |
| 10 | 0.46 | 0.12 | 0.11 | 30 | 13.98 | 100.00 | 0.00 | 50 | 422.06 | 100.00 | 0.00 |
| 11 | 0.55 | 0.34 | 0.22 | 31 | 16.58 | 100.00 | 0.00 | 51 | 500.45 | 100.00 | 0.00 |
| 12 | 0.65 | 0.64 | 0.30 | 32 | 19.66 | 100.00 | 0.00 | 52 | 593.40 | 100.00 | 0.00 |
| 13 | 0.77 | 0.73 | 0.09 | 33 | 23.31 | 100.00 | 0.00 | 53 | 703.61 | 100.00 | 0.00 |
| 14 | 0.92 | 1.84 | 1.11 | 34 | 27.64 | 100.00 | 0.00 | | | | |
| 15 | 1.09 | 4.34 | 2.50 | 35 | 32.78 | 100.00 | 0.00 | | | | |
| 16 | 1.29 | 8.57 | 4.23 | 36 | 38.86 | 100.00 | 0.00 | | | | |
| 17 | 1.53 | 14.55 | 5.98 | 37 | 46.08 | 100.00 | 0.00 | | | | |
| 18 | 1.81 | 21.97 | 7.42 | 38 | 54.64 | 100.00 | 0.00 | | | | |
| 19 | 2.15 | 30.91 | 8.94 | 39 | 64.79 | 100.00 | 0.00 | | | | |
| 20 | 2.55 | 40.85 | 9.94 | 40 | 76.82 | 100.00 | 0.00 | | | | |

| Ch. | Particle diameter(μm) | Total (%) | Amount in channel(%) | Ch. | Particle diameter(μm) | Total (%) | Amount in channel(%) | Ch. | Particle diameter(μm) | Total (%) | Amount in channel (%) |
|---|---|---|---|---|---|---|---|---|---|---|---|
| 1 | 0.10 | 0.00 | 0.00 | 21 | 3.02 | 54.20 | 11.87 | 41 | 91.09 | 100.00 | 0.00 |
| 2 | 0.12 | 0.00 | 0.00 | 22 | 3.58 | 66.74 | 12.54 | 42 | 108.01 | 100.00 | 0.00 |
| 3 | 0.14 | 0.00 | 0.00 | 23 | 4.24 | 78.33 | 11.59 | 43 | 128.07 | 100.00 | 0.00 |
| 4 | 0.17 | 0.00 | 0.00 | 24 | 5.03 | 87.39 | 9.06 | 44 | 151.86 | 100.00 | 0.00 |
| 5 | 0.20 | 0.00 | 0.00 | 25 | 5.97 | 93.48 | 6.09 | 45 | 180.07 | 100.00 | 0.00 |
| 6 | 0.23 | 0.00 | 0.00 | 26 | 7.07 | 97.30 | 3.82 | 46 | 213.51 | 100.00 | 0.00 |
| 7 | 0.28 | 0.00 | 0.00 | 27 | 8.39 | 99.29 | 1.99 | 47 | 253.17 | 100.00 | 0.00 |
| 8 | 0.33 | 0.00 | 0.00 | 28 | 9.95 | 99.99 | 0.70 | 48 | 300.19 | 100.00 | 0.00 |
| 9 | 0.39 | 0.04 | 0.04 | 29 | 11.79 | 100.00 | 0.01 | 49 | 355.95 | 100.00 | 0.00 |
| 10 | 0.46 | 0.26 | 0.22 | 30 | 13.98 | 100.00 | 0.00 | 50 | 422.06 | 100.00 | 0.00 |
| 11 | 0.55 | 0.77 | 0.51 | 31 | 16.58 | 100.00 | 0.00 | 51 | 500.45 | 100.00 | 0.00 |
| 12 | 0.65 | 1.56 | 0.79 | 32 | 19.66 | 100.00 | 0.00 | 52 | 593.40 | 100.00 | 0.00 |
| 13 | 0.77 | 2.32 | 0.76 | 33 | 23.31 | 100.00 | 0.00 | 53 | 703.61 | 100.00 | 0.00 |
| 14 | 0.92 | 4.59 | 2.27 | 34 | 27.64 | 100.00 | 0.00 | | | | |
| 15 | 1.09 | 8.42 | 3.83 | 35 | 32.78 | 100.00 | 0.00 | | | | |
| 16 | 1.29 | 13.43 | 5.01 | 36 | 38.86 | 100.00 | 0.00 | | | | |
| 17 | 1.53 | 19.15 | 5.72 | 37 | 46.08 | 100.00 | 0.00 | | | | |
| 18 | 1.81 | 25.40 | 6.25 | 38 | 54.64 | 100.00 | 0.00 | | | | |
| 19 | 2.15 | 33.03 | 7.63 | 39 | 64.79 | 100.00 | 0.00 | | | | |
| 20 | 2.55 | 42.33 | 9.30 | 40 | 76.82 | 100.00 | 0.00 | | | | |

| Ch. | Particle diameter(μm) | Total (%) | Amount in channel (%) | Ch. | Particle diameter(μm) | Total (%) | Amount in channel (%) | Ch. | Particle diameter(μm) | Total (%) | Amount in channel (%) |
|---|---|---|---|---|---|---|---|---|---|---|---|
| 1 | 0.10 | 0.00 | 0.00 | 21 | 3.02 | 53.38 | 11.87 | 41 | 91.09 | 100.00 | 0.00 |
| 2 | 0.12 | 0.00 | 0.00 | 22 | 3.58 | 66.12 | 12.74 | 42 | 108.01 | 100.00 | 0.00 |
| 3 | 0.14 | 0.00 | 0.00 | 23 | 4.24 | 78.06 | 11.94 | 43 | 128.07 | 100.00 | 0.00 |
| 4 | 0.17 | 0.00 | 0.00 | 24 | 5.03 | 87.46 | 9.40 | 44 | 151.86 | 100.00 | 0.00 |
| 5 | 0.20 | 0.00 | 0.00 | 25 | 5.97 | 93.75 | 6.29 | 45 | 180.07 | 100.00 | 0.00 |
| 6 | 0.23 | 0.00 | 0.00 | 26 | 7.07 | 97.60 | 3.85 | 46 | 213.51 | 100.00 | 0.00 |
| 7 | 0.28 | 0.00 | 0.00 | 27 | 8.39 | 99.48 | 1.88 | 47 | 253.17 | 100.00 | 0.00 |
| 8 | 0.33 | 0.00 | 0.00 | 28 | 9.95 | 99.99 | 0.51 | 48 | 300.19 | 100.00 | 0.00 |
| 9 | 0.39 | 0.05 | 0.05 | 29 | 11.79 | 100.00 | 0.01 | 49 | 355.95 | 100.00 | 0.00 |
| 10 | 0.46 | 0.27 | 0.22 | 30 | 13.98 | 100.00 | 0.00 | 50 | 422.06 | 100.00 | 0.00 |
| 11 | 0.55 | 0.79 | 0.52 | 31 | 16.58 | 100.00 | 0.00 | 51 | 500.45 | 100.00 | 0.00 |
| 12 | 0.65 | 1.59 | 0.80 | 32 | 19.66 | 100.00 | 0.00 | 52 | 593.40 | 100.00 | 0.00 |
| 13 | 0.77 | 2.39 | 0.80 | 33 | 23.31 | 100.00 | 0.00 | 53 | 703.61 | 100.00 | 0.00 |
| 14 | 0.92 | 4.66 | 2.27 | 34 | 27.64 | 100.00 | 0.00 | | | | |
| 15 | 1.09 | 8.46 | 3.80 | 35 | 32.78 | 100.00 | 0.00 | | | | |
| 16 | 1.29 | 13.40 | 4.94 | 36 | 38.86 | 100.00 | 0.00 | | | | |
| 17 | 1.53 | 18.97 | 5.57 | 37 | 46.08 | 100.00 | 0.00 | | | | |
| 18 | 1.81 | 24.99 | 6.02 | 38 | 54.64 | 100.00 | 0.00 | | | | |
| 19 | 2.15 | 32.37 | 7.38 | 39 | 64.79 | 100.00 | 0.00 | | | | |
| 20 | 2.55 | 41.51 | 9.14 | 40 | 76.82 | 100.00 | 0.00 | | | | |

| Ch. | Particle diameter(μm) | Total (%) | Amount in channel(%) | Ch. | Particle diameter(μm) | Total (%) | Amount in channel(%) | Ch. | Particle diameter(μm) | Total (%) | Amount in channel(%) |
|---|---|---|---|---|---|---|---|---|---|---|---|
| 1 | 0.10 | 0.00 | 0.00 | 21 | 3.02 | 57.12 | 11.09 | 41 | 91.09 | 100.00 | 0.00 |
| 2 | 0.12 | 0.00 | 0.00 | 22 | 3.58 | 68.80 | 11.68 | 42 | 108.01 | 100.00 | 0.00 |
| 3 | 0.14 | 0.00 | 0.00 | 23 | 4.24 | 79.76 | 10.96 | 43 | 128.07 | 100.00 | 0.00 |
| 4 | 0.17 | 0.00 | 0.00 | 24 | 5.03 | 88.42 | 8.66 | 44 | 151.86 | 100.00 | 0.00 |
| 5 | 0.20 | 0.00 | 0.00 | 25 | 5.97 | 94.23 | 5.81 | 45 | 180.07 | 100.00 | 0.00 |
| 6 | 0.23 | 0.00 | 0.00 | 26 | 7.07 | 97.80 | 3.57 | 46 | 213.51 | 100.00 | 0.00 |
| 7 | 0.28 | 0.00 | 0.00 | 27 | 8.39 | 99.55 | 1.75 | 47 | 253.17 | 100.00 | 0.00 |
| 8 | 0.33 | 0.00 | 0.00 | 28 | 9.95 | 100.00 | 0.45 | 48 | 300.19 | 100.00 | 0.00 |
| 9 | 0.39 | 0.04 | 0.04 | 29 | 11.79 | 100.00 | 0.00 | 49 | 355.95 | 100.00 | 0.00 |
| 10 | 0.46 | 0.26 | 0.22 | 30 | 13.98 | 100.00 | 0.00 | 50 | 422.06 | 100.00 | 0.00 |
| 11 | 0.55 | 0.79 | 0.53 | 31 | 16.58 | 100.00 | 0.00 | 51 | 500.45 | 100.00 | 0.00 |
| 12 | 0.65 | 1.59 | 0.80 | 32 | 19.66 | 100.00 | 0.00 | 52 | 593.40 | 100.00 | 0.00 |
| 13 | 0.77 | 2.29 | 0.70 | 33 | 23.31 | 100.00 | 0.00 | 53 | 703.61 | 100.00 | 0.00 |
| 14 | 0.92 | 4.68 | 2.39 | 34 | 27.64 | 100.00 | 0.00 | | | | |
| 15 | 1.09 | 9.00 | 4.32 | 35 | 32.78 | 100.00 | 0.00 | | | | |
| 16 | 1.29 | 14.92 | 5.92 | 36 | 38.86 | 100.00 | 0.00 | | | | |
| 17 | 1.53 | 21.79 | 6.87 | 37 | 46.08 | 100.00 | 0.00 | | | | |
| 18 | 1.81 | 29.03 | 7.24 | 38 | 54.64 | 100.00 | 0.00 | | | | |
| 19 | 2.15 | 37.08 | 8.05 | 39 | 64.79 | 100.00 | 0.00 | | | | |
| 20 | 2.55 | 46.03 | 8.95 | 40 | 76.82 | 100.00 | 0.00 | | | | |

| Ch. | Particle diameter(μm) | Total (%) | Amount in channel (%) | Ch. | Particle diameter(μm) | Total (%) | Amount in channel (%) | Ch. | Particle diameter(μm) | Total (%) | Amount in channel (%) |
|---|---|---|---|---|---|---|---|---|---|---|---|
| 1 | 0.10 | 0.00 | 0.00 | 21 | 3.02 | 65.09 | 11.08 | 41 | 91.09 | 100.00 | 0.00 |
| 2 | 0.12 | 0.00 | 0.00 | 22 | 3.58 | 76.46 | 11.37 | 42 | 108.01 | 100.00 | 0.00 |
| 3 | 0.14 | 0.00 | 0.00 | 23 | 4.24 | 86.45 | 9.99 | 43 | 128.07 | 100.00 | 0.00 |
| 4 | 0.17 | 0.00 | 0.00 | 24 | 5.03 | 93.51 | 7.06 | 44 | 151.86 | 100.00 | 0.00 |
| 5 | 0.20 | 0.00 | 0.00 | 25 | 5.97 | 97.47 | 3.96 | 45 | 180.07 | 100.00 | 0.00 |
| 6 | 0.23 | 0.00 | 0.00 | 26 | 7.07 | 99.21 | 1.74 | 46 | 213.51 | 100.00 | 0.00 |
| 7 | 0.28 | 0.00 | 0.00 | 27 | 8.39 | 100.00 | 0.79 | 47 | 253.17 | 100.00 | 0.00 |
| 8 | 0.33 | 0.01 | 0.01 | 28 | 9.95 | 100.00 | 0.00 | 48 | 300.19 | 100.00 | 0.00 |
| 9 | 0.39 | 0.12 | 0.11 | 29 | 11.79 | 100.00 | 0.00 | 49 | 355.95 | 100.00 | 0.00 |
| 10 | 0.46 | 0.62 | 0.50 | 30 | 13.98 | 100.00 | 0.00 | 50 | 422.06 | 100.00 | 0.00 |
| 11 | 0.55 | 1.80 | 1.18 | 31 | 16.58 | 100.00 | 0.00 | 51 | 500.45 | 100.00 | 0.00 |
| 12 | 0.65 | 3.81 | 2.01 | 32 | 19.66 | 100.00 | 0.00 | 52 | 593.40 | 100.00 | 0.00 |
| 13 | 0.77 | 6.40 | 2.59 | 33 | 23.31 | 100.00 | 0.00 | 53 | 703.61 | 100.00 | 0.00 |
| 14 | 0.92 | 10.75 | 4.35 | 34 | 27.64 | 100.00 | 0.00 | | | | |
| 15 | 1.09 | 16.60 | 5.85 | 35 | 32.78 | 100.00 | 0.00 | | | | |
| 16 | 1.29 | 23.39 | 6.79 | 36 | 38.86 | 100.00 | 0.00 | | | | |
| 17 | 1.53 | 30.41 | 7.02 | 37 | 46.08 | 100.00 | 0.00 | | | | |
| 18 | 1.81 | 37.32 | 6.91 | 38 | 54.64 | 100.00 | 0.00 | | | | |
| 19 | 2.15 | 45.03 | 7.71 | 39 | 64.79 | 100.00 | 0.00 | | | | |
| 20 | 2.55 | 54.01 | 8.98 | 40 | 76.82 | 100.00 | 0.00 | | | | |

| Ch. | Particle diameter(μm) | Total (%) | Amount in channel(%) | Ch. | Particle diameter(μm) | Total (%) | Amount in channel(%) | Ch. | Particle diameter(μm) | Total (%) | Amount in channel(%) |
|---|---|---|---|---|---|---|---|---|---|---|---|
| 1 | 0.10 | 0.00 | 0.00 | 21 | 3.02 | 46.21 | 10.96 | 41 | 91.09 | 100.00 | 0.00 |
| 2 | 0.12 | 0.00 | 0.00 | 22 | 3.58 | 58.37 | 12.16 | 42 | 108.01 | 100.00 | 0.00 |
| 3 | 0.14 | 0.00 | 0.00 | 23 | 4.24 | 70.29 | 11.92 | 43 | 128.07 | 100.00 | 0.00 |
| 4 | 0.17 | 0.00 | 0.00 | 24 | 5.03 | 80.43 | 10.14 | 44 | 151.86 | 100.00 | 0.00 |
| 5 | 0.20 | 0.00 | 0.00 | 25 | 5.97 | 88.20 | 7.77 | 45 | 180.07 | 100.00 | 0.00 |
| 6 | 0.23 | 0.00 | 0.00 | 26 | 7.07 | 93.88 | 5.68 | 46 | 213.51 | 100.00 | 0.00 |
| 7 | 0.28 | 0.00 | 0.00 | 27 | 8.39 | 97.61 | 3.73 | 47 | 253.17 | 100.00 | 0.00 |
| 8 | 0.33 | 0.00 | 0.00 | 28 | 9.95 | 99.59 | 1.98 | 48 | 300.19 | 100.00 | 0.00 |
| 9 | 0.39 | 0.02 | 0.02 | 29 | 11.79 | 99.95 | 0.36 | 49 | 355.95 | 100.00 | 0.00 |
| 10 | 0.46 | 0.11 | 0.09 | 30 | 13.98 | 100.00 | 0.05 | 50 | 422.06 | 100.00 | 0.00 |
| 11 | 0.55 | 0.33 | 0.22 | 31 | 16.58 | 100.00 | 0.00 | 51 | 500.45 | 100.00 | 0.00 |
| 12 | 0.65 | 0.58 | 0.25 | 32 | 19.66 | 100.00 | 0.00 | 52 | 593.40 | 100.00 | 0.00 |
| 13 | 0.77 | 0.58 | 0.00 | 33 | 23.31 | 100.00 | 0.00 | 53 | 703.61 | 100.00 | 0.00 |
| 14 | 0.92 | 1.95 | 1.37 | 34 | 27.64 | 100.00 | 0.00 | | | | |
| 15 | 1.09 | 4.99 | 3.04 | 35 | 32.78 | 100.00 | 0.00 | | | | |
| 16 | 1.29 | 9.39 | 4.40 | 36 | 38.86 | 100.00 | 0.00 | | | | |
| 17 | 1.53 | 14.57 | 5.18 | 37 | 46.08 | 100.00 | 0.00 | | | | |
| 18 | 1.81 | 20.24 | 5.67 | 38 | 54.64 | 100.00 | 0.00 | | | | |
| 19 | 2.15 | 27.04 | 6.80 | 39 | 64.79 | 100.00 | 0.00 | | | | |
| 20 | 2.55 | 35.25 | 8.21 | 40 | 76.82 | 100.00 | 0.00 | | | | |

| Ch. | Particle diameter(μm) | Total(%) | Amount in channel(%) | Ch. | Particle diameter(μm) | Total(%) | Amount in channel(%) | Ch. | Particle diameter(μm) | Total(%) | Amount in channel(%) |
|---|---|---|---|---|---|---|---|---|---|---|---|
| 1 | 0.10 | 0.00 | 0.00 | 21 | 3.02 | 40.83 | 7.23 | 41 | 91.09 | 100.00 | 0.00 |
| 2 | 0.12 | 0.00 | 0.00 | 22 | 3.58 | 49.14 | 8.31 | 42 | 108.01 | 100.00 | 0.00 |
| 3 | 0.14 | 0.00 | 0.00 | 23 | 4.24 | 57.45 | 8.31 | 43 | 128.07 | 100.00 | 0.00 |
| 4 | 0.17 | 0.00 | 0.00 | 24 | 5.03 | 64.59 | 7.14 | 44 | 151.86 | 100.00 | 0.00 |
| 5 | 0.20 | 0.00 | 0.00 | 25 | 5.97 | 70.33 | 5.74 | 45 | 180.07 | 100.00 | 0.00 |
| 6 | 0.23 | 0.00 | 0.00 | 26 | 7.07 | 75.31 | 4.98 | 46 | 213.51 | 100.00 | 0.00 |
| 7 | 0.28 | 0.00 | 0.00 | 27 | 8.39 | 79.86 | 4.55 | 47 | 253.17 | 100.00 | 0.00 |
| 8 | 0.33 | 0.00 | 0.00 | 28 | 9.95 | 83.93 | 4.07 | 48 | 300.19 | 100.00 | 0.00 |
| 9 | 0.39 | 0.03 | 0.03 | 29 | 11.79 | 87.18 | 3.25 | 49 | 355.95 | 100.00 | 0.00 |
| 10 | 0.46 | 0.18 | 0.15 | 30 | 13.98 | 89.54 | 2.36 | 50 | 422.06 | 100.00 | 0.00 |
| 11 | 0.55 | 0.52 | 0.34 | 31 | 16.58 | 91.16 | 1.62 | 51 | 500.45 | 100.00 | 0.00 |
| 12 | 0.65 | 0.99 | 0.47 | 32 | 19.66 | 92.66 | 1.50 | 52 | 593.40 | 100.00 | 0.00 |
| 13 | 0.77 | 1.23 | 0.24 | 33 | 23.31 | 94.42 | 1.76 | 53 | 703.61 | 100.00 | 0.00 |
| 14 | 0.92 | 3.08 | 1.85 | 34 | 27.64 | 96.40 | 1.98 | | | | |
| 15 | 1.09 | 6.90 | 3.82 | 35 | 32.78 | 98.27 | 1.87 | | | | |
| 16 | 1.29 | 12.16 | 5.26 | 36 | 38.86 | 99.62 | 1.35 | | | | |
| 17 | 1.53 | 17.86 | 5.70 | 37 | 46.08 | 99.96 | 0.34 | | | | |
| 18 | 1.81 | 23.18 | 5.32 | 38 | 54.64 | 100.00 | 0.04 | | | | |
| 19 | 2.15 | 28.33 | 5.15 | 39 | 64.79 | 100.00 | 0.00 | | | | |
| 20 | 2.55 | 33.60 | 5.27 | 40 | 76.82 | 100.00 | 0.00 | | | | |

1

2 a)

b)

STABLE AQUEOUS SUSPENSION LIQUID OF FINELY DIVIDED DIAMOND PARTICLES, METALLIC FILM CONTAINING DIAMOND PARTICLES AND METHOD OF PRODUCING THE SAME

This application is a division of U.S. application Ser. No. 11/335,734, filed on Jan. 20, 2006, now U.S. Pat. No. 7,585, 360, which is a divisional application of prior application Ser. No. 10/231,441, filed Aug. 30, 2002, now U.S. Pat. No. 7,115, 325.

BACKGROUND OF THE INVENTION

1. Field of the Invention

The present invention relates to a stable aqueous suspension liquid of ultradispersed diamond particles having particle size of, for instance, 4.2 nm or less in average diameter (which may also be referred as UDD or nanodiamond hereinafter in this specification), and a diamond powder of UDD obtained from said aqueous suspension liquid, metallic film containing the UDD particles and preparation method of the aqueous suspension-liquid and the metallic film.

In general, these UDD particles have 2 nm to 70 nm of diameter, definitively 2 nm to 40 run of diameter, and in case of the dry powder obtained from the aqueous suspension liquid, several to thousands primary UDDs pareticles, generally, tens to hundreds primary UDDs pareticles are being quasi-aggregated and having a numeral average diameter of 150 to 600 nm and bigger particles having more than 1000 nm of diameter and smaller particles having less than 30 nm of diameter are rare.

2. Description of the Related Art

It is known that preparation method of fine diamond particles called ultra dispersed diamond (UDD), in which by imposing shock waves to a carbonaceous material, UDD are produced. For instances, Japanese Examined Patent Publications of Tokkou Shou 42-19684, Tokkyou Shou 43-4641, Japanese Unexamined Patent Publications of Tokkai Shou 46-1765, Tokkai Shou 50-157296 disclose that diamond-like fine particles are produced by imposing an impulse voltage formed between a pair of opposite electrodes to a carbon material placed in high pressure and high temperature liquid. And Japanese Unexamined Patent Publications of Tokkai Shou 48-3759, Tokkai Shou 48-8659, Tokkai Shou 49-8486 Tokkai Shou 49-39595, Tokkai Shou 49-51196, Tokkai Shou 50-149595, Tokkou Shou 53-30969, Tokkai Shou 54-4298, Tokkai Shou 55-56007, Tokkai Shou 55-56829, Tokkai Shou 55-90410, Tokkai Shou 57-194040, Tokkai Shou 60-48133, Japanese Unexamined Patent Publication of Tokkai Hei 4-83525, Japanese Examined Patent Publications of Tokkou Hei. 1-14994 disclose that diamond-like fine particles are produced by imposing a super high pressure of shock waves which are generated by detonation of explosive, to a carbon material. Japanese Unexamined Patent Publication of Tokkai Hei 1-234311 discloses a producing method of synthetic diamond which comprises steps of holding a high vacuum state in a tubular reaction container made of quartz, producing a crude diamonds by using a detonation synthesis technique, exposing the crude diamonds to oxygen plasma gas at a low temperature for oxidizing combustible carbonaceous powder contents to a gas phase, and separating synthetic diamonds from the tubular reaction container.

As shown in FIG. 31 (which is, for just scientific reference, a copy cited from the Bull. Soc. Chim. Fr. Vol. 134 (1997), pp. 875-890), fine diamond particles synthesized by such a shock imposing method may commonly exhibit some prominent reflective intensity peak at 26.5±2° of the Bragg angle (2θ) implying the presence of not transformed graphite structure, in addition to common peak 44±2° of the Bragg angle (2θ) pertinent to a (111) crystal structure of diamond, in the X-ray diffraction (in scanning with Cu—Kα radiation at 30 kV of bulb potential and 15 mA of bulb current).

Japanese Unexamined Patent Publication of Tokkai Hei 2-141414 discloses a synthesis process of diamond in which the process is executed by steps of forming a source material composition 10 g consisting of 80% of an explosive (hexogen), 14.2% of graphite and 5.8% of paraffin, to a cylindrical form having 2 cm diameter and 1.47 g/cc density, placing the cylindrical form of source material composition, into the inside space of a tube having side end opening or side ends openings, attaching 1.5 g of hexogen and a No. 6 electric detonator to the cylindrical form of the source material composition, then detonating the cylindrical form of the source material composition which being sunk at a depth of one meter in an inverted cone shaped water tank container sized 1.5 m in diameter and 2 m in height and the detonations are repeated 10 times to sum up to total detonated amount 100 g, treating the reaction product with nitric acid, and a mixture of hydrochloric acid and nitric acid, and a mixture of hydrofluoric acid and nitric acid, respectively, then washing plural times with waters and drying the obtained material, to obtain synthesized diamond which has no peak at the Bragg angle (2θ) of 26.5±2°, by 11.5% yield.

With regard to characteristics of diamond obtained by explosive shock method, "Science", Vol. 133, No. 3467, pp. 1821-1822, published in June of 1961 by the American Association for the Advancement of science, Washington, describes that to study of the effects of explosive shocks on various minerals, samples of spectro-scopically pure artificial graphite were exposed to shock pressures estimated at 300, 000 atm for 1 μsec, and the recovered fragments, which were microscopically resembled with the original material, were rather brittle and did not possess greasy texture of normal graphite powder when ground in a mortar, and X-ray diffraction pattern of the shocked graphite showed three additional lines, weak and slightly broadened, which could be indexed as (111), (220), and (311) these are only possible reflections from diamond, and specimen ground and centrifuged in bromoform showed density 2.87 g/cm$^3$ which is a mean value between 2.25 g/cm$^3$ pursuant to graphite and 3.5 g/cm$^3$ pursuant to diamond, and the distance between bonded atoms in the diamond component is 2.06 angstroms which is very different from 3.35 angstroms of the distance between graphite atoms.

FIG. 32 (which is, for just scientific reference, a copy cited from Bull. Soc. Chim. Fr., Vol. 134 (1997), pp. 875-890) illustrates pressure/temperature dependent profiles of carbon at diamond phase, graphite phase, and liquid phase.

According to "Effect of hydrogen in ultradisperse diamond structure", Physics of the Solid State, Vol. 42, No. 8 (2000), pp. 1575-1578 and "Structure and defects of detonation synthesis nanodiamond", Diamond and Related Materials, Vol. 9 (2000), pp. 861-865, UDD synthesized by the shock conversion method is in the form of aggregates of fine particles having 40 to 50 angstroms diameter and 100 nanometers at the maximum, and each UDD particle consists of a lattice core of sp$^3$ carbons which is wrapped with a shell of active sp$^2$ carbons having 4 to 10 angstroms thickness.

Also, depicted in "Chemical Physics Letters", 222, pp. 343-346, published in May of 1994, onion-like carbon from ultra disperse diamond (UDD) denotes that the detonation samples were prepared from 50/50 TNT/RDX (trotyl/cyclotrimethylene-tnnitramine) by igniting fire shock in a hermetic tank, and the UDD (with 3.0 to 7.0 nm in the diameter, 4.5 nm in the average diameter) have been isolated from the detonation soot by oxidative removal of non-diamond carbon with $HClO_4$, the elementary cell parameter of the UDD $\alpha$=0.3573 nm (0.35667 nm for bulk diamond), and an elemental analysis of the UDD has shown a relatively high concentrations of hydrogen-, nitrogen- and oxygen-containing groups which could be partially removed from the sample by heating in vacuum, however, a portion of such elements are possibly included in the annealed products, and denotes that the UDD annealing was performed in a tantalum cap heated by an electronic beam at 1000-1500° C., which was placed in a high-vacuum chamber, and from XRD data of the UDD, the distance of faces between the (111) reflections (lattice parameter) of this UDD was 0.2063 nm (for bulk diamond $d_{11}$=0.205 nm), and by such heating, surface energy of the UDD was decreased therefore the volume of the UDD was dramatically increased from 2.265 g/m$^3$ to 3.515 g/m$^3$, due to the extinction of dangling bonds, and in case of the number of surface atoms of each UDD particle is not large enough to form a completely closed spherical graphite network, the carbon atoms form an onion-like shape consisting of concentric fullerene shells, and the most stable, octagonal lattice of resultant diamond crystals consists of 1683 carbon atoms having a diameter of 2.14 nm, in which 530 carbon atoms are the surface atoms, and in comparison, a cubic crystal form of diamond of the same size has 434 carbon atoms as the surface atoms.

In general, element analysis of UDD implies the presence of hydrogen contained groups, nitrogen contained groups, and oxygen contained groups, however it does not identify the detailed kind and quantity of the groups.

Carbon, Vol. 33, No. 12 (1995), pp. 1663-1671 reporting FTIR Study of ultradispersed diamond powder synthesized by shock conversion", describes that UDD synthesized in a reaction mixture of carbon, micro-graphite, carbon black and so forth, by detonation of a carbon-containing explosive which includes a significantly negative balance of oxygen atoms than chemically equivalent amount of oxygen to react with carbon atoms and other oxidative atoms in the chemical structure of the explosive, has highly defective structural surfaces, high activity and absorptivity which were inspected by various techniques such as differential thermal analysis, mass-spectrum analysis, gas chromatography, polarography, X-ray photoelectric spectroscopy, TEM, or IR spectroscopy (1. V. I. Trefilov, G. I. Savaakin, V. V. Skorokhod, Yu. M. Solonin and B. V. Fenochka, Prosh. Metall. (in Russian), Vol. 1, No. 32 (1979); 2. N. R. Gneiner, D. S. Phillips, J. D. Johnson and F. Volk, Nature, 333(6172) and 440 (1988); 3. A. A. Vereschagin, G. V. Sakovich, A. A. Petrova, V. V. Novoselov and P. M. Brylyakov, Doklagy Akademii Nauk USSR, 315,104 (1990) (in Russian); 4. A. A. Vereschagin, G. M. Ulyanova, V. V. Novaselov, L. A. Petrova and P. M. Brylyakov, Sverkhtverdyi Materialy, 5,20 (1990) (in Russian); 5. A. L. Vereschagin, a V. Sakovich, V. F. Kamarov, and E. A. Petrov, Diamond Relat. Mater. 3,160 (993); 6. B. I. Reznik, Yu. M. Rotner, S. M. Rotner, S. V. Feldman, and E. M. Khrakovskaya, Zh. Prikl. Spektr. 55,780 (1990) (in Russian); 7. F. M. Tapraeva, A. N. Pushkin, I. I. Kulakova, A. P. Rydeko, A. A. Elagin, and S. V. Tikhomirov, Zh. Fiz. Khimii 64,2445 (1990) (in Russian); 8. V. K. Kuznetsov, M. N. Aleksandrov, I. V. Zagoruiko, A. L. Chuvilin, E. M. Moroz, V. N. Kolomiichuk, V. A. Likholobov, and P. N. Brylyakov, Carbon 29,665 (1991); 9. V. F. Loktev, V. I. Makalskii, E. V. Stoyanova, A. V. Kalinkin, V. A. Likholobov, and V. N. Michkin, Carbon 29,817 (1991); 10. T. M. Gubarevich, V. F. Pyamerikov, I. S. Larionova, V. Yu. Dolmotov, R. R. Samaev, A. V. Tyshetskaya, and L. I. Poleva, Zh. Prikl. Khimii 65,2512 (1992) (in Russian); 11. G. A. Chigonova, A. S. Chiganov, and Yu. V. Tushko, Zh. Prikl. Khimii 65,2598 (in Russian); 12. D. S. Knight and W. B. White, J. Mater. Res. 4,385 (1989); 13. P. V. Huong, J. Molec. Structure 292,81 (1993); 14. B. Dischler, C. Wild, W. Muller-Sebert, and P. Koild, Physica B 185,217 (1993); 15. T. Ando, S. Inoue, M. Ishii, M. Kano, and Y. Sato, J. Chem. Soc., Farad. Trans. 89.749 (1993); and 16. T. Ando, M. Ishii, M. Kano, and Y. Sato, J. Chem. Soc., Farad. Trans. 89,1783 (1993).

This literature also says that the IR spectroscopic measurements are however scarcely denoted heretofore.

It is also described in this literature that the UDD obtained by a detonation method shown in Energetic Materials 1,19 (1993) (in Chinese) by K. Xu. Z. Jin, F. Wei and T. Jiang, and subjected to (I) removing process to remove metal impurities using 18% HCl for one hours, decanting with water, dry distilling with a mixture of $HClO_4$(71%):$HNO_3$(65%)=6:1 at 200° C. for two hours until their color turns from black to thin brown, and having 250 to 270 m$^2$/g of specific surface and 3.3 g/cm$^3$ of density by a BET technique, elemental content of 85.87% of carbon, 1.95% of nitrogen, 0.60% of hydrogen, 0.16% of sulfur, and less than 11% of oxygen and has an initial drying loss of 0.37%, exhibits its IR absorption spectrum characteristics as shown in FIGS. 33 to 36 (which is, for just scientific reference, copies cited from this "Carbon", Vol. 33, No. 12 (1995), pp. 1663-1671), where the resultant product being denoted by the real lines and its profile after heated at 140° C. for five hours being denoted by the dotted lines, and in FIG. 34 illustrating an enlarged portion from 3700 cm$^{-1}$ to 3000 cm$^{-1}$ of the deconvoluted spectrum profile of FIG. 37, FIG. 35 which are illustrating another enlarged portion from 1900 cm$^{-1}$ to 1500 cm$^{-1}$ of the same profile, FIG. 36 which is illustrating a further enlarged portion from 1500 cm$^{-1}$ to 900 cm$^{-1}$ of the same profile); And alternatively, another UDD subjected to (II) removing metal impurities with the use of 18% HCl for one hours, decanting with water, dry distilling with a mixture of $H_2SO_4$(98%):fuming sulfuric acid, $SO_3$ (less than 50%):$HNO_3$(65%)=2:1:1 and a small amount of HCl at 270° C. for two hours until their color turns from black to thin brown, and having elemental content of 87.58% of carbon, 2.14% of nitrogen, 0.62% of hydrogen, 0.00% of sulfur, and less than 10% of oxygen and has an initial drying loss of 0.127% by weight, exhibits its IR absorption spectrum characteristics as shown in FIGS. 37 to 40 (where the resultant product being denoted by the real lines and its profile after heated at 140° C. for five hours being denoted by the dotted lines, FIG. 38 which is illustrating an enlarged portion from 3700 cm$^{-1}$ to 3000 cm$^{-1}$ of the deconvoluted spectrum profile of FIG. 37, FIG. 39 which are illustrating another enlarged portion from 1900 cm$^{-1}$ to 1500 cm$^{-1}$ of the same profile, FIG. 40 which is illustrating a further enlarged portion from 1500 cm$^{-1}$ to 900 cm$^{-1}$ of the same profile).

It is also described in this literature that ER spectra of aforementioned UDD (I) which was dressed by aforementioned treatment (I), and aforementioned UDD (II) which was dressed by aforementioned treatment (II) are identified as shown in TABLE 1, depending upon D. Lin-Vien, N. B. Colthup, W. G. Fateley, J. G Grasselli, "The hand book of infrared and Raman characteristic frequencies of organic molecules", Academic Press, Boston (1991); K. Nakanishi, P. H. Solomon, "Infrared absorption spectroscopy, 2nd edition", Holden Day Inc., San Francisco, Calif. (1977); A. D. Cross, "Introduction to practical infrared spectroscopy, 3rd edition", Butterworth, London (1964); F. M. Tapraeva, A. N. Pushkin, I. I. Kulakova, A. P. Rydenko, A. A. Elagin and S. V. Tikhomirov, "Zh. Fiz. Khimii (in Russian)", 64,2445 (1990) (concluding that the absorptivity of 1733-4740 cm$^{-1}$ is based on ═CO, —COH, —COOH); V. K. Kuznetsov, M. N. Aleksandrov, I. V. Zagoruiko, A. L. Chuvilin, E. M. Moroz, V. N.

Kolomiichuck, V. A. Likholobov, and P. N. Brylyakov, "Carbon", 29,665 (1991) (concluding that the absorptivity of 1733 $cm^{-1}$ and 1670 $cm^{-1}$ by UDD is based on COO—); R. Sappok and H. P. Boehm, "Carbon", 6,283 (1968) (concluding that the absorptivity of 1742 $cm^{-1}$ is based on a ketone group of cyclohexanone and the absorptivity of 1772 $cm^{-1}$ is based on a ketone group of cyclopentanone, the absorptivity of 1760 $cm^{-1}$ may equally be based on a ketone group); and T. Ando, S. Inoue, M. Ishii, M. Kato, and Y. Sato, "J. Chem. Soc., Farad. Trans. 89,749 (1993)" (concluding that the absorptivity of 1760 $cm^{-1}$ is based on a carbonyl group of cyclic carbonic aid anhydride).

It is also noticeable that this literature, with referencing above cited many reports and literatures, says that repeated purification of the UDD with (I) various mixtures of perchloric acid-nitric acid-hydrochloric acid, or (II) various mixture of sulfuric acid-nitric acid-fuming sulfuric acid, are worth nothing for the UDD, when they have been treated with hydrochloric acid to remove metallic impurities then with such kinds of acid mixtures, even if the repeated treatments are conducted after reduction treatment by hydrogen following the purification.

sure onto a carbon material are relatively large in the crystalline structure and may occur particles having sharp angles if shock fracturing thereof is caused, due to whose cleavage shearing property. Very fine particles of diamond (UDD), which is synthesized by imposing an instantaneous dynamic ultra-high pressure to a carbon material, also holds more or less level of such shock fracture properties. Accordingly, as disclosed in Japanese Unexamined Patent Publication of Tokkai Hei 4-83525, such a shock conversion method using an ultra-high pressure of the shock waves generated by detonation of an explosive can be utilized for modification of already synthesized diamonds, where diamonds are embedded in a metal binder and exposed to the shock waves generated by detonation of an explosive to develop their modified form.

The element of group VIII in the Periodic Table of elements such as iron has a catalytic effect in course of the shock conversion reaction of a graphite structure into a diamond structure by detonation of an explosive, and are used as catalysts during the shock conversion of a graphite structure into a diamond structure by detonation of an explosive, and this metal binder would easily provide a favorable pressure-resistant condition for receiving and withstanding for a high pres-

TABLE 1

Summary of main IR frequencies of UDD

| I | | II | | UDD (I) and UDD (II) after reduction | | Assgnment and Remarks |
|---|---|---|---|---|---|---|
| 3430s | 3558<br>3434<br>3425 | 3425s | 3590<br>3425<br>3240 | Same as I, II | | Bonded $\nu_{OH}$<br>$\nu_{OH}$, water, tertiary alcohol<br>Bonded $\nu_{OH}$, $\nu_{NH}$ |
| 2980w<br>2925w | 2965<br>2928<br>2873<br>2852 | 2961w<br>2911w | | 2955sh<br>2927m<br>2887m | 2955<br>2927<br>2871<br>2852 | $\nu_{as}$ $CH_3$<br>$\nu_{as}$ $CH_2$<br>$\nu_s$ $CH_3$, $\nu_{CH}$<br>$\nu_s$ $CH_2$ |
| 1776m | 1780<br>1755 | 1736m | 1783<br>1759<br>1736<br>1271 | | | $\nu_C = 0$ — Cyclic ketonic, Lactam, Ester, carboxylic |
| 1628m | 1676<br>1630 | 1633m | 1663<br>1630<br>1597 | 1697w<br>1632m | 1776<br>1698<br>1679<br>1632<br>1587<br>1653 | $\nu_C = 0$ (amide I)<br>$\delta_{OH}$ water, $\nu_{CO}$ (amide II)<br>$\nu_{NH}$ mixed with (amide II) |
| | | | | 1460w | | $\delta_{as}$ $CH_3$, $CH_2$, CH |
| 1261m | 1334<br>1313<br>1261 | | 1395<br>1328<br>1256 | 1333s | 1379<br>1333<br>1254 | $\delta_s$ $CH_3$, $\delta_{OH}$<br>$\delta_{CH}$, $O^b$, $\nu_{CN}$ or $\delta_{OH}$<br>$\nu_{CO}$ epoxy, ester, $\delta_{CHH}$ (amide III), $D^b$<br>$\nu_{CCO}$ in 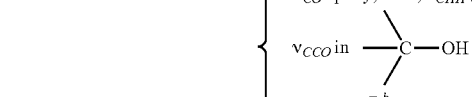 <br>$\nu_{CC}$, $\nu_{CH}$, $D^b$ |
| 1194sh<br>1130s<br>1047sh | 1192<br>1130<br>1043<br>969 | 1217m<br>1125s<br>1046sh | 1217<br>1125<br>1046<br>963 | 1130s<br>1049sh | 1187<br>1130<br>1049<br>959 | $\nu_{as}$ COC either, $\delta_{OH}$<br>$\delta_{OH}$<br>$\delta_{CCC}$, $\nu_{SCOC}$ |
| | 618w<br>~550b | | 619w<br>~550b | | ~550b | $\delta_{CCC}$, $\delta_{NCO}$ (amide IV) |

[a]The frequencies on the right of the brackets are the frequency positions determined by deconvoluted and second-ferivative and fitted spectra. s, Strong; m, medium; sh, shoulder; b, broad
[b]D, N-induced one phonon process and/or defect structure in diamond Generally speaking, fine particles of single-crystal diamond synthesized by imposing a static and ultra-high pressure as 10 GPa or preferably 20 GPa of pressure which is generated by the shock waves of the detonation, furthermore the metal binder is capable of a fast heat transfer for heat absorbing from and radiating to the out side of the system, therefore the metal binder can easily provide a high heat-transfer condition that enables a quick cooling of the reaction system, so that it does not make stay a UDD being once produced by a high temperature such as 3000 degree K or more, in a dangerous state apt to return the UDD to graphite by textural conversion, namely does not stay the UDD in a dangerous state that ultra high pressure of the system for UDD synthesis has already liberated while the temperature is still in high level as 2000 to 1500 degree K.

However, for removing merely metal binder to recover the produced UDD particles which having been buried in the metal binder, a worrisome treatments must be inevitable which might be comprise a removal treatment of the metal covering by cutting or destruction, a dissolving treatment by acid and so forth treatments. Thereafter, it is, of course, further required a treatment for purifying the UDD by removal of impurities such as non reacted graphite or carbon fine particles etc.

Disclosed in Japanese Unexamined Patent Publication of Tokkai Shou 63-303806 is a technique for picking up diamonds synthesized in a metal medium by shock conversion. It discloses that removal of unwanted graphite is difficult by only exposing the synthesized diamonds to fuming nitric acid or concentrated nitric acid or any other strong oxidizer which may be a mixture of hydrogen peroxide, fuming nitric acid or concentrated nitric acid and if desired, potassium permanganate, sodium chlorate, or hydrogen peroxide. Also, there is provided a technical knowledge for a purifying process in this patent document that the process consisting of pressurizing particles of a graphite material having a diameter of 0.1 mm or less and encapsulated in a catalyst metal (Fe50-Ni50 alloy) with a pressure force of 5.2 GPa at a high temperature of 1380° C. for 15 minutes, exposing their resultant aggregate to 35% hydrochloric acid at 100° C. for 3 hours to dissolve and remove the catalyst metal, and oxidizing the resultant powder from graphite to carbon dioxide with using a mixture of concentrated phosphoric acid, concentrated sulfuric acid, and concentrated nitric acid at 320° C. for 5 hours, and this oxidizing steps are repeated three times (in total 15 hours). It is also described that an examination of the product by an XRD analysis (X-ray diffraction using Cu—Kα radiation) revealed some prominent peaks of the intensity pursuant to the (111) plane diamond at 44±2° of the Bragg angle) (2θ±2°) and other peaks indicating the presence of graphite at 26.5°, and when the product is subjected to an ultrasonic wave oxidization process using ultrasonic wave at a resonant frequency 20 KHz by a ceramic ultrasonic wave generator operated at an output power 150 W with a mixture of concentrated sulfuric acid and concentrated nitric acid at a temperature of 320° C. for one hour, and which processes are repeated five times (in total 5 hours), the crystallized diamonds are successfully separated from unwanted graphite particles, and almost all of the graphite have been disappeared by the purification process.

Another shock conversion method for synthesizing diamond powder is disclosed in Japanese Unexamined Patent Publication of Tokkai Shou 56-26711 which comprising steps of mixing a carbon precursor (organic material does not melt by heating, such as phenollic resin, furfuryl alcohol derivatives, cellulose derivatives) provided as the carbon source material with an amount not fewer than 80% by weight of a thermally conductive metal powder (if few than 80% by weight, the productivity will be declined), compressing the mixture into a shape, imposing a shock pressure of 400 to 1500 kilobars to the shaped mixture, and holding a resultant blended diamond powder for 30 minutes in a solution prepared by dissolving 0.1 mol % of sodium chlorate in concentrated nitric acid and keeping a temperature of 80° C. to dissolve and remove non-converted carbons, as a result, the diamond powder can be prepared at a higher productivity (of 60%) which is highly dressed and having a color of substantially white, and by this method, in contradiction to the known theory that the diamond structure returned back to the graphite form when the compressing pressure is smaller than 1500 kilobars, the proposed method of synthesizing fine particles of diamond can be obtained at a higher productivity, than that of a prior art method disclosed in British Patent No. 1154633 which describes:

| Compressing Pressure (Kbar) | Productivity (%) |
|---|---|
| 1,400 | 52-32 |
| 900 | 12, |
| 780 | 5 |

, on the other hand, the proposed method can synthesize diamonds at a productivity of 40% using a pressure of 1000 kilobars.

British Patent No. 1154633, which is referred in aforementioned Japanese Unexamined Patent Publication Tokkai Shou 56-26711, describes that a crude diamond product synthesized from graphite material by shock conversion method under the high enough temperature (2000° C. or more) and pressure (300 to 700 kilobars) is a diamond of particles form which are contained in pocket of substantial quantities of unconverted graphite and inorganic impurities containing silicon, iron, boron, aluminium, calcium and titanium, and from this crude diamond, a purified metallic grey lustre is obtained by purifying with moneral non-oxidising acid such as hydrochloric acid then with oxidising acid such as nitric acid at atmospheric pressure, temperatures of at least 280° C., preferably above 300° C., and this purified diamond is not greater than 0.1 μm of average diameter, 40-400 $m^2/g$ in the surface area, carbon 87% to 92%, hydrogen 0.5% to 1.5%, and not greater than 1.0% in the content of nitrogen and have acidic, and has least 20% of hydrophilic surfaces bonded with functional groups such as hydroxy functional group, carboxy function group, a carbonyl functional group or their derivatives such as carboxylic acid anhydride, lactone, or ether which are coupled with surface carbon atoms, therefore carbon content in this purified diamond is lower than that of natural diamonds.

This British Patent also describes that the synthesized diamond is a mass of interwinded diamond crystallites and corresponding to a particle size not greater than 0.01 μm (100 Å) of average diameter containing so many dislocations that defined crystal faces are not visible, and has no susceptible external crystal surface when inspected by an optical microscope having a power of ×100,000, and when anhydrous, not exhibits pyramid shape pursuant to natural diamond, individual diamond particle is $7\times10^{-1}$ to $10^{-2}$, and also exhibits characteristic infra-red absorption peaks at the wave lengths 5,65 and 16.2 microns and broad bands of absorption at the wave lengths 2.8 to 3.5 microns, and a broad band of absorption at the wave length 9.2 9.8 microns when an hydrous, characteristic infra-red absorption peaks and bands of absorption at the wave lengths indicated when hydrated, and more intense absorption in the region of about 2.9 and 6.1 microns, in addition to the aforementioned the absorptions shown in an hydrous, state, and also describes that this new diamantiferous material, unlike most natural diamonds or man-made diamonds manufactured by other synthetic method, blackens when heated in an argon atmosphere at a temperature in the range from 850° C. to 900° C. for period of 4 hours, and as a result, this diamantiferous material can normally be recognised by the loss of at least 5%, generally at least 8%, of its weight in the form of carbon monoxide, carbon dioxide, Water, and hydrogen.

Further, Japanese Laid-Open Patent Publication of Tokuhyou Shou 57-501080 by Japanese language of PCT WO 82/00458 which corresponding to U.S. Pat. No. 4,483,836 discloses a method of producing diamond and/or diamond-like modifications of boron nitride from a material to be transformed, in which, A method for producing diamond and/or diamond-like modifications of boron nitride by detonating in a container, a charge of a particulate admixture of 1% to 70% of an explosive (for examples cyclotrimethylenetrinitramine (hexogen), cyclo-tetramethylenetetranitramine (octogen), trinitrotoluene (trotyl), trinitrophenylmethylnitramine (tetryl), pentaerythritol tetranitrate (PETN), tetranitromethane (TNM) or mixtures of said explosives) and 99% to 30% of the material to be transformed, selected from the group consisting of: (a) carbon (such as hexagonal graphite, rhombohedral graphite, colloidal graphite, and pyrolytic graphite) to produce diamond, (b) boron nitride to produce diamond-like modifications of boron nitride, (c) carbon and boron nitride to produce a mixture of diamond and diamond-like modifications of boron nitride; and (d) additives (such as water, dry ice, liquid nitrogen, aqueous solutions of metal salts, crystal hydrates, ammonium salts, hydrazine, hydrazine salts, aqueous solutions of hydrazine salts, and liquid or solid hydrocarbons) inert to the material to be transformed, in an amount of 1 to 50% by weight of the charge, which endothermically evaporate and decompose beyond the front of a detonation wave, for cooling heated metal wall and the resulting high-pressure phase (the target product) upon impact compression, to preclude annealing of said phase and its re-conversion to the initial state, wherein said explosive upon detonation produces dynamic pressures varying from about 3 to 60 GPa and temperatures varying from about 2,000 degree K to 6,000 degree K and includes an inactive additive, such as water, ice, liquid nitrogen, metal salt solution, crystalline hydrate, ammonium salt, hydrazine, hydrazine salt, hydrazine salt solution, liquid hydrocarbon, or solid hydrocarbon, which is inactive and can be evaporated and decomposed over the wavefront of shock waves. As the explosive is combined with the carbon material to develop a preparation form, its detonation will be improved. For increasing the productivity of diamonds, the carbon material to be shock converted is added with another material such as a metal which can be heated by a temperature lower than that of the high pressure phase generated by the detonation. This allows the additive to decline the temperature in the high pressure phase hence inhibiting annealing and re-conversion (U.S. Pat. No. 3,401,019 and United Kingdom Patent No. 1,281,002).

And this Publication also discloses that the use as explosives, substances which upon detonation of a charge providing dynamic pressures of 3 to 60 GPa and temperatures of 2000 degree K to 6000 degree K, and such substances are, e.g. cyclotrimethylenetrinitramine (hexogen), cyclo-tetramethylenetetranitramine (octogen), trinitrotoluene (trotyl), trinitrophenylmethylnitramine (tetryl), pentaerythritol tetranitrate (PETN), tetranitromethane (TNM) or mixtures of said explosives, and maximum pressure is determined by the pressure in the chemical peak of the detonation wave, which for hexogen having a density of 1.6 g/cm$^3$ is 60 GPa, and which for trotyl having a density of 0.8 g/cm$^3$ is 3.0 GPa.

Such conventional shock compressing conversion methods of synthesizing diamonds using detonation of explosives explosion of include: (1) method of converting graphite to diamond by making collision a striking body accelerated by the detonation, into the graphite, as disclosed in, for example, Japanese Unexamined Patent Publication of Tokkai Hei 4-83525, (2) method of converting graphite to diamond by making collision a capsule loaded with graphite therein and being accelerated by the detonation, against a target surface for example pooled water surface, then picking up the submerged capsule in water and recovering object (synthesized diamonds) from the inside of the capsule, (3) detonating a mixture of a high-performance explosive and a graphite material to convert the graphite into a diamond form, and the like methods.

The method (1), which is a method comprising steps of colliding an accelerated object to a container of raw material then picking up the colluded container from in water to recover synthesized diamonds, allows the container and other instruments for the collusion to be employed only one time, it never permits to be used two or more times. Also, the amount of the explosive for the detonation is needed some tens of times greater than that of the graphite material corresponding to diamond amount. Accordingly, the method (1) will require more labors and costs for supplying a new set of the components and the explosive at each action. Equally, the method (2) requires more labors for provision of the accelerating arrangement. In addition, as the accelerating arrangement is broken up by the detonation, it has to be rebuilt thus increasing the overall cost. The method (3) employs non of the consumable arrangements but a detonation container in which the mixture of an explosive and a graphite material is detonated then synthesized diamonds are picked up from the products deposited on the inner wall of the container. It is hence necessary that the detonation container is tightly sealed off during the detonation and can be opened for taking up the products. Also, the detonation container has to be rigid enough strength to stand for the detonation and intricately arranged for replacing the air with an inactive gas in the interior or reducing the inner pressure to avoid combustion of the products at the detonation. As its detonation container has to be handled for opening and closing at every action of the detonation, the method (3) similar to the other methods (1) and (2) will also require more labors.

The detonation of an explosive easily produces a high pressure and a high temperature for conversion of the graphite structure of a carbon material into a diamond structure in a reactive system. However, as the inner pressure in a closed reactive system is increased, the temperature soars up. As explained, the heat (temperature) effectively acts on the conversion of the graphite structure into a diamond structure. Also, the high pressure has a primary role for conversion into the diamond structure. When the pressure is instantly released after the diamond synthesizing process while generated heat (temperature) is still remained in the reaction system, the remained heat (temperature) may act on the returning of the diamond structure to the graphite structure. The temperature acting on the returning of the synthesized diamond structure to the graphite structure is generally about 2000° C. in the reactive system when the high pressure has been declined to an atmospheric level. The speed of transmission of the shock waves generated by the detonation ranges commonly from 0.8 km/sec to 12 km/sec. It means that such high pressure is, in only short time, held in the reactive system of a common scale within $10^{-5}$ to $10^{-6}$ of a second. Particularly, the duration of maintaining the pressure at its higher level locally in every minimum reactive area is as short as $10^{-8}$ to $10^{-9}$ of a second. Since the graphite material is elastic and its storage resiliency (tan δ) or loss resiliency (tan δ") for easing the effectiveness of the high pressure is not negligible, the high pressure in the reactive system may be maintained in a less period of the duration. It is hence difficult to quickly decline such high temperature to the atmospheric temperature passing through a temperature zone around 2000° C. which is a temperature for returning back the produced diamond structure to the graphite structure, if in the absence of momentary liberalization of the pressure.

There are also proposed methods for synthesizing diamonds in which a carbon material based on explosive is used. As a typical example, Japanese Unexamined Patent Publication of Tokkai Hei 3-271109 discloses a detonative synthesis method of diamond which is capable of plural desired times of explosions repeatedly and is capable of recovery reaction products easily. The method, which uses an organic explosive composition mixture having a negative value in of OB (Oxygen Balance) denoted by Exhibition (II) with regard to Exhibition (I) showing excess oxygen amount by gram unit in reaction of one gram explosive material, $$CxHyOzNw \rightarrow xCO_2 + y/2H_2O + w/2N_2 - (2x+y/2-z)O_2 \quad (I)$$

$$(OB;\text{Oxygen Balance}) = -16(2x+y/2-z)/Z \quad (II)$$

(where M being the molecular weight of a chemical compound CxHyOzNw) in contrasting with the OB level being set to zero in common industrial explosive by mixing properly a negative OB combustible material and a positive OB oxygen contained inorganic salt, comprises steps of: preparing said organic explosive composition by mixing an explosive compound (such as tri-nitro-toluene TNT, cyclotetramethylene-tetranitroamine HMX, cyclotrimethylene-trinitroamine RDX, penta-erythritol-tetra-nitrate PETN, amine nitrate, amine perchlorate, nitro-glycerin, picric acid, or tetryl) with a combustible material (such as an oxygen reactable carbon precursor such as paraffin, light oil, heavy oil, aromatic compound, plant oil, starch, wood meal, or charcoal) to have an oxygen balance level of −0.25 to −1.2, the organic explosive composition, suspending said explosive composition horizontally at a depth of not smaller than 50 cm (for example, 120 cm) in the water a tube having either one or both ends thereof opened (for example, a steel cylindrical tube having an inner diameter of 27 cm, a length of 125 cm, and a thickness of 0.6 cm and arranged open at one end) and filled with the organic explosive composition (for example, weighted 10 g and consisting mainly of 76.2% of HMX, 19.5% of 2,6-dibrom-4-nitrophenol, and 4.3% of paraffin), detonating the tube a desired number of times by electrical energization of a detonator to synthesize diamonds in the water; draining the water and collecting a diamond contained product deposited at the bottom; and dissolving and removing byproducts such as metals and remaining graphite by a known manner of eliminating the metals with aqua regia or nitric acid and then the remaining graphite with a mixture of hydrochloric acid and nitric acid before treating with a mixture of hydrofluoric acid and nitric acid; washing with water and drying the product to obtain pure, synthesized diamonds (at a productivity of 5.2% based on HMX).

Japanese Laid-Open Patent Publication of Tokuhyou Hei 6-505694 by Japanese language of PCT WO 93/13016 which corresponding to U.S. Pat. No. 5,861,349 discloses a synthetic diamond-bearing material consisting essentially of aggregates of particles of a round or irregular shape, with an average diameter of the particles not exceeding 0.1.mm., the improvement wherein the material comprises: a) elemental composition (% by mass):

| | |
|---|---|
| carbon | 75 to 90, |
| hydrogen | 0.6 to 1.5, |
| nitrogen | 0.8 to 4.5, |
| oxygen | the balance; |

b) phase composition (% by mass):
amorphous carbon 10 to 30, diamond of cubic crystal structure the balance;
c) a porous structure said material having pores with a volume of the pores being within about 0.6 to 1.0 $cm^3/l$;
d) a material surface with 10 to 20% of the material surface being methyl, nitrite, first and second hydroxyl groups having different chemical shifts in an NMR spectrum and one or more oxycarboxylic functional groups selected from the group consisting of carbonyl groups, carboxyl groups, guinone groups, hydroperoxide groups and lactone groups 1 to 2% of the material surface being occupied by carbon atoms with uncompensated bonds; and
e) a specific surface area in a range of from 200 to 450 $m^2/g$;

and a process for preparing a synthetic diamond-bearing material consisting essentially of:
(a) providing a pressure vessel with (i) a charge consisting essentially of at least one carbon-containing solid explosive or mixture of carbon-containing solid explosives, said charge having a negative oxygen balance, and (ii) a medium consisting essentially of gases and carbon particles ultra dispersed as a suspension in the gases in a concentration of about 0.01 to 0.15 $kg/m^3$, said gases consisting essentially of oxygen in an amount of about 0.1 to 6% by volume and a balance of nitrogen or gases inert to carbon;
(b) closing the pressure vessel and detonating the charge, the detonating of the charge being initiated at a temperature of about 303 degree K. to 363 degree K in the absence from the charge of a carbon material other than the carbon-containing explosive or mixture of explosives to form the synthetic diamond-bearing material from decomposition products of the explosive or mixture of explosives and not from the carbon particles in the medium; and
(c) recovering the synthetic diamond-bearing material.

In Yokan Nomura & Kazuro Kawamura Carbon, vol. 22, No. 2, pp. 189-191 (1984)/, there are described some properties of soot produced in detonation of trinitrotoluene in an apparatus made from carbon steel. (The composition of the atmosphere is not reported). From the data of electron microscopy, this specimen mainly comprises a roentgen-amorphous phase of nondiamond carbon constituted by particles of 5 to 10 non flat carbon layers distributed chaotically so that no graphite phase is produced.

Another publication of theoretical investigations, Van Thiel, M. & Rec., F. H. J. Appl. Phys., vol. 62, pp. 1761-1767 (1987) considers some properties of carbon formed in detonation of trinitrotoluene. On the basis of calculation, the authors have made the assumption that the carbon formed under these conditions features excessive energy as against graphite by 1 to 2 kcal/mol. Proceeding from these data the assumption has been made that the carbon particles produced in explosion must have the size of the order of 10 nm.

Another prior art report is issued in N. Roy Greiner, D. S. Phillips, J. D. Johnson & Fred Volk, "Nature", Vol. 333, 2nd, June 1988, pp. 440-442. This prior art discloses the properties of carbon generated by the detonation of an explosive material mixture composition of tri-nitro-toluene and RDX (60/40%), under an argon atmosphere at a room temperature. The condensed product generated by the detonation contains diamonds and non-diamond-transformed carbons, and crystalline analysis and X-ray analysis reveal that the amorphous carbon phase consists of a solid, spheroidal structure of about 7 nm in diameter with a curved belt form of about 4 nm in thickness. It is also described in the report that this non-diamond carbon has an interplanar spacing between completely amorphous graphite and randomly oriented graphite measured 0.35 nm thus having typical reflective (002) planes in an X-ray pattern.

Japanese Laid-Open Patent Publication of Tokuhyou Hei 7-505831 by Japanese language of PCT WO 94/18123 which corresponding to U.S. Pat. No. 5,916,955 describes following instructions as in explanations of a diamond-bearing material comprising carbon, hydrogen, nitrogen and oxygen, wherein the material comprises, carbon of cubic crystal structure of 30 to 75% by mass, amorphous phase of carbon of 10 to 15% by mass, carbon of a non-diamond crystalline phase the balance, with a quantitative ratio of elements, carbon of 84 to 89% by mass, hydrogen 0.3 to 1.1% by mass, nitrogen of 3.1 to 4.3% by mass, oxygen of 2.0 to 7.1% by mass, and incombustible impurities of 2.0 to 5.0% by mass, the crystalline carbon phase having a surface containing methyl, carboxyl, quinone, lactone, ether, and aldehyde functional groups, the material having a unit surface of about 218 to 600 $m^2/g$; and following instructions as in explanations of aforementioned diamond-bearing material.

Namely, this Patent Publication describes that the crystalline and roentgen-amorphous carbon phases are made up of compact spheroids of a diameter of some 7 nm and bent bands around 4 nm thick. The nondiamond form of carbon is characterized on the X-ray pattern by an inter-plane spacing of 0.35 nm typical of reflection (002) for the fully amorphous and randomly disoriented graphite.

This Patent Publication describes that the diamond carbon phase compact spheroids of a diameter of some 7 nm. In the studies by the method of electron diffraction, the following set of inter-plane reflections has been recorded: d=0.2058, 0.1266, 0.1075, 0.884, 0 and 0.636 nm which correspond to the reflection planes (111), (220), (311), (400) and (440) of the diamond.

This Patent Publication also describes that the product of the claimed invention was produced in detonation of an oxygen-deficient explosive in a closed volume in a medium inert towards carbon which is synthesized at a cooling rate of the detonation products of 200 to 600 degree/min.

This Patent Publication also describes that commonly use was made for the purpose of an explosive of the composition: trinitrotoluene/RDX (octogen, analogue of RDX) of 50/50 to 70/30. The material of the invention is a black powder with a unit surface of 218 to 6000 $m^2/g$, a specific weight in the range from 2.2 to 2.8 $g/cm^3$ and a humidity of 4.0%. The specific weight of the specimens is defined by the proportion of incombustible impurities, mainly iron. The proportion of incombustible impurities in the product of the invention claimed varies within the limits from 2.0 to 5.0%.

This Patent Publication also describes that the incombustible impurities include magnetite, an alpha-modification of iron and ferric carbide. From data of gamma-resonance spectroscopy, the following distribution of intensities in the spectrum takes place: the contribution of the lines of alpha-iron constitutes 29 to 43%, of magnetite is 36 to 48% and of the ions of ferric iron (represented by ferric carbide) is 16 to 27%. By the elemental composition, the product includes (% by mass) from 84.0 to 89.0 carbon, from 0.3 to 1.1 hydrogen, from 3.1 to 4.3 nitrogen; from 2.0 to 7.1% oxygen (by the difference). (The elemental composition is determined using the standard combustion technique of organic chemistry).

This Patent Publication also describes that Data of nitrogen and carbon distribution have been obtained using the method of X-ray photoelectron spectroscopy. It was found that the following relationship between the atoms of oxygen and carbon, nitrogen and carbon takes place in the source specimen: O/C=0.030 to 0.040, N/C=0.01 to 0.03. After etching the surface with argon ions these relationships changed: O/C=0.017 to 0.020, N/C=001 to 0.0005. This is indicative of the presence of oxygen- and nitrogen-containing groups on the surface of the particles. A low-molecular component of the claimed substance was separated by extraction with non-polar solvents (tetrachlorated carbon, ether, n-hexane and benzene). The fraction of the total mass varies within the limits 0.36 to 1.13% and is a mixture of organic compounds. From the data of IR-spectroscopy, there was revealed the presence of such functional groups as OH, NH, $CH_2$—, $CH_3$—, CH— and —C—O—C— groups. These compounds are the products of condensation of the stable fragments of molecules in a detonation wave.

This Patent Publication also describes that information of the surface condition was obtained making recourse to the methods as follows. By the data of gas-chromatographic analysis, the following gases are separated when heating in a vacuum at 673 degree K during 2 hours: methane 0.03 to 0.47 $cm^3/g$, hydrogen 0.03 to 0.30 $cm^3/g$, carbon dioxide 0.02 to 0.84 $cm^3/g$, oxygen 0.00 to 0.05 $cm^3/g$ and nitrogen 0-20 to 1.83 $cm^3/g$. The total gas separation varies within the limits 0.36 to 2.98 $cm^3/g$. These data show that the surface of the claimed product includes methyl (because methane is separated) and carboxyl (because separation of $CO_2$ is detected) groups. On the basis of the data on gas evolution from specimens at the temperatures 573 to 773 degree K, activation energies were determined for a number of gases: 103.6 kJ/mol for carbon monoxide, 23.4 kJ/mol for carbon dioxide, 22.5 kJ/mol for nitrogen and 47.6 kJ/mol for methane. The values of the activation energy obtained point to that the evolved gases are not adsorbed by the surface but are rather formed in breaking of the chemically bonded surface groups. According to the data of polarographic studies, quinone, lactone, carbonyl, aldehyde and ether groups were present in all specimens. But methyl groups prevail in the product according to the invention, therefore the material features a water-repellent property. This, in turn, defines the sphere of application of the material in composites containing nonpolar components, such as rubbers, polymers, oils. Any chemical treatment materially influences the surface properties of the substance and the possibility of its use in one or another composite material. Distribution of the carbon forms in the substance of the present invention has been found by using X-ray photoelectron spectroscopy (XPES). From the data of XPES, C line is represented by a broad asymmetric peak with a halfbreadth of 4.1 eV, which, after being bombarded with argon ions narrows to 2.5 eV and takes the shape typical of graphite or finely dispersed coals. The surface charge is equal to zero, which is characteristic of electrical conductors. It may be assumed that the spectrumen volume is represented by the phase of nondiamond carbon and diamond carbon, the diamond carbon being distributed in particles. Information on the phase composition of the material of the present invention was obtained using the method of X-ray: phase analysis.

The X-ray patterns of the studied specimens contain, along with three lines relating to the diamond phase of carbon, reflection (002) of carbon and a broad maximum with d=0.418 nm relating to the roentgen-amorphous phase of carbon, the presence of this phase being stipulated by the conditions of synthesis. The presence of the latter maximum particularly distinctly shows up after partial oxidation of the substance with either air oxygen or an oxidizing mixture of acids).

This Patent Publication also describes that distribution of the material particles was found by the method of small-angle scattering. As follows from the curve, size distribution of the particles is characterized by a single maximum in the region between 40 and 50 A. And from these data the carbon phases are not divided by particle sizes. Investigation into the behavior of specimens heated in the air atmosphere showed that one broad exoeffect with a maximum at 683 to 773 degree K is observed on a DTA curve, which is indicative of a very high homogeneity of the material. It is not found possible to separate the material into nondiamond and diamond forms of carbon without destroying one of them. On the basis of the conducted investigations, the following particle structure of the material according to the invention can be assumed. A diamond nucleus in the center is surrounded by the roentgen-amorphous phase of carbon. The roentgen-amorphous carbon phase in contact with the nucleus comprises a roentgen-amorphous phase of diamond which passes through the roentgen-amorphous carbon phase into a crystalline phase of carbon. Surface groups are found on the surface of the crystalline carbon phase. The diamond-carbon material of the present invention is produced by detonating an oxygen-deficient explosive in a closed volume in a medium inert towards carbon at a cooling rate of the detonation products of 200 to 6000 degree/min in a conventional blasting chamber. The explosion temperature of the composition T/RDX 60/70 amounts to (depending on the calculation method) 3500 to 4000 degree K, and after the explosion the products are cooled down to 350 degree K. If we take the rate of cooling of the order of 7000 degree/min, then under these conditions a carbon phase will be formed containing 70 to 80% by mass-of-the cubic phase (diamond). But for realizing such cooling conditions, it is required that the volume of the blasting chamber exceed about one million times the volume of the explosive charge. In other words, in blasting a charge of 1 kg of explosive of the composition T/RDX 60/40 a blasting chamber of about 500 $m^3$ is required, which is economically and technically inexpedient because of a high level of the product loss and low output. If, on the contrary, the cooling rate is decreased below 200 degree/min, then due to interaction with carbon dioxide and water vapors the product of the claimed invention has time to react with them, thus turning completely to CO.

This Patent Publication also describes that it is therefore necessary to provide a cooling rate which would be technically realizable and make possible to obtain the required relation between the carbon phases and a definite composition of the surface groups. All this permitted of using the material formed as a component of highly effective composite materials. The rate of gas cooling was adjusted by using different conditions of release of gases and varying the volumes of explosives and blasting chamber.

EXAMPLE

As an initial step, in order to create the required atmosphere of gaseous explosion products for preserving the diamond-carbon material a charge of a 0.65-kg explosive is blasted, comprising trinitrotoluene and RDX in the ratio 60/40, in a blasting chamber of 3 $m^3$ volume. Then, similar charge of the explosive is blasted in the chamber. After the detonation products have expanded and a thermal equilibrium established, the gas mixture is allowed to outflow from the chamber through a supersonic flow laval nozzle with a 15-mm section for 40 s. Owing to the heat transfer to the chamber wall and the work performed by the gas, the rate of the mixture cooling becomes 304 degree/min. The condensed products formed are entrapped in cyclones and analyzed without any auxiliary cleaning.

In analyzing the powder, the following data are obtained.

black-color powder has the following elemental composition: 83.9% carbon, 1.1% hydrogen, 8.1% oxygen, 3.3% nitrogen. The content of incombustible impurities constitutes 3.5%.

From the data of X-ray studies, the product consists of three phases: 50% carbon of a cubic modification (diamond), 20% roentgen-amorphous carbon, and 30% crystalline carbon.

The composition of the surface oxygen-containing functional groups is determined polarographically. Carboxyl, quinone, lactone, ether and aldehyde groups are identified by the value of the reduction potentials. Methyl groups are identified by the composition of the gases evolved in heating (by methane evolution).

Other examples of carrying out the process with the claimed range of the method are presented below. The Table also includes comparative example with the method conditions different from those of the claimed invention for a graphic correlation with the properties of the products produced.

Cooling Rate

| degree/min | analysis results |
|---|---|

7,000 (comparative example with a output 8.0%, cooling rate exceeding the maximum)

Elemental Composition:

| | |
|---|---|
| [C] | 86.5 |
| [H] | 0.3 |
| [N] | 4.0 |
| [O] | 2.2 |

incombustible impurities—7.0

Phase Composition:

carbon of cubical modification—70 crystalline carbon—10

Composition of Surface Groups:

methyl, carboxyl 6,000 (comparative example with a output—7.8 maximum cooling rate)

Elemental Composition:

| | |
|---|---|
| [C] | 85.1 |
| [H] | 1.1 |
| [N] | 6.0 |
| [O] | 3.8 |

incombustible impurities—4.0

Phase Composition:

carbon of cubic modification—55 roentgen-amorphous carbon—15 crystalline carbon—30

Composition of Surface Groups:
methyl, carboxyl, quinone, lactone, ether, aldehyde

| 3,000 | output - 7.2 |
|---|---|

Elemental Composition:

| | |
|---|---|
| [C] | 84.2 |
| [H] | 0.9 |
| [N] | 8.3 |
| [O] | 3.1 |

incombustible impurities—3.5
Phase Composition:
carbon of cubic modification—45
roentgen-amorphous carbon—15
crystalline carbon—40
Composition of Surface Groups:
methyl, carboxyl, quinone, lactone, ether, aldehyde

| 304 | output - 4.2 |
|---|---|

Elemental Composition:

| | |
|---|---|
| [C] | 83.9 |
| [H] | 1.1 |
| [N] | 8.1 |
| [O] | 3.3 |

incombustible impurities—3.5
Phase Composition:
carbon of cubic modification—35
roentgen-amorphous carbon—15
crystalline carbon—50
Composition of Surface Groups:
methyl, carboxyl, quinone, lactone, ether, aldehyde
200 (comparative example with a output—3.3 minimum cooling rate)
Elemental Composition:

| | |
|---|---|
| [C] | 88.9 |
| [H] | 1.0 |
| [N] | 3.5 |
| [O] | 3.6 |

incombustible impurities—3.0
Phase Composition:
carbon of cubic modification—30
roentgen-amorphous carbon—15
crystalline carbon—55
composition of Surface Groups:
methyl, carboxyl, quinone, ether, lactone, aldehyde
100 (comparative example with a output—0.8, cooling rate less than the minimum) elemental composition:

| | |
|---|---|
| [C] | 75.0 |
| [H] | 1.3 |
| [N] | 10.4 |
| [O] | 2.6 |

incombustible impurities—10.7
Phase Composition:
carbon of cubic modification—5
roentgen-amorphous carbon—45
crystalline carbon—50
composition of Surface Groups:
carboxyl and aldehyde
60 (comparative example with a condensed phase is not observed, cooling rate less than the minimum).

U.S. Pat. No. 5,861,349 discloses a synthetic diamond-bearing material consisting essentially of aggregates of particles of a round or irregular shape, with art average diameter of the particles not exceeding 0.1.mu., wherein the material comprises:

a) elemental composition consisting of carbon of 75 to 90% by mass, hydrogen of 0.8 to 1.5% by mass, nitrogen of 0.6 to 4.5% by mass, and oxygen of the balance, b) phase composition consisting of amorphous carbon of 10 to 30% by mass, and diamond of cubic crystal structure the balance, c) a porous structure said material having pores with a volume of the pores being within about 0.6 to 1.0 $cm^3/g$, d) a material surface with 10 to 20% of the material surface being methyl, nitrile, first and second hydroxyl groups having different chemical shifts in an NMR spectrum and one or more oxycarboxylic functional groups selected from the group consisting of carbonyl groups, carboxyl groups, guinone groups, hydroperoxide groups and lactone groups 1 to 2% of the material surface being occupied by carbon atoms with uncompensated bonds, and e) a specific surface area in a range of from 200 to 450 $gm^2/g$.

This United States patent also discloses that when some explosives detonate under the conditions making it possible to preserve the condensed carbon products of the explosion ultradispersive diamond-bearing powders are formed, which possess such specific properties as high dispersivity, presence of defects of carbon structure, developed active surface. These characteristics are varied within wide limits depending on the conditions of preparing the diamond-bearing materials. The properties of the diamond obtained from the carbon of explosives are described by K. V. Volkov with co-authors (The Physics of Combustion and Explosion, v. 26, No. 3, p, 123, 1990). Synthesis is effected when charges are set off in a blasting chamber in the atmosphere of carbon dioxide and in a water jacket. The particle size of the obtained diamond is 0.3 to 0.06 nm, the CSR size is 4 to 6 μm, the particle shape is round. The pycnometric density is 3.2 $g/cm^3$. The product contains about 90% diamond, the balance, adsorbed gases. The product start oxidizing at 623 K. After five hour holding at. 1.173K, the degree of graphitization of the diamond is 10%. Other versions of the method (A. M. Stayer et al. The Physics of Combusion and Explosion, V. 20, No. 5, p. 100, 1984 and G. I. Savvakin et al, Proceedings of the USSR Academy of Sciences, V. 282, No. 5, 1985) are based of other or the same explosives in various kinds of atmospheres. The products resulting in this case feature properties similar to those described by K. V. Vollcov with co-authors.

This United States patent also discloses that for isolating the end diamond-bearing product, use is made of a complex of chemical operations directed at either dissolving or gasifying the impurities present in the material. The impurities, as a rule, are of the two kinds: non-carbon (metal, oxides, salts, etc.) and nondiamond forms of carbon (graphite, black, amorphous carbon). The diamond-bearing material most close by the technical properties to the material of the present invention is that disclosed in British Patent No. 1154633.

This United States patent also discloses that the presence of the amorphous phase defines an increased reactivity of the claimed material as compared with other man-made diamonds. This shows up in the following reactions. Thus, the temperature of the beginning of oxidation in the air of the diamond-bearing material of the invention, measured at the heating rate 10 degree/min, is 703 to 723 degree K, whereas for man-made diamonds it is 843 to 923 degree K W. In addition, when heating specimens of the claimed material at a temperature of 443 to 753 degree K in carbon dioxide at atmospheric pressure, its adsorption takes place, causing an increase in the specimen mass by around 5%, which was-not observed before for any of the forms of man-made diamonds.

However, these conventional synthetic diamond of fine particles having sizes in nanometers, are small in specific surfaces area ($m^2/g$) thereof in practice, so that the actual width levels of specific surfaces area are lower than that expected by respective authors of reports. Also density and number of active sites per unit surface area on each particle of such conventional synthetic diamonds are limited. Further, the diamond particles are largely spread in the size, including relatively too great diameter of particles, their dispersion in a liquid medium will hardly be uniform. And activity thereof stays in low level therefore being unfavorable in the adsorptivity, the contact stability, and the mixing stability thus existing the room for improvements.

It is hence an object of the present invention to provide a stable aqueous suspension of ultra-dispersed diamond (UDD) being sufficiently purified which are quasi-aggregation of several to hundreds units non-separable diamond particles, and has one-order broader (that is about ten times large) active surface area than that of conventional UDD, and each particle contains active sites in significantly higher density per unit surface area than that of conventional UDD particle, therefore has an excellent activity and an excellent dispersing stability in liquid and in metallic layer. It is another object of the present invention to provide an powder of UDD powder which is obtained from said aqueous suspension of UDD, and a metallic layer containing the UDD, and preparation method of the aqueous suspension of UDD.

SUMMARY OF THE INVENTION

These and other objects are attained by present inventions and featuring mode thereof which comprises;

(1). A diamond powder consisting of fine diamond particles, wherein;

(i) said diamond powder has an element composition consist mainly of carbon in the range of 72 to 89.5% by weight, hydrogen in the range of 0.8 to 1.5%, nitrogen in the range of 1.5 to 2.5%, and oxygen in the range of 10.5 to 25.0%, (ii) and, particles of said powder have a narrow distribution of diameters thereof so as to range in the scope of 150 to 650 nm by number average particle diameter (ØMn), and particles of over 1000 nm and below 30 nm in the diameter are absent, (iii) and, particles of said powder exhibit a strongest peak of the intensity of the Bragg angle at 43.9° (2θ±2°), strong and characteristic peaks at 73.5° (2θ±2°) and) 95° (2θ±2°), a warped halo at 17° (2θ±2°), and no peak at 26.5°, by X-ray diffraction (XRD) spectrum analysis using Cu—Kα radiation, (iv) and, the specific surface area of said powder is not smaller than $1.50\times10^5$ $m^2/kg$, and substantially all of the surface carbon atoms of said particles are bonded with hetero atoms, and total absorption space of said powder is $0.5\times10^3$ $m^3/kg$ or more;

(2). A diamond powder according to above described paragraph (1), wherein diamond particles of said diamond powder have a narrow distribution of diameters so as to range in the scope of 300 to 500 nm by number average particle diameter (ØMn), and particles of over 1000 nm and of below 30 nm in the diameter are absent;

(3). diamond powder according to above described paragraph (1), wherein the specific density of said diamond powder is $3.20\times10^3$ $kg/m^3$ to $3.40\times10^3$ $kg/m^3$, and absorption curve lines by infrared ray (IR) absorption analysis of said diamond powder show a strongest and broad absorption intensity about 3500 cm wavelength, and a strong and broad absorption intensity extended between 1730 and 1790 $cm^{-1}$ wavelengths which is warped in both absorption ends, and a strong and broad absorption intensity about 1170 $cm^{-1}$, and a medium strong and broad absorption intensity about 610 $cm^{-}$;

(4). A diamond powder according to above described paragraph (1), wherein the specific density of said diamond powder is in the range of $3.20\times10^3$ $kg/m^3$ to $3.40\times10^3$ $kg/m^3$, and absorption curve lines by infrared ray (IR) absorption analysis of said diamond powder show a strongest and broadly ranged absorption intensity about 3500 $cm^{-1}$ wavelength, and a strong and broad absorption intensity extended between 1730 and 1790 $cm^{-1}$ wavelengths which is warped in both absorption ends, and a strong and broad absorption intensity about 1170 $cm^{-1}$, and a medium strong and broad absorption intensity about 610 $cm^{-1}$, and two medium strong absorption intensities about 1740 $cm^{-1}$ and 1640 $cm^{-1}$, and a broad range absorption intensity about 1260 $cm^{-}$;

(5). A diamond powder according to above described paragraph (1), wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of $^{89}/_{11}$ to 81/19;

(6). A diamond powder according to above described paragraph (1), wherein the specific surface area measured by BET (Brunauer-Emmet-Teller isotherm absorption) method after heating to 1273 degree K is in the range of $1.95\times10^5$ $m^2/kg$ to $4.04\times10^5$ $^{m2}/kg$.

Still aforementioned and other objects are attained by present inventions and featuring mode thereof which comprise;

(7). An aqueous suspension liquid of finely divided diamond particles comprising 0.05 to 160 parts by weight of a finely divided diamond particles in 1000 parts of water, wherein;

(i) the finely divided diamond particles have an element composition consisting mainly of 72 to 89.5% by weight of carbon, 0.8 to 1.5% of hydrogen, 1.5 to 2.5% of nitrogen, and 10.5 to 25.0% of oxygen;

(ii) and, almost all of said diamond particles are in the range of 2 nm to 50 nm in diameters thereof (80% or more by number average, 70% or more by weight average), (iii) and, said finely divided diamond particles exhibit a strongest peak of the intensity of the Bragg angle at 43.9° (2θ±2°), strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation when dried, (iv) and, specific surface area of said diamond particles when dry state powder is not smaller than $1.50\times10^5$ $m^2/kg$, and substantially all the surface carbon atoms of said particles are bonded with hetero atoms, and the total absorption space of said powder is $0.5\times10^3$ $m^3/kg$ or more, when dried.

(8). An aqueous suspension liquid of finely divided diamond particles according to claim 7, wherein the pH value is 4.0 to 10.0;

(9). An aqueous suspension liquid of finely divided diamond particles according to claim 7, wherein the pH value is 5.0 to 8.0;

(10). An aqueous suspension liquid of finely divided diamond particles according to above described paragraph (7), wherein the pH value is 6.0 to 7.5;

(11). An aqueous suspension liquid of finely divided diamond particles according to above described paragraph (7), wherein the concentration of said diamond particles in said suspension liquid is 4.0 to 36%;

(12). An aqueous suspension liquid of finely divided diamond particles according to above described paragraph (7), wherein the concentration of said diamond particles in said suspension liquid is 0.5 to 16%;

(13). An aqueous suspension liquid of finely divided diamond particles according to above described paragraph (7), wherein diamond particles of 40 nm or more in diameter are substantially absent, and diamond particles of 2 nm or less in diameter are absent, and content of diamond particles of small diameter not more than 16 nm in diameter is 50 weight % or more, for all diamond particles dispersed content;

(14). An aqueous suspension liquid of finely divided diamond particles according to above described paragraph (7), wherein the specific density of said diamond particles is in the scope of $3.20\times10^3$ kg/m$^3$ to $3.40\times10^3$ kg/m$^3$, and absorption curve lines by infrared ray (IR) absorption analysis of said diamond powder show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$;

(15). An aqueous suspension liquid of finely divided diamond particles according to above described paragraph (7), wherein the specific density of said diamond particles is in the scope of $3.20\times10^{-3}$ kg/m$^3$ to $3.40\times10^{-3}$ kg/m$^3$, and absorption curve lines by infrared ray (IR) absorption analysis of said diamond powder show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$, and two medium strong absorption intensities about 1740 cm$^{-1}$ and 1640 cm$^{-1}$, and a broad range absorption intensity about 1260 cm$^{-1}$;

(16). An aqueous suspension liquid of finely divided diamond particles according to above described paragraph (7), wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of 89/11 to 19/81;

(17). An aqueous suspension liquid of finely divided diamond particles according to above described paragraph (7), wherein the specific surface area of said diamond particles measured by BET technique after heating to 1273 degree K is in the ranges of $1.95\times10^5$ m$^2$/kg to $4.04\times10^5$ m$^2$/kg.

Still further aforementioned and other objects are attained by present inventions and featuring mode thereof which comprise;

(18). A metal plating solution comprising diamond powder dispersed and suspended therein at a concentration of 0.01 to 160 g per liter, wherein;

(i) said diamond powder have an element composition consisting mainly of carbon in the range of 72 to 89.5% by weight, hydrogen in the range of 0.8 to 1.5%, nitrogen in the range of 1.5 to 2.5% of, and oxygen in the range of 10.5 to 25.0%, (ii) and, almost all of particles of said diamond powder are in the range of 2 nm to 50 nm in diameters thereof (80% or more by number average, 70% or more by weight average), (iii) and, particles of said powder exhibit a strongest peak of the intensity of the Bragg angle at 43.9° (2θ±2°), strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation, (iv) and, the specific surface area of said powder is not smaller than $1.50\times10^5$ m$^2$/kg, and substantially all of the surface carbon atoms of said particles are bonded with hetero atoms, and total absorption space of said powder is $0.5\times10^3$ m$^3$/kg or more, when dried;

(19). A metal plating solution according to above described paragraph (18), wherein diamond particles of 40 nm or more in diameter are substantially absent, diamond particles of 2 nm or less in diameter are absent, and content of diamond particles of small diameter not more than 16 nm in diameter is 50 weight % or more, for all diamond powder particles dispersed;

(20). A metal plating solution according to above described paragraph (18), wherein the specific density of said diamond powder is in the range of $3.20\times10^3$ kg/m$^3$ to $3.40\times10^3$ kg/m$^3$, and absorption curve lines by infrared ray (IR) absorption analysis of said diamond powder show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$;

(21). A metal plating solution according to above described paragraph (18), wherein the specific density of said diamond powder is in the range of $3.20\times10^3$ kg/m$^3$ to $3.40\times10^3$ kg/m$^3$, and absorption curve lines by infrared ray (IR) absorption analysis of said diamond powder show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$, and two medium strong absorption intensities about 1740 cm$^{-1}$ and 1640 cm$^{-1}$, and a broad range absorption intensity about 1260 cm$^{-1}$, and two medium strong absorption intensities about 1740 cm$^{-1}$ and 1640 cm$^{-1}$, and a broadly range absorption intensity about 1260 cm$^{-1}$;

(22). metal plating solution according to above described paragraph (18), wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of 89/11 to 81/19;

(23). A metal plating solution according to above described paragraph (18), wherein the specific surface area of said diamond powder measured by BET technique after heating to 1273 degree K ranges from $1.95\times10^5$ m$^2$/kg to $4.04\times10^5$ m$^2$/kg.

Still aforementioned and other objects are attained by present inventions and featuring mode thereof which comprise;

(24). A metal plating solution comprising finely divided diamond particles dispersed and suspended at a rate of 0.01 to 160 g per liter, wherein, (i) said diamond particles in a dry state have an element composition consisting mainly of 72 to 89.5% by weight of carbon, 0.8 to 1.5% of hydrogen, 1.5 to 2.5% of nitrogen, and 10.5 to 25.0% of oxygen, (ii) and, almost all particles are in the range of 2 nm to 50 nm in diameters thereof (80% or more by number average, 70% or more by weight average), (iii) and, said diamond particles exhibit a strongest peak of the intensity of the Bragg angle at 43.9° (2θ±2°), strong and characteristic peaks at 73.5° (2θ±2°) and 95° (2θ±2°), a warped halo at (17° (2θ±2°), and no peak at 26.5°, by X-ray diffraction (XRD) spectrum analysis using Cu—Kα radiation, (iv) and, the specific surface area of said diamond particles when dry state is not smaller than $1.50\times10^5$ $m^2$/kg, all of the surface carbon atoms of the diamond particles are bonded with hetero atoms, and the total absorption space of the diamond particles is 0.5 $m^3$/kg or more, when dried.

(25). A metal plating solution according to above described paragraph (24), wherein diamond particles of 40 nm or more in diameter are substantially absent, diamond particles of 2 nm or less in diameter are absent, and content of diamond particles of small diameter not more than 16 nm in diameter is 50 weight % or more, for all diamond particles dispersed;

(26). A metal plating solution according to above described paragraph (24), wherein the specific density of said diamond particles are in the range of $3.20\times10^3$ kg/$m^3$ to $3.40\times10^3$ kg/$m^3$, and absorption curve lines by infrared ray (IR) absorption analysis of said diamond particles show a strongest and broadly ranged absorption intensity about 3500 $cm^{-1}$ wavelength, and a strong and broad absorption intensity extended between 1730 and 1790 $cm^{-1}$ wavelengths which is warped in both absorption ends, and a strong and broad absorption intensity about 1170 $cm^{-1}$, and a medium strong and broad absorption intensity about 610 $cm^{-1}$;

(27). A metal plating solution according to above described paragraph (24), wherein the specific density of the diamond particles are in the range of $3.20\times10^3$ kg/$m^3$ to $3.40\times10^3$ kg/$m^3$, and absorption curve lines by infrared ray (IR) absorption analysis of said diamond particles show a strongest and broadly ranged absorption intensity about 3500 $cm^{-1}$ wavelength, and a strong and broad absorption intensity extended between 1730 and 1790 $cm^{-1}$ wavelengths which is warped in both absorption ends, and a strong and broad absorption intensity about 1170 $cm^{-1}$, and a medium strong and broad absorption intensity about 610 $cm^{-1}$, and two medium strong absorption intensities about 1740 $cm^{-1}$ and 1640 $cm^{-1}$, and a broad range absorption intensity about 1260 $cm^{-1}$;

(28). A metal plating solution according to above described paragraph (24), wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of 89/11 to 81/19;

(29). A metal plating solution according to above described paragraph (24), wherein the specific surface area of said diamond particles measured by BET technique after heating to 1273 degree K is in the range of $1.95\times10^5$ $m^2$/kg to $4.04\times10^5$ $m^2$/kg;

(30). A metal plating solution according to above described paragraph (24), wherein the solution does not comprise substantially cationic surfactant;

(31). A metal plating solution according to above described paragraph (24), wherein said diamond particles are suspended at a concentration rate of 0.1 to 120 g per liter in the metal plating solution;

(32). metal plating solution according to above described paragraph (24), wherein said diamond particles are suspended at a concentration rate of 1 to 32 g per liter in the metal plating solution;

(33). A metal plating solution according to above described paragraph (24), wherein said metal for plating is selected from metals in the groups Ia, IIIa, Vb, VIa, VIb, and VIII of the periodic table of elements, and their alloys;

(34). A metal plating solution according to above described paragraph (24), wherein said metal for plating is Cu or Au which belongs to the group Ia of the periodic table of elements;

(35). A metal plating solution according to above described paragraph (24), wherein said metal is indium which belongs to the group IIIa of the periodic table;

(36). A metal plating solution according to above described paragraph (24), wherein said metal is vanadium which belongs to the group Vb of the periodic table;

(37). A metal plating solution according to above described paragraph (24), wherein said metal is tin which belongs to the group VIa of the periodic table;

(38). A metal plating solution according to above described paragraph (24), wherein said metal is Cr, Mo, or W which belongs to the group VIb of the periodic table;

(39). A Metal plating solution according to above described paragraph (24), wherein said metal is Ni, Pt, Rh, Pd, or Lu which belongs to the group VIII of the periodic table.

Still aforementioned and other objects are attained by present inventions and featuring mode thereof which comprise;

(40). A metallic film having 0.1 to 350 nm thickness and comprising a diamond powder 0.1 to 2.0% by weight therein, wherein, (i) said diamond powder have an element composition consisting mainly of 72 to 89.5% by weight of carbon, 0.8 to 1.5% of hydrogen, 1.5 to 2.5% of nitrogen, and 10.5 to 25.0% of oxygen, (ii) and, almost of all particles of said diamond powder are in the range of 2 nm to 50 nm in diameters thereof (80% or more by number average, 70% or more by weight average), (iii) and, said diamond powder exhibits a strongest peak of the intensity of the Bragg angle at 43.9° (2θ±2°), strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation, (iv) and, the specific surface area of said diamond powder when dry state is not smaller than $1.50\times10^5$ $m^2$/kg, and all the surface carbon atoms of the diamond particles are bonded with hetero atoms, and the total absorption space of the diamond powder is 0.5 $m^3$/kg or more, when dried;

(41). A metallic film according to above described paragraph (40), wherein particle of diamond powders of 40 nm or more in diameter are substantially absent, particles of 2 nm or less in diameter are absent, and content of diamond powder particles of small diameter not more than 16 nm in diameter is 50 weight % or more, for all diamond powder particles dispersed;

(42). A metallic film according to above described paragraph (40), wherein the specific density of said diamond powder is in the range of $3.20\times10^3$ kg/m$^3$ to $3.40\times10^3$ kg/m$^3$, and absorption curve lines by infrared ray (IR) absorption analysis of said diamond particles show a strongest and broadly ranged absorption intensity about 3500 cm wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$;

(43). A metallic film according to above described paragraph (40), wherein the specific density of said diamond powder is in the range of $3.20\times10^3$ kg/m$^3$ to $3.40\times10^3$ kg/m$^3$, and absorption curve lines by infrared ray (IR) absorption analysis of said diamond particles show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$, and two medium strong absorption intensities about 1740 cm$^{-1}$ and 1640 cm$^{-1}$, and a broad range absorption intensity about 1260 cm$^{-1}$;

(44). A metallic film according to above described paragraph (40), wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of 89/11 to 81/19;

(45). A metallic film according to above described paragraph (40), wherein the specific surface area of diamond powder measured by BET technique after heating to 1273 degree K is in the range of $1.95\times10^5$ m$^2$/kg to $4.04\times10^5$ m$^2$/kg.

Still aforementioned and other objects are attained by present inventions and featuring mode thereof which comprise;

(46). A metallic film having 0.1 to 350 μm thickness and comprising finely divided diamond particles 0.1 to 2.0% therein, wherein;

(i) said finely divided diamond particles have an element composition consisting mainly of 72 to 89.5% by weight of carbon, 0.8 to 1.5% of hydrogen, 1.5 to 2.5% of nitrogen, and 10.5 to 25.0% of oxygen, (ii) and, almost all of said diamond particles are in the range of 2 nm to 50 nm in diameters thereof (80% or more by number average, 70% or more by weight average), (iii) and, said diamond particles exhibit a strongest peak of the intensity of the Bragg angle at 43.9° (2θ±2°, strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation when dried, (iv) and, the specific surface area of said diamond particles when dry state is not smaller than $1.50\times10^5$ m$^2$/kg, and all of the surface carbon atoms of said diamond particles are bonded with hetero atoms, and the total absorption space of said diamond particles is 0.5 m$^3$/kg or more when dried;

(47). A metallic film according to above described paragraph (46), wherein diamond particles of 40 nm or more in diameter are substantially absent, diamond particles of 2 nm or less in diameter are absent, and content of diamond particles of small diameter not more than 16 nm in diameter is 50 weight % or more, for all diamond particles dispersed;

(48). A metallic film according to above described paragraph (46), wherein the specific density of said diamond particles is in the range of $3.20\times10^3$ kg/m$^3$ to $3.40\times10^3$ kg/m$^3$, and absorption curve lines by infrared ray (IR) absorption analysis of said diamond particles show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$;

(49). A metallic film according to above described paragraph (46), wherein the specific density of the diamond particles is $3.20\times10^3$ kg/m$^3$ to $3.40\times10^3$ kg/m$^3$, and absorption curve lines by infrared ray (IR) absorption analysis of said diamond particles show a strongest and broadly ranged absorption intensity about 3500 cm$^{-1}$ wavelength, and a strong and broad absorption intensity extended between 1730 and 1790 cm$^{-1}$ wavelengths which is warped in both absorption ends, and a strong and broad absorption intensity about 1170 cm$^{-1}$, and a medium strong and broad absorption intensity about 610 cm$^{-1}$, and two medium strong absorption intensities about 1740 cm$^{-1}$ and 1640 μm$^{-1}$, and a broad range absorption intensity about 1260 cm$^{-1}$;

(50). A metallic film according to above described paragraph (46), wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of 89/11 to 81/19;

(51). A metallic film according to above described paragraph (46), wherein the specific surface area of said diamond particles measured by BET technique after heating to 1273 degree K is in the range of $1.95\times10^5$ m$^2$/kg to $4.04\times10^5$ m$^2$/kg.

Moreover aforementioned and other objects are attained by present inventions and featuring mode thereof which comprises;

(52). A method of producing an aqueous suspension liquid of finely divided diamond particles comprising steps of synthesizing a diamond/non-diamond mixture (blended diamond, BD) by a detonating technique using explosives, oxidizing the obtained crude diamond/non-diamond mixture to produce a suspension liquid, and separating a diamond-containing phase from the suspension liquid, wherein said oxidizing step is followed by a neutralizing step for mixing the oxidized product with an additive of basic reagent which is volatile itself or decomposition product thereof is volatile, to conduct a decomposing reaction with nitric acid being remained in the resultant of said oxidizing step;

(53). A method of producing an aqueous suspension liquid of finely divided diamond particles according to above described paragraph (52), wherein said oxidizing step consists of a plural time of oxidizing steps in which every oxidizing step is conducted at 150 to 250° C. under a pressure of 14 to 25 bars for at least 10 to 30 minutes;

(54). A method of producing an aqueous suspension liquid of finely divided diamond particles according to above described paragraph (52), wherein said oxidizing step consists of an oxidative decomposition step using nitric acid and an oxidative etching step using nitric acid, and, said neutralizing step is conducted after said oxidative etching step;

(55). A method of producing an aqueous suspension liquid of finely divided diamond particles according to above described paragraph (52), wherein said oxidative etching step of said oxidizing step is carried out at a higher pressure and a higher temperature than that in said oxidative decomposition step of said oxidizing step;

(56). A method of producing an aqueous suspension liquid of finely divided diamond particles according to above described paragraph (52), wherein said oxidative etching step consisting of a primary oxidative etching step and a secondary oxidative etching step, and said secondary oxidative etching step is carried out at a higher pressure and a higher temperature than that in said primary oxidative etching step;

(57). A method of producing an aqueous suspension liquid of finely divided diamond particles according to above described paragraph (52), wherein said separating step for separating a diamond-containing phase from said suspension liquid phase is a step of adding water into said suspension liquid and of decanting said suspension liquid, to separate said diamond-containing phase as a lower layer from non-diamond containing phase as upper layer;

(58). A method of producing an aqueous suspension liquid of finely divided diamond particles according to claim 52, wherein said separating step for separating said diamond-containing phase from said suspension liquid phase further includes a step of adding nitric acid into said suspension liquid separated as said lower layer and a step of decanting said suspension liquid, to separate said diamond-containing lower layer from said non-diamond-containing upper layer, and said separation of the diamond-containing phase from said non-diamond contained phase is a separation of said diamond-containing phase located as lower layer from said non-diamond containing phase located as upper layer and which layers are occurred by settlement after addition of nitric acid for washing of said suspension liquid;

(59). A method of producing an aqueous suspension liquid of finely divided diamond particles according to above described paragraph (52), wherein said separating step for separating said diamond-containing phase from said suspension liquid phase further comprises a step of adding nitric acid into said suspension liquid separated as lower layer and a step of decanting said suspension liquid, to separate said diamond-containing lower layer from said non-diamond containing upper layer and which layers are occurred by settlement of the suspension liquid;

(60). A method of producing an aqueous suspension liquid of finely divided diamond particles according to above described paragraph (52), wherein said method further comprises a step for subjecting said lower suspension liquid comprising synthesized diamond particles to pH and concentration adjustments so as to adjust the pH value in the scope of 4.0 to 10.0 and a diamond particle concentration in the scope of 0.01 to 32%;

(61). A method of producing an aqueous suspension liquid of finely divided diamond particles according to above described paragraph (52), wherein said method further comprises a step for subjecting the lower suspension liquid comprising synthesized diamond particles to pH and concentration adjustments so as to adjust the pH value in the scope of 5.0 to 8.0 and a diamond particle concentration in the scope of 0.1 to 16%;

(62). A method of producing an aqueous suspension liquid of finely divided diamond particles according to above described paragraph (52), wherein said method further comprises a step for subjecting the lower suspension liquid comprising synthesized diamond particles to pH and concentration adjustments so as to adjust the pH value in the scope of 6.0 to 7.5 and a diamond particle concentration in the scope of 0.1 to 16%.

Moreover aforementioned and other objects are attained by present inventions and featuring mode thereof which comprises;

(63). A method of producing a diamond powder, comprising steps of centrifugally separating diamond particles to separate the diamond particles from an aqueous suspension liquid of finely divided diamond particles which comprises 0.05 to 160 parts by weight of finely divided diamond particles in 1000 parts of water, then drying the diamond particles at a temperature of not higher than 400° C., wherein, (i) said diamond particles has an element composition consisting mainly of 72 to 89.5% by weight of carbon, 0.8 to 1.5% of hydrogen, 1.5 to 2.5% of nitrogen, and 10.5 to 25.0% of oxygen, (ii) and, particles of said powder have a narrow distribution of diameters thereof so as to range in the scope of 150 to 650 nm by number average particle diameter (ØMn), and particles of over 1000 nm and below 30 nm in the diameter are absent, (iii) and, said diamond powder exhibits a strongest peak of the intensity of the Bragg angle at 43.9° (2θ±2°), strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation, (iv) and, the specific surface area of said powder is not smaller than $1.50\times10^5$ $m^2/kg$, and substantially all of the surface carbon atoms of said particles are bonded with hetero atoms, and total absorption space of said powder is 0.5 $m^3/kg$ or more.

DETAILED DESCRIPTION OF THE PREFERRED EMBODIMENTS

Figure 1:
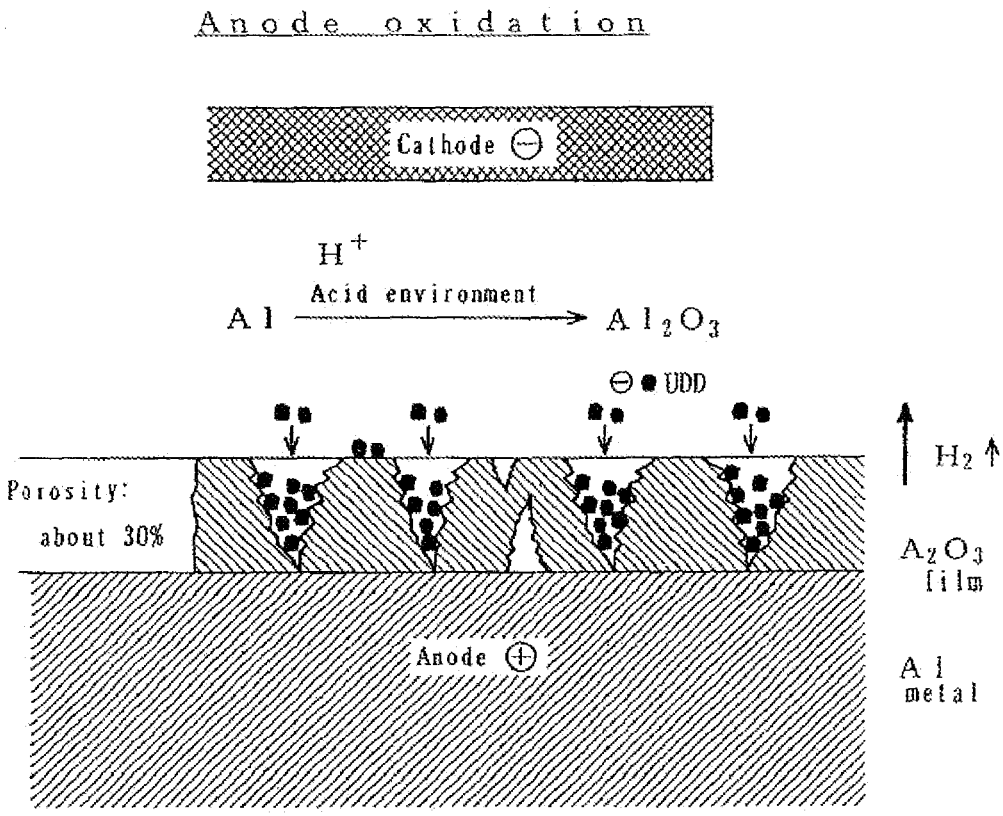
FIG. 1 is a cross sectional view of an anodized aluminum layer modified with the UDD of the present invention.

The present invention will be described in more details.

[UDD, UDD Suspension, and Preparation Methods thereof]

Crude diamonds (referred to as blend diamonds or BD hereinafter) used in the present invention can be synthesized by any of the known shock conversion methods depicted in: aforementioned Science, Vol. 133, No. 3467 (1961), pp. 1821-1822; Japanese Unexamined Patent Publications of Tokkai Hei 1-234311 and Tokkai Hei 2-141414, Bull. Soc. Chim. Fr. Vol. 134 (1997), pp. 875-890; Diamond and Related Materials, Vol. 9 (2000), pp. 861-865; Chemical Physics Letters, 222 (1994), pp. 343-346; Carbon, Vol. 33, No. 12 (1995), pp. 1663-1671; Physics of the Solid State, Vol. 42, No. 8 (2000), pp. 1575-1578; Carbon, Vol. 33. No. 12 (1995), pp. 1663-1671; K. Xu. Z. Jin, F. Wei and T. Jiang, Energetic Materials, 1,19 (1993) (in Chinese); Japanese Unexamined Patent Publications of Tokkai Shou 63-303806 and Tokkai Shou 56-26711; British Patent No. 1154633, Japanese Unexamined Patent Publication of Tokai Hei 3-271109, Japanese Laid-Open Patent Publication of Tokuhyou Hei 6-505694 by Japanese language of PCT WO 93/13016 corresponding to U.S. Pat. No. 5,861,349, Carbon, Vol. 22, No. 2, pp. 189-191 (1984); Van Thiei. M. & Rec., F. H., J: Appl. Phys., 62, pp. 1761-1767 (1987); Japanese Laid-Open Patent Publication of Tokuhyou Hei 7-505831 by Japanese language of PCT WO 94/18123 corresponding to U.S. Pat. No. 5,916,955, However, it must be noticed that the properties of UDD stated in the given reports differ from each other, and UDD have a vary complex nature and their properties greatly depend on a production method, therefore all investigations were carried out under different conditions. Preferable methods assumed in the present invention will be explained later in detail.

The blended diamond (BD) synthesized by such a shock conversion method is in the form of mixture of UDD particles and non-graphite particles, both having a diameter of some tens to hundreds nm. The UDD particle is an aggregate of very small, nano-sized diamond clusters (nano-diamonds have usually 1.7 to 7 nm diameter) which is impossible or very hard to be physically broken up, and has a diameter ranging from tens to several hundreds nm. In other words, It is an quasi-aggregate of at least four to tens, occasionally to hundreds, or rarely to few thousands of nano-diamonds. The BD is a mixture of UDD and other components including very few amount of very fine amorphous diamond particles, graphite particles, and non-graphite carbon particles, which, almost all of, are smaller than 1.5 nano-meters in size.

The method of preparing UDD in present invention is based on oxidizing step, in which condensed carbon phase produced by shock conversion is oxidized in steps with the uses of liquid acids to stepwise decompose non-diamond parts of ingredients. The liquid acids for oxidization may be nitric acid. If desired, the carbon phase may be treated with hydrochloric acid to dissolve metal oxide impurities prior to the oxidization. First of all, the condensed carbon phase including blended diamonds is oxidized to separate diamond components from the carbon components.

Then, non-diamond carbon components, which coat over the surface of blended diamonds, are removed by oxidative decomposition or oxidative etching. Furthermore, non-diamond carbons constituting a part of the diamond surface are removed by oxidative etching. Thereafter neutralizing treatment together with small scale of explosions is conducted, to more sufficiently remove the remaining non-diamond carbonaceous part. At least a part of such non-diamond carbon components which coat over the diamond surfaces, non-diamond carbons which constitute a part of the diamond surface, and non-diamond carbonaceous part may result from re-conversion of synthesized diamonds to their original graphite form by the action of a rapidly declined pressure and a moderately declined temperature in just after of the detonation of an explosive. However, the present invention is not limited to this theory. The removal of such non-diamond carbon components which coat over the diamond surfaces and non-diamond carbons which constitute a part of the diamond surface, by oxidative decomposition and oxidative etching may be carried out simultaneously or preferably sequentially.

Nano-diamonds constituting the purified UDD product are substantially $42\pm2\times10^{10}$ m in the average diameter as measured by coherent scattering photoelectric field technique.

A characteristic of UDD core having diamond lattice structure was identified by the measurement in the present invention, and a characteristic of very small trace amount of aggregated carbons which are scattered in the bulk of the aggregates of carbon atoms, which do not form a lattice, and basically, are arranged in the interatmic distance smaller than $1.5\times10^{-10}$ m, too. On the other hand, another kind of measurement in the present invention revealed that this characteristic of very small trace amount of aggregated carbons were also identified in the inner surfaces of each particle, and that the interatomic distances are plotted in a Gaussian distribution, therefore it become clear that the aggregated carbons in the inner surfaces of each particle were carbon of amorphous type.

Generally speaking, conventional such kind of UDDs have a specific surface area of (2.5 to 3.5)$\times10^3$ $m^2/g$ and a porous volume of (0.3 to 1.0)$\times10^{-3}$ $m^3/kg$, and, decrease of specific surface when heated to 1273 degree K is little.

Also, as for conventional UDD, in case of suspension, the maximum particle size thereof is $1000\times10^{-6}$ m, and when dried it to a powder form, the particles turn to aggregate to change into a poly-dispersed powder. Also, when heated under an inert atmosphere, a spherollite form of the UDD particles may be increased from 873 degree K. The spherollite form of the UDD particles can however be fractured by imposing a mechanical pressure of (100 to 150)$\times10^6$ Pa, and at thereafter, there is very few possibility to aggregate again to shift to the poly-dispersed formation of powder, again.

In contrast to this, UDD particles of the present invention, due to unbalanced and intense conditions of synthesis in the present invention, have a high density of defects, an active developed surface, as large as $1.50\times10^5$ $m^2/kg$, and excess formation enthalpy. Also, the total absorption space is not smaller than 0.5 $m^3/kg$ at $p/p_s$=0.995 (where p is the surface area in pores filled with $N_2$ gas and $p_s$ is the partial pressure of nitrogen gas for forming single layer of the gas) as very different from that of any prior arts. Those properties endorse the utility of UUD of the present invention.

As a further feature, UDD of the present invention has enormous amounts of volatile substances and solid impurities deposited on the surface thereof which are not capable of removal as far as they are furnished to very severe conditions. The volatile substances are acid residues such as CO, $CO_2$, $N^2$, $H_2O$, $H_2SO_4$, and $HNO_3$ which are presented by chemical purification, and the solid impurities are insoluble compounds or salts such as non-diamonds, metal oxides, or carbide. Eventually, UDD of the present invention comprises 72 to 89.5% of carbon, 0.8 to 1.5% of hydrogen, 1.5 to 2.5% of nitrogen, and 10.5 to 25.0% of oxygen (it is clearly different from usual diamonds comprising 90 to 99% of carbon, 0.5 to 1.5% of hydrogen, 2 to 3% of nitrogen, and lower than 10% of oxygen). Out of all carbons contained, 90 to 97% of carbons are in diamond crystal and 10 to 3% of carbons are non-diamond carbons.

The impurities in BD for the UDD of the present invention may theoretically be classified into (i) water soluble (ionized) electrolytic impurities, (ii) chemically combined with diamond surface, hydrolysable and ionizable impurities (salts forms of functional surface groups), (iii) water insoluble impurities (mechanical impurities, non-dissociating salt and oxide forms of surface impurities), and (iv) impurities included into crystal lattice of diamond and capsulated ones. The impurities (i) and (ii) are formed on the stage of chemical purification of UDD by acids. The basic water soluble of impurities (i) can be removed by washing the UDD with water, an additional treatment of suspension by ion-exchange resins is favorable for more effective washing.

It is considered that the functional groups of impurities (ii) at the surface BD for UDD of the present invention are ones of such type of —COOH, —OH, —$SO_3H$, ion exchanger, and —$NO_3$, —$NO_2$. In this case treatment of aqueous UDD suspensions by ion-exchangers is more effective, because desalting of surface groups occurs, therefore it is useful for future application.

Aforementioned water soluble impurities (iii) represent both as separate microparties of metals, oxides, carbides, salts (sulphates, silicates, carbonates) and surface salt and metal oxide compounds, not able to dissociate. To remove them, i.e. to transfer into soluble form, a treatment by acids is used in the present invention.

In the present invention, aforementioned impurities (I), (ii) and (iii) can be removed by 40 to 95%, by different methods using acids, but it is impossible to reach a complate removal of these impurities, and perfect removal of such impurities is no essential requirement of the present invention. Besides, considerable difficulty of a complete transfer of the impurities (iii) into soluble condition, impurities (iv) are not practically removed by merely chemical methods.

Basic elements of impurities (iv) are silicon, calcium, ferrum, sulphur, titanium, copper, chrome, potassium are practically constantly present in small quantities. UDD having active developed surface are able to absorb impurities from a solution. Therefore some impurities, namely silicon, potassium and partly ferrum can be put down to a hardness of water used in the technology of purification of UDD. Ferrum is one of the basic technological impurities (namely comes from material apt to be use in instruments for shock conversion method) of UDD which being in concentration 1.0 to 0.5 wt. % and less it is removed with difficulty. The given level corresponding to a quantity of insoluble compounds of ferrum is mainly surface ones.

UDD particles of the present invention contains a considerable amount of volatile impurities (upto 10% by weight), they can be purified or decreased amount by heat treatment under a vacuum at 0.01 Pa. In this case, the temperature to be applied for the heating is not higher than 400° C., preferably up to 250° C.

In another view, the best scientific knowledge by the present invention is a clarified relationship between the purification steps of crude diamonds (blended diamonds) synthesized by shock conversion and the composition or properties of the UDD.

Prior to specifying the present invention, compositions of UDDs produced from BDs (they are obtained by detonation of explosives) in initial stage (non treatment with solution) and treated with non-oxidizing solutions based on organic solvents (hydrocarbons, alcohols) and compositions and properties thereof are shown in Table 2.

TABLE 2

| BD-sample Treatment conditions (wt. %) | UDD gross-formula | Relative quantity of heteroatoms on 100 atoms of carbon |
|---|---|---|
| initial, $\alpha = 0$ | $C_{100}H_{5.3}N_{2.8}O_{4.1}$ C: 86.48%, H: 0.81%, N: 2.22%, O: 10.49% | 12.2 |
| treatment with hydrocarbons CnH2n + 2 | $C_{100}H_{13.8}N_{2.9}O_{4.6}$ C: 90.36%, H: 1.04%, N: 3.06%, O: 5.56% | 21.3 |
| treatment with alcohols CnH2n + 1OH | $C_{100}H_{15.3}N_{2.6}O_{8.0}$ C: 86.96%, H: 1.12%, N: 2.24%, O: 9.28% | 26.1 |

Degree of oxidative decomposition $\alpha$ = [(C" ox in Cox)/Cox] × 100 (Where Cox is total mass for oxidizable carbon in DB or UDD, and C" ox in Cox is the same in an oxidated sample)

The non-oxidative treatment of BD with the organic solvent (hydrocarbon $CnH_2n+_2$, an alcohol $CnH_2n+_1OH$) does not affect the carbon skeleton of the UDD particles but changes surface functional groups causing a change of elements composition of BD. More particularly, as hydrocarbon and alcohol are bonded to the UDD and consumed, the hydrogen and oxygen contained components are relatively increased thus doubling the number of hetero elements (hydrogen, nitrogen, and oxygen).

[Synthesis of UDD]

Method of preparing an improved UDD suspension liquid according to the present invention comprises the steps of preparing a diamond/non-diamond mixture (initial BD or crude BD) by shock conversion, oxidizing the diamond/non-diamond mixture to produce a suspension liquid, and separating a diamond containing phase from the suspension liquid, wherein said oxidizing step is followed by mixing step for mixing the oxidized product with additive of basic agent, which is volatile itself or its decomposition product is volatile, to occur a decomposition reaction in neutralization with nitric acid.

Preferably, the oxidizing step is executed at 150 to 250° C. under a pressure of 14 to 25 bars for at least 10 to 30 minutes, and which step is repeated a number of times. Also, the oxidizing step comprises an oxidative decomposition step with nitric acid and an oxidative etching step with nitric acid, and said neutralizing step of the decomposing reaction is preferably conducted after said oxidative etching step.

The oxidative etching step is preferably carried out at a higher pressure and a higher temperature than those in the oxidative decomposition step. The oxidative etching step may comprise a primary oxidative etching step and a secondary oxidative etching step, and the secondary oxidative etching step is preferably carried out at a higher pressure and a higher temperature than those in the primary oxidative etching step. Preferably, the separating step for separating a diamond-contained phase from the suspension liquid produced by said neutralizing step using the additive of basic reagent, involves decanting with water to separate the diamond-contained phase from the non-diamond contained phase.

The step of decanting with water to separate the diamond-contained phase from the non-diamond contained phase is preferably followed by washing with nitric acid to divide the suspension liquid into a lower suspension liquid containing synthesized diamond particles and an upper draining liquid and then separating the lower suspension liquid containing synthesized diamond particles from the upper draining liquid. Also, the step of separating the lower suspension liquid containing synthesized diamond particles from the upper draining liquid may involve holding the suspension liquid for a while, after finishing the step of washing with nitric acid.

Moreover, the method may further comprise the step of subjecting the lower suspension liquid containing synthesized diamond particles, to a pH- and concentration-adjustments so as to make a pH of 4.0 to 10.0, preferably 5.0 to 8.0, or more preferably 6.0 to 7.5, and a diamond particle concentration of 0.05 to 16%, preferably 0.1 to 12%, or more preferably 1 to 10%.

Accordingly, a favorable method of preparing an improved UDD suspension liquid according to the present invention comprises the steps of: preparing a diamond/non-diamond mixture (an initial BD) by shock conversion; subjecting the diamond/non-diamond mixture to oxidative decomposition; then subjecting the diamond/non-diamond mixture to oxidative etching reaction to prepare a suspension of the product in a nitric acid; mixing said suspension with an additive of volatile basic reagent to conduct the product into a decomposing reaction for neutralization with the nitric acid; decanting obtained suspension with water; adding nitric acid into the suspension and holding the resultant in a settle state, to separate the suspension into two layers; separating the lower suspension liquid containing synthesized diamond particles from the upper draining liquid; washing with nitric acid then if desired subjecting the suspension to centrifugal separation; and subjecting the suspension to pH- and concentration-adjustments to prepare a final aqueous suspension liquid of diamond particles.

On the other hand, the diamond powder according to the present invention is prepared by the steps of centrifugal separating to separate diamond particles from the diamond particle dispersed suspension liquid prepared by the above described manner, then drying the obtained wet diamond particles at a temperature of not higher than 400° C. Thus obtained diamond powder of the present invention is in the scope of 2 nm to 50 nm in diameters thereof (80% or more by number average, 70% or more by weight average) in almost all of powder particles, and, particles of said powder have a narrow distribution of diameters thereof so as to range in the scope of 150 to 650 nm by number average particle diameter (ØMn), and particles of over 1000 mu and below 30 nm in the diameter are absent.

By such manners, UDD aqueous suspension of finely divided diamond particles comprising 0.05 to 160 parts by weight of a finely divided diamond particles in 1000 parts of water, and said suspension having an excellent dispersing stability can be obtained at a relative higher productivity (1 to 5%), wherein;

(i) the finely divided diamond particles have an element composition consisting mainly of 72 to 89.5% by weight of carbon, 0.8 to 1.5% of hydrogen, 1.5 to 2.5% of nitrogen, and 10.5 to 25.0% of oxygen;

(ii) and, suspension liquid 0.05 to 32 parts thereof in 99.5 to 68 parts of water, almost all of said diamond particles are in the range of 2 nm to 50 nm in diameters thereof (80% or more by number average, 70% or more by volume average), (iii) and, said finely divided diamond particles exhibit a strongest peak of the intensity of the Bragg angle at 43.9° (2θ±2°), strong and characteristic peaks at 73.5° (2θ±2° and 95° (2θ±2°), a warped halo at 17° (2θ±2°), and no peak at 26.5°, by X-ray diffraction (XRD) spectrum analysis using Cu—Kα radiation when dried, (iv) and, specific surface area of said diamond particles when dry state powder is not smaller than $1.50\times10^5$ $m^2/kg$, and substantially all the surface carbon atoms of said particles are bonded with hetero atoms, and the total absorption space of said powder is $0.5\times10^{-3}$ $m^3/kg$ or more, when dried.

The diamond powder of UDD obtained from said aqueous suspension liquid is also provided by the present invention. Particles in the diamond powder of the present invention is an quasi-aggregate of at least four to tens, occasionally to hundreds, or rarely to few thousands of nano-diamonds, and is a narrow dispersion type of sizes having 300 nm to 500 nm of numeral average diameter, definitively 150 nm to 650 nm of numeral average diameter and bigger particles having more than 1000 nm of diameter and smaller particles having less than 30 nm of diameter are rare. These quasi-aggregates of powder can be disassembled to original and basic UDD particles, by using for example, ultrasonic dispersing in acidic environmental aqueous liquid.

Particle diameters of nano-diamond and UDD in the present invention are on the basis of dynamic light scattering photometry method by electrophoretic light scattering photometer, model ELS-8000. Measurable scope of the dynamic light scattering photometry method is ranged within 1.4 nm to 5 μm, therefore particles sized in this range are kaleidoscopically shifted their locations, directions and arrangements, therefore using those phenomena, diameters can be measured from the relationships between sizes of particles subsiding and subsidence velocities of the particles, and if laser beam is irradiated to particles under Brown motions, the scattered light from particles occurs flickers pursuant to respective particle sizes, thus this flickers are observed by photon detective technique.

Average particle diameter and size distribution of nano-diamonds and UDD in metallic composite film consisting of nano-diamonds and UDD particles in metal film in present invention is based upon the result of analysis of SEM and TEM photographs.

[Plating Bath, Metallic Film]

The UDD according to the present invention has an improved properties such as hardness like as that of peculiar diamonds, excellent electromagnetic properties such as low electric inductance in spate of its low electric conductivity, low magnetic sensitivity, high lubrication nature, excellent heat resistance and small thermal conductivity, and has a high dispersibility peculiar fine particles having narrow distribution range in particle sizes, enhanced surface activity, ion exchangeability particularly cation exchangeability, and high affinity to metal and ceramic surfaces. Furthermore, the UDD particles according to the present invention are, in almost all cases, particle shapes peculiar to diamond particles excepting twin-crystal forms, namely, converged and closed form such as cubic forms, not flat forms such as rectangular form or planar sheets form. And also the UDD particles are, in many cases, porous and active particles which are caused by the oxidative decomposing treatment and the oxidative etching treatment according to the present invention.

The UDD particles are colorless transparent and are mixed or dispersed uniformly into other substances, therefore impossible or very difficult to identify visually the existence of each particle in the other substances by naked eye. Also, even if being dispersed into a solid structure, the UDD particles can be not perceived tactually.

This UDD can be, for the purpose of improvements of slidability, lubricity, anti-abrasive, heat resistance, anti-thermal expansion or dimensional stability with heat, adhesive of anti-peeling nature, durability for humidity and chemicals, anti-corrosive by gases, color tone of articles modified by films or coatings, specific gravity and density of various substances such as plates, layers, films or coatings, applicable automobile, motorcycle, die for molding, parts and components of machine and instruments for aircraft and space industry, parts and components of chemical plant, parts and components such as memory elements and, switching elements of electric and electronic machine and instruments, parts and components of various business machines or called office machines and optical and audio machines, recording media such as magnetic tape and disc medium such as CD, lubricant composition, fuel composition, greasy pastes composition for sealing or filling, resinous composition for molding, rubber composition, metallic composition, ceramics composition. Also, a powder form of the UUD may be applied to the moving parts of any mechanical instrument. And the UDD also can be used as absorbents, ion-exchanger to administrate to human and animals. As a more favorable mode, the UDD can be in a form of suspension liquid, particularly aqueous suspension liquid which shows very stable dispersing nature.

More specifically, the UDD of the present invention, when dried powder, comprises 98.22% of carbon, 0.93% of oxidizable carbon, 0.85% of non-combustible impurity residuals after the strong oxidizing treatment, and liquid suspension, which is a liquid form before dried up, of 1100 g consisting of the UDD at a concentration of 15.5% in an aqueous phase (thus containing 170 g of the UDD) can last in stable dispersion state as a commercial product for 24 months.

As an another mode of the UDD in dried form, it comprises 98.40% of carbon, 0.85% of oxidizable carbon, 0.75% of non-combustible impurity residuals after the strong oxidizing treatment, and liquid suspension, which is a liquid form before dried up, of 2010 g consisting of the UDD at a concentration of 12.5% in an aqueous phase (thus containing 251 g of the UDD) can last in stable dispersion state as a commercial product for 24 months.

As another mode of the UDD in dried form, it comprises 98.87% of carbon, 0.73% of oxidizable carbon, 0.40% of non-combustible impurity residuals after the strong oxidizing treatment, and liquid suspension, which is a liquid form before dried up, of 552 g consisting of the UDD at a concentration of 11.0% in an aqueous phase (thus containing 56 g of the UDD) can also last in stable dispersion state as a commercial product for 24 months.

As still another mode of the UDD in dried form, it comprises 98.80% of carbon, 0.80% of oxidizable carbon, 0.40% of non-combustible impurity residuals after the strong oxidizing treatment, and liquid suspension, which is a liquid form before dried up, of 1044 g consisting of the UDD at a concentration of 11.5% in an aqueous phase (thus containing 120 g of the UDD) can also last in stable dispersion state as a commercial product for 24 months.

The UDD of the present invention, when suspension liquid form of concentration of 16%, does not occur aggregation and precipitation in storing for six months at room temperature (15 to 25° C.). In general, the degradation of any aqueous composition is doubled as the temperature increases by 10° C. during the storage. For example, as almost all of metal plating process are carried out under an elevated temperature condition, the UDD dispersed suspension liquid of the present invention have resistance to high temperature as above mentioned, can be advantageous. Yet, it is desired to store the UDD suspension liquid, usually at a temperature ranging from 5° C. to 70° C.

Since the UDD of the present invention is improved in the dispersion stability and the activity which are possibly caused by the existence of carboxyl groups positioned surface of the UDD particles, behavior of the UDD is similar to that of n-type semiconductors. The UDD suspension liquid exhibits a weak acidic nature and a slight electric conductivity and durable for use under an elevated temperature as 60 to 70° C., it is however desirable to avoid to be used under more severe condition than such temperatures. The UDD dispersed suspension liquid of the present invention, in general, is adjusted to a pH value of 4.0 to 10.0 not higher than 10, preferably 5.0 to 8.0, or more preferably 6.0 to 7.5. If its pH exceeds 10, the suspension liquid is apt to be unstable.

As described in Japanese Unexamined Patent Publications of Tokkou Shou 63-33988, Tokkai Hei 4-333599 and Tokkai Hei 8-20830, Material Inspection Technology, Vol. 40, No. 4, pp. 95, Coloring Materials, Vol. 71, No. 9, pp. 541-547, to the plating electrolytes suspending particles such as diamond particles is usually required an addition of surfactant for ensuring the dispersion stability of the suspended particles.

However, the UDD dispersed suspension liquid of the present invention is not always required the addition of surfactant. By addition of surfactant, it may possibly to ensure the dispersion stability in some cases, however in other cases it possible to decline the dispersion stability of the UDD suspension liquid, particularly such tendencies are often marked in case of a concentrated pasty suspension.

Thus, the UDD suspension liquid of the present invention can favorably be applied to any type of metal plating. As usual plating liquids are in many cases in acidic state, the UDD suspension liquid is adjusted its pH value in constitution of a plating liquid, and after adjustment of pH value, surfactant may be added into the plating liquid. It is favorable to stirrer the plating liquid. As mentioned, in the present invention, condition favorable to store the UDD suspension liquid may differ from the condition favorable to constitute it to metal plating liquid.

Metallic material used for metal plating with the UDD dispersed suspension liquid of the present invention may be selected from metals in the groups Ia, IIIa, Vb, VIa, VIb, and VIII of the periodic table of Elements. More particularly, characteristic examples of the group Ia are Cu and Au. A characteristic example of the group IIIa is In. A characteristic example of the group Vb is V. A characteristic example of the group VIa is Sn. Characteristic examples of the group VIb are Cr, Mo, and W. Characteristic example of the group VIII are Ni, Pt, Rh, and Lu. Also, alloys thereof may be used with equal success. Such metal is commonly provided in the form of a water soluble metal salt or complex salt. The acid radical of the salt may be selected from ones of inorganic type including hydrochloric acid, sulfuric acid, boric acid, stannic acid, fluoroboric acid, chromic acid, and cyanic acid and ones of organic acid types including sulfamic acid, acetic acid, benzene-disulfonic acid, cresol-sulfonic acid, and naphthol-sulfonic acid.

The plating process may be electroplating, electroless plating, or electro-forming. The plating bath (plating solution) is prepared by adding the UDD of the present invention at a concentration of 0.01 to 120 g per liter of the plating solution, preferably 0.05 to 120 g, and more preferably 1.0 to 32 g, most preferably 1.0 to 16 g. It may be understood from the concentration of the UDD in its suspension liquid of the present invention that the concentration of the UDD in the plating solution can easily be controlled in a desired level. And as the plating solution according to the present invention occurs no aggregation of the UDD, despite of the UDD contained in a higher concentration than that of any prior art, it can inhibit the UDD particles to precipitate in the bath, by the action of gas bubbles which are generated in the location near electrode during operation. Further, it can certainly inhibit the UDD particles to precipitate, by stirring action that is usually adopted in conventional plating process during plating. The thickness of a plated metallic layer of the present invention is in the range of 0.1 to 350 μm, preferably 0.2 to 100 μm, depending on the plating conditions, the purposes of applications the metallic layer, and the kinds, natures, surface conditions and qualities of a substrate to be plated in plating process base on which the metal is plated. For example, the electroplating may be in 0.1 to 0.5 μm thickness in case of Au layer, 0.1 to 10 μm thickness in case of Rh layer, 3 to 30 μm thickness in case of Ni layer, and 5 to 100 μm thickness in case of Cr layer. In case of electro-forming which may produce relatively thicker metal layer, for example Ni layer electroforming may produce as a greater thickness as 350 μm.

As shown in FIG. 1, the Al plating however may cause $Al_2O_3$ layer which is porous thus allows the UDD particles to irreversibly enter the pores and hence property of the layer can be improved.

As described above, UDD aqueous suspension liquid of the present invention can consistently be used at a concentration of 16% at maximum. When the concentration of the UDD in the suspension liquid is high, a more number of UDD particles can be deposited in the resultant plated metallic layer. For example, In case of Ni plating, UDD can be contained in an amount of 1 g in plating liquid of one liter, and it causes Ni layer produced which may include 0.2% by weight of the UDD particles. Also, by the Ni plating liquid containing UDD at a rate of 10 g per liter, Ni plating layer produced includes 0.7% by weight of the UDD. Accordingly, the content of the UDD in the plating layer can be increased (10 g for 1 g of the plating layer) substantially in proportional to a common logarithm of the UDD content in the suspension (g/liter). Thus, Ni plating layer produced may increase Ni content to usually 1% to maximum 16% (under stirring) by weight of the UDD. Similarly, a resultant Ag plating layer may contain usually 0.1 to 0.2% by weight and 5% of maximum content, and, a Cr plating layer may contain 7.0% (under stirring) by weight.

However, when the UDD suspension is too high concentration, UDD particles may easily apt to be precipitated or aggregated thus declining the stability. In reverse, when the UDD suspension is too low concentration, the UDD content in the resultant plating layer may declined to unfavorably level. The concentration of the UDD in the suspension liquid is hence favorable in the level of 0.05 to 1.6%, preferably 0.1 to 12%, or more preferably 1 to 10%. When concentration is lower than 0.05%, the UDD will hardly be deposited at a desired rate in the plating layer. When the concentration exceeds 16%, the suspension liquid will becomes unstable.

The UDD of the present invention has a large amount of negatively charged functional groups provided on the particle surface and can thus be improved in the surface activity and the affinity. Also, as the UDD not include big size particles, and diameters of the UDD particles are in a narrow range, therefore the UDD particles can hardly be aggregated and precipitated as compared with the conventional diamond particles and they are dispersed and suspended in stable state in aqueous suspension. When the UDD suspension liquid is aqueous, the addition of surface-active agent is not essential which may rather decline the suspension stability, in some cases. It is estimated that such declination may result from the following reasons.

Figure 2:
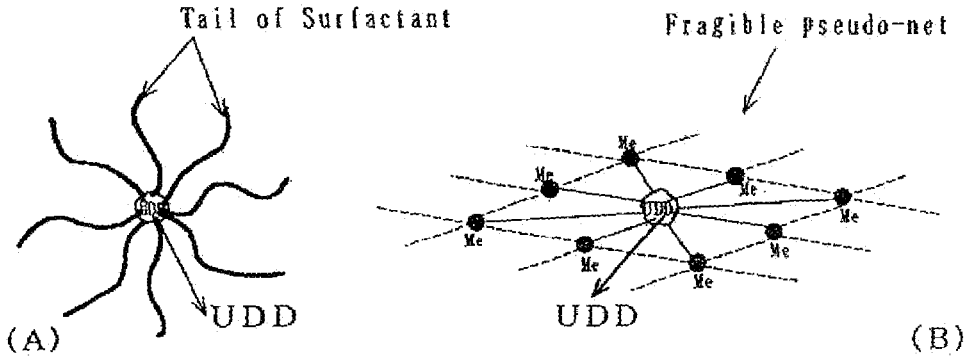
FIG. 2 is a schematic view explaining the action of the UDD of the present invention in a plating solution.

Namely, in contrast with conventional UDD particles which are generally dispersed in liquid using a cationic surface-active agent, as schematically shown in FIG. 2A, in case of UDD of the present invention, cations in used cationic surface-active agent are attracted by the negatively charged functional group on the UDD surface. As a result, each hydrophobic long-chain hydrocarbon group of surface-active agent is oriented with facing to the outside liquid phase and thus will be declined in the hydrophilic property.

On the other hand, the negatively charged UDD particle of the present invention is being bonded with cationic metal atoms in the plating liquid to form a quasi net structure which can easily be fractured and reconstructed, as shown in FIG. 2B. The quasi net structure is migrated towards the anode (a positive electrode) by the action of a voltage and deposited as a mixture metal plating.

Figure 3:
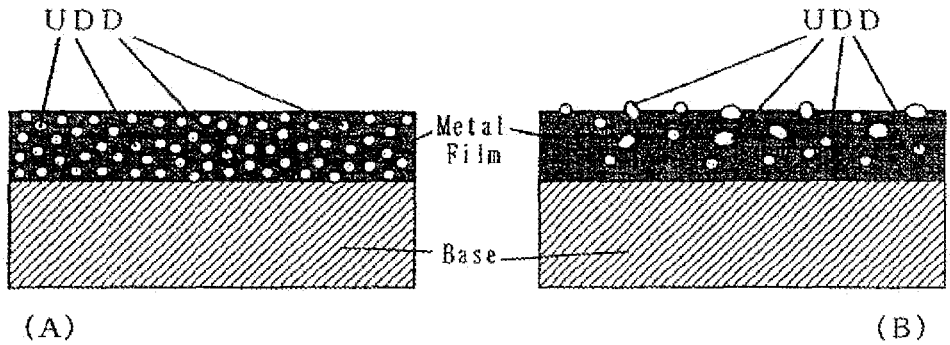
FIG. 3 is a schematic cross sectional view of the UDD contained metal film of the present invention.

Accordingly, the UDD contained metal film of the present invention can have the UDD particles dispersed uniformly at a high density therein, as shown in FIG. 3A. Conventional UDD-containing metal film is schematically illustrated in FIG. 3B where the UDD content becomes lower in proportion with depth levels from surface of plated layer to the bottom of the layer. In some cases of conventional UDD, particles thereof may not completely be embedded in the metal film but exposed at the surface to the outside. This may result from a difference of transferring ratio of the metal atoms and UDD particles in plating baths of conventional process and of process in the present invention, and it is considered that the conventional bath is modified by surface-active agent causing change of charged state and has particles of larger diameters. However the above phenomenon is not one for limiting the present invention, but one for assisting the compatibilities between UDD particles modified by surfactant and UDD particles of the present invention. Sufficient miscibility of UDD particles of the present invention which are modified by surfactant into resin solution of the hydrocarbon organic solvent, may be supported by the hypothesis.

[Resin Composition]

The polymers modified by addition of the UDD of the present invention can widely be utilized in a various industries such as automobile, tractor, ship building, medical industry, chemical industry, petroleum industry, sealing, protective, and friction-resistant film industries. Using method of cold curing and impregnating a fluorine elastomer with the UDD particles, there are provided specific coatings which are characterized in that: (i) permeability of hydrocarbon or polar solvent is declined to as a small level as 1/50 or namely from $1.389\times10^{-7}$ kg/m$^2$ sec to $0.0278\times10^{-7}$ kg/m$^2$ sec, where the chemical durability of ethylene/perfluoro-alkyl vinyl ether copolymer (a protective film) doped with the UDD of the present invention shows very high degree.

(ii) the dry friction coefficient of the metal is declined to 0.01 or lower; (iii) the durability of copolymer elastomer is improved, where the elastomer of 100% stretched ethylene/perfluoro-alkyl vinyl ether copolymer is increased by a factor of 10 from 8.5 MPa to 92 Mpa in the tension stress factor and from 15.7 MPa to 173 MPa in the fracture-resistant strength, also by a factor of 1.6 from 280% to 480% in the relative tensile elongation but decreased by 1/1.2 from 108% to 81% in the relative tensile retained; and (iv) the bonding strength of an adhesive is increased.

More specifically, the improvements are that: (a) the bonding strength of the active surface to steel ($C_T$ grade) is increased by a factor of about 300 to 500 from 1.7 kN to 5.1 kN, to aluminum is from 0.5 kN to 3.3 kN, and to zinc by a factor of 3 to 6 times; (b) the bonding strength of the inert surface to lead or copper is increased to 2.8 kN to 3.3 kN; and (c) the dielectric loss tangent of film samples ranges from 2.58 to 2.71 at 4000 MHz depending on the thickness while the penetration factor and the reflection factor of the same is increased up to 15 and 12.4 respectively at 5000 MHz or 14.3 and 12.4 respectively at 11000 MHz also depending on the thickness.

As, the UDD contained metal film of the present invention is improved in the physical and mechanical properties, it can be treated under a pressure of $2\times10^6$ kg/m$^2$. Also, the improvements are that: (d) the film of polysiloxane modified by the UDD of the present invention or of 100% stretched polysiloxane elastomer improved in the durability is increased by a factor of 3 from 19 MPa to 53 MPa in the tensile stress and from 52 MPa to 154 MPa in the tensile-fracture-resistant strength; and (e) the resistance to resiliency and the resistance to thermal degradation of a 100% stretched fluorine rubber material containing the UDD of the present invention are increased by a factor of 1.6 from 7.9 MPa to 12.5 MPa and by a factor of 1.35 from 210 MPa to 285 MPa respectively. In addition, the film of fluorine elastomer containing the UDD of the present invention is increased by a factor of 1.5 to 2 in the frictional resistance. The film of polyisoprene is also increased by a similar factor. The film of fluorine rubber containing the UDD of the present invention when heated and degraded more or less remains substantially equal to or slightly higher in the physical and mechanical properties than those of common fluorine rubber. The UDD while being heated and degraded rarely creates any structural fracture but produces its reverse effect. As described, the fluorine rubber containing the UDD of the present invention has an improved level of the elastomer properties.

When the fluorine rubber is stretched to 300%, it will increase by a factor of 1.4 from 7.7 MPa to 12.3 MPa in the stress, and thus from 139 MPa to 148 MPa in the tensile-fracture-resistant strength. The maximum swelling degree of the fluorine rubber in toluene is declined to 45% the original. As described, the fluorine rubber is higher in the hardness and the durability (about 30% higher than any conventional one) and in the resistance to mechanical fatigue. The increase in the stretching rate due to the enhancement of the durability is not derived from the known theory but may result from a modification in the molecular structure of the fluorine rubber. This is proved by the fact that the adhesivity is increased by a factor of 1.6 from 1.7 MPa to 2.7 MPs.

Because the rubber is modified with the UDD of the present invention, its properties (the stress at 300% of the stretching, the fracture-resistant strength, and the tensile strength) can be improved by a factor of 1.6 to 1.8 without changing the elasticity. The rubber containing the UDD of the present invention is higher in the hardness than any conventional rubber containing non of the UDD of the present invention (as increased from 5.8 MPa to 7.4 MPa at 300% of the stretching with its stretching degree declined from 700% to 610%). When the rubber is added with both the UDD of the present invention and another artificial carbon powder together, its tensile strength will be increased by as a higher percentage as 25 to 35% than that of typical samples.

When the UDD of the present invention is mixed with a common rubber mixture based on a butadiene (70 mol)-styrene (30 mol) copolymer, its adhesivity is increased by a factor of 1.5 to 2.0 from 1.6 MPa to 3.1 MPa as compared with the typical samples. The copolymer rubber containing the UDD of the present invention is equal in the durability to and higher in the hardness than typical samples while is increased by a factor of substantially 2 from 71 kN to 135 kN in the tensile strength and by a factor of substantially 1.44 from 7.9 MPa to 11.4 MPa at 300% of the stretching.

The film of butadiene/nitryl rubber B14 modified by the UDD of the present invention is decreased by a factor of 1.5 in the friction coefficient but increased by a factor of 1.4 in the durability to fatigue and by a factor of 1.7 in both the elasticity and the frost resistance (with a drop by 8 to 10% in the glass transition temperature).

As the film of natural rubber (RSS in Malaysia) modified by the UDD of the present invention is increased in the resistance to fatigue, its stress at 300% of the stretching rises by a factor of substantially 3 from 1.8 MPa to 5.4 MPa. The viscosity and bonding strength of an epoxy adhesive containing the UDD of the present invention are also improved significantly.

The UDD of the present invention can preferably be used for various polymerizing processes including suspension polymerization, copolymerization, chemical curing, electron curing, glass flame heat-up curing, and electrostatic paint curing. The polymer composition containing the UDD of the present invention is hence characterized by: (i) improvements in the strength, the climate resistance, and the wear resistance; (ii) decrease in the friction coefficient of poly-fluoro elastic material or perfluoro polymer and increase in the friction coefficient of poly-isoprene; (iii) ease of application to the micro technologies and use as materials or coatings of the micro products, thus enhancing the quality and the commercial value of its final product. The UDD of the present invention is dispersed preferably 1 to 5 kg for every 1000 kg of the copolymer or rubber or 1 to 5 kg for every 1000 m$^2$ of the film or coating.

[Lubricant, Grease, Lubricating Coolant, Hydraulic Medium]

Also, a lubricant composition modified by the UDD of the present invention can be used for various mechanical industries including machinery manufacturing, metal machinery, engine manufacturing, ship building, airplane manufacturing, and transportation machinery. The lubricant oil containing the UDD of the present invention includes micro particles which are very hard and not greater than $5\times10^{-7}$ m in the diameter and is thus highly resistive to the sedimentation, declining the friction moment by 20 to 30% and the surface frictional fatigue by 30 to 40%. The UDD of the present invention in the lubricant is preferably 0.01 to 0.2 kg for every 1000 kg of the basic oil.

[Other Applications]

The UDD of the present invention can be added to shaped compositions of a metal material or a ceramic material to be baked for fabricating highly wear-resistant carbide tools in order to improve the lubrication, the hardness, the heat dissipation, the specific density, and the dimensional stability after the shaping of the material.

MODES FOR EMBODYING THE INVENTION

Synthesizing of UDD

The present invention will be described in more detail referring to the relevant drawings.

Figure 4:
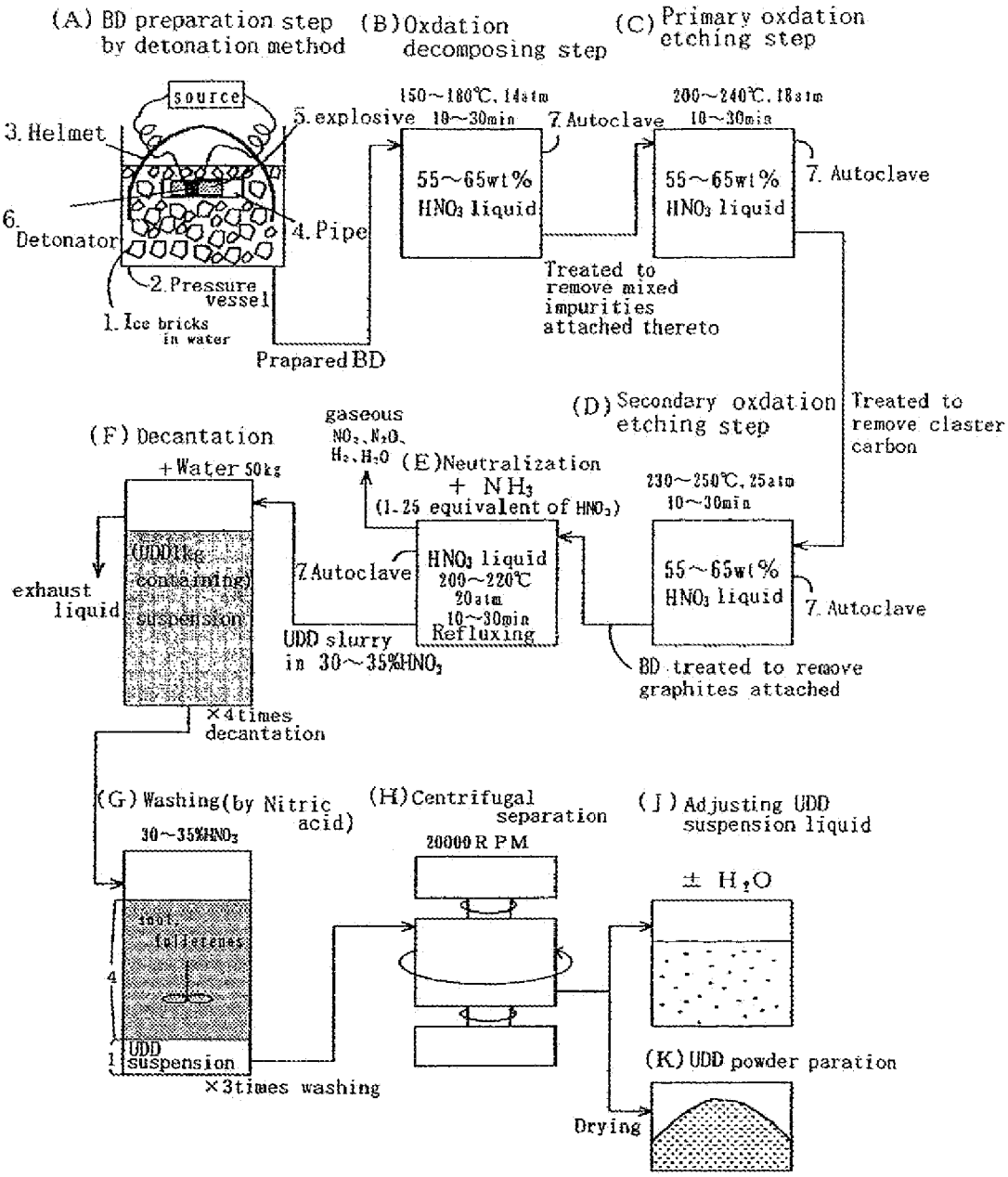
FIG. 4 is a principal diagram showing a method of synthesizing the UDD powder and a method of preparing the UDD dispersed suspension liquid of the present invention.

FIG. 4 is a schematic diagram showing a procedure of producing an improved UDD dispersed suspension liquid of the present invention.

The method of producing the UDD suspension liquid of the invention comprises the steps of consisting of, step (A) of preparing an initial BD by shock conversion process using the detonation of an explosive; step (B) of recovering and subjecting the initial BD to oxidative decomposition for eliminating contaminants such as carbons; step (C) of subjecting the obtained initial BD from the step (B) to the primary oxidative etching for removing hard carbons covering the surface of the BD; step (D) of subjecting the BD primary oxidatively etching treated, to secondary oxidative etching for removing hard carbons which are existing in the ion-permeable gaps between the UDD particles composing BD aggregate and in crystalline; step (E) of adding a basic material, which is volatile or its decomposition product is volatile, to a nitric acid aqueous liquid produced from the secondary oxidative etching and including the BD to conduct a neutralizing reaction, to conduct a decomposing reaction with nitric acid being remained in the resultant for decomposing the secondary BD aggregate form into individual UDD particle; step (F) of decanting with water the UDD suspension liquid produced by the neutralization; step of (G) washing with nitric acid and holding the UDD suspension liquid obtained from the decanting step in stational state to deposit and separate UDD-contained lower suspension layer portion from an upper drainage layer portion; step (H) of subjecting the washed UDD suspension to centrifugal separation; step (J) of preparing a purified UDD suspension aqueous solution at a desired pH and a desired concentration from the centrifugal separated UDD suspension. And UDD powder of the invention further comprises a step (K) of separating solid ODD from the suspension and drying the UDD at a temperature not higher than 250° C. or preferably not higher than 130° C., to obtain a UDD powder. The UDD suspension of the present invention after the step (J) has a pH level of 4.0 to 10.0, preferably 5.0 to 8.0, or more preferably 6.0 to 7.5.

In the step (A) of preparing initial BD by shock conversion process, a steel pipe (4) provided with a plug at one end and containing an explosive (5) (TNT (tri-nitro-toluene)/HMX (cyclo-tetra-methylene-tetra-nitramine at 50/50 in this embodiment) and equipped with an electric detonator (6) therein, is placed horizontally in a pure-titanium made pressure vessel (2) which is filled with water and a large amount of ice bricks (1), then the steel pipe (4) covered with steel helmet (3), then the explosive (5) is detonated, then taking up a product namely initial BD from the water containing ice bricks in the vessel (2).

However, the temperature condition in the BD preparing step is essential. As any BD prepared under a cooled condition is possibly declined in the density of its structure defects which are bonded with the oxygen containing functional groups to occur active sites or absorption sources, the use of ice should be limited or avoided if possible.

The obtained BD (initial BD) is subjected to the oxidative decomposition step (B) where it is dispersed in 55 to 56% by weight of conc. $HNO_3$ and oxidized at 150 to 180° C. under around 14 bars for 10 to 30 minutes to decompose carbon and other inorganic contaminants. After the oxidative decomposition step (B), the BD is subjected to the primary oxidative etching step (C). The condition in the primary oxidative etching step (C) is as crucial as at 200 to 240° C. under aroundl8 bars to remove hard carbons deposited on the surface of the BD.

Obtained BD is followed by the secondary oxidative etching step (D) where the condition is more crucial with 230 to 250° C. under 25 around bars to eliminate small amounts of hard carbon existing in the crystalline defects of the UDD surface and in the ion permeable inter-gaps between the UDD particles of each BD aggregate. The present invention is not limited to the conditions such as 150 to 180° C. under 14 bars, 200 to 240° C. under 18 bars, or 230 to 250° C. under 25 bars but may preferably have at least, in step by step, more crucial levels of the conditions. After the secondary oxidative etching step (D), the solution is turned to an acidic level having a pH of 2 to 6.95.

The neutralizing step (E) is a unique feature of the present invention as is differentiated from any conventional method. Because of adding the additive of basic reagent which generates a volatile decomposition product in the neutralization, the pH of the solution shifts from a range of 2 to 6.95 to a higher range of 7.05 to 12. The neutralizing step (E) makes the nitric acid solution containing BD product from the secondary oxidative etching, to mix with the additive of basic reagent, which is volatile or its decomposition product is volatile for smoothening the neutralization reaction. Although not intended to limit the present invention by the following hypnosis, it is considered that in the neutralization, the nitric acid remaining in the BD suspension liquid can be assaulted by cations which in general have smaller ion diameters than that of anions, thus can penetrate into inner small or narrow gaps of BD particle where $HNO_3$ is still remaining, thereupon occurring violent reactions with the $HNO_3$ for the neutralizing it, decomposing impurities which are also still remaining by escape from the attack of the $HNO_3$, dissolving them, and generating gas, thus producing surface functional groups, in accompany with increases of the temperature and pressure by the gas generation which again may affect to the purification, and also to the separation of the BD aggregate into individual UDD particles. Also, during the violent neutralizing step (E), the specific surface area of the UDD may be increased while the porous absorption spaces being developed.

Characteristic examples of the basic additive are: hydradine, methyl amine, dimethyl amine, trimethyl amine, ethyl amine, diethyl amine, triethyl amine, ethanol amine, propyl amine, isopropyl amine, dipropyl amine, aryl amine, aniline, N,N-dimethyl aniline, diisopropyl amine, poly-alkylene poly-amine such as diethylene triamine or tetraethylene pentamine, 2-ethylhexyl amine, cyclohexyl amine, piperydine, folmamide, N,N-methyl folmamide, and urea. For example, when the basic additive is ammonium, the reactions with acid are:

$$HNO_3+NH_3 \rightarrow NH_4NO_3 \rightarrow N_2O+2H_2O$$

$$N_2O \rightarrow N_2+(O)$$

$$3HNO_3+NH_3 \rightarrow NH_4NO_2 \rightarrow N_2O_3+H_2O+O_2+(O)$$

$$NH_4NO_2 \rightarrow N_2+2H_2O$$

$$N_2O_3+NH_3 \rightarrow 2N_2+3H_2O$$

$$N_2O_3 \rightarrow N_2+O_2+(O)$$

$$NH_4NO_2+2NH_3 \rightarrow 2N_2+H_2O+3H_2$$

$$H_2+(O) \rightarrow H_2O$$

$$HCl+NaOH \rightarrow Na^+ + Cl^- + H_2O$$

$$HCl+NH_3 \rightarrow NH_4^+ + Cl^-$$

$$NH_4^+ \rightarrow NH_3+H^+$$

$$H_2SO_4+2NH_3 \rightarrow N_2O+SO_2NO_2$$

As the resultant gases of $N_2$, $O_2$, $N_2O$, $H_2O$, $H_2$, and possible $SO_2$ generated from the above reactions are discharged to the outside, therefore the system can hardly be affected by any residues.

In the decanting step (F), it is necessary that decantations with water of the UDD suspension from the neutralizing step are repeated by a plural number of times (for example, three times). In the washing step (G), to the decanted UDD suspension is added by nitric acid and stirred by a mechanical magnetic stirrer in this embodiment, settled to separate lower layer of UDD suspension and upper layer which is no existence of UDD and thus is a portion to be withdraw. The lower suspension liquid containing UDD is then separated in, from the upper drainage liquid. While border between the lower suspension liquid containing UDD and the upper drainage liquid can not clearly distinguished by naked eye observation in some cases, amount of lower suspension liquid containing UDD is about ¼ in case of 50 kg of water is added into 1 kg of suspension liquid containing UDD, hence amount of the upper drainage liquid is about ¾. The upper suspension contains very fine particles of diamond having diameters ranged from 1.2 to 2.0 nm which may be aggregated together with unwanted components, and these aggregates are hardly separable with a mechanical force, therefore recovery of such aggregates of very fine diamond particles and impurities from upper layer is not necessarily in the present invention.

The UDD suspension taken from the bottom layer of the vessel is subjected to the centrifugal separating step (H) which is conducted by a high-speed centrifugal separator ratable at 20000 rpm. When desired, the UDD suspension is subjected to the step (J) for adjusting UDD suspension aqueous solution, or UDD drying step (K) to prepare power form of UDD. The UDD prepared by the method of the present invention in either a suspended form or a powder form is fallen in a very narrow range of the diameter profile. As results of measurements, it is found out that the UDD includes no particle having 1000 nm or greater diameter (as compared with any conventional UDD particles where about 15% are large size diamonds having 1000 nm or greater diameters in usual) and also no particle having 30 nm or smaller diameters, and volumetric average particle diameter of the UDD ranges from 150 to 650 nm, and is typical narrower distribution of diameters ranging in the scope of 300 to 500 nm. These UDD particles can be divided into original elements by applying ultrasonic dispersing action in water, or other mechanical shearing action.

The UDD of the present invention has a specific density of $3.2\times10^3$ to $3.40\times10^3$ kg/m$^3$. Specific density of amorphous carbon is $(1.8 \text{ to } 2.1)\times10^3$ kg/m$^3$ and specific density of graphite is $2.26\times10^3$ kg/m$^3$, and specific density of natural diamond is $3.51\times10^3$ kg/m$^3$, further, other artificial diamonds synthesized by static conversion technique (not shock conversion) have a specific density of 3.47 to 3.50. Accordingly, specific density of the UDD of the present invention is smaller in the specific density than natural diamond or any synthetic diamond synthesized by static conversion.

The UDD suspension of the present invention is adjusted pH level in the scope of 4.0 to 10.0, preferably 5.0 to 8.0, or more preferably 6.0 to 7.5. Volumetric particle diameters of almost all particles (at over 80% in number average and over 70% in weight average) of the UDD particles suspended in liquid are small, and in the narrow range as they are in the range of 2 nm to 50 nm. Concentration of the UDD particles in the UDD suspension liquid is in the range of 0.05 to 16%, preferably 0.1 to 12%, or more preferably 1 to 10%. If concentration is smaller than 0.05%, the content of the UDD in a metal film fabricated from plating solution prepared by using the UDD suspension liquid, or the content of the UDD in a resin film fabricated from resin coating composition prepared by using the UDD suspension liquid will hardly be increased to an adequate level. If its concentration exceeds 16%, the UDD suspension liquid may be declined in the storage stability.

The steps (B), (C) and (D) in FIG. 4 are illustrated as like they are implemented at different locations using different vessels, but those steps, of course, may be implemented at same location and same vessel or facility with equal success. Similarly, the steps (F) and (G) may be implemented either in separate locations or one single location. The vessel used is pressure vessel.

Figure 5:
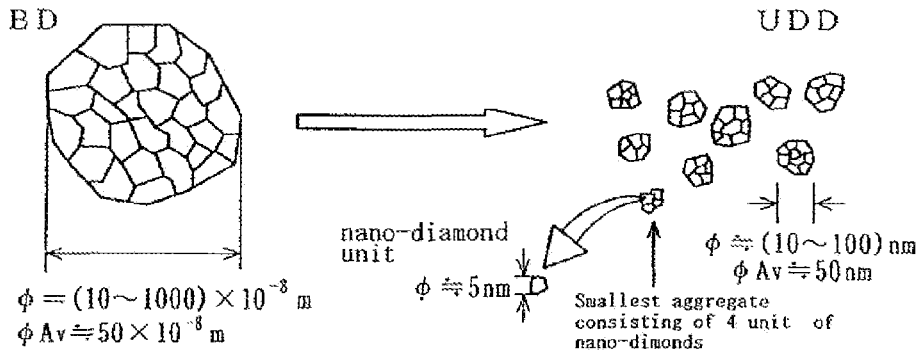
FIG. 5 is a view illustrating a step of fabricating the UDD powder of the present invention.

As shown in FIG. 5 conceptually, by the method of the present invention, purified UDD particles of a number of aggregates, and each aggregate consisting mainly of at least four or commonly tens to hundreds of nano-diamonds of the order of 4.2±2 nm in the average diameter, are obtained from initial BD particles having diameters in the order of $(10 \text{ to } 1000)\times10^{-8}$ which are divided into a number of UDD. Diameters of the purified UDD particles are in a narrow scope ranging from 10 nm to 100 nm, and weight average diameter is as small as 5 nm. The resultant UDD is high in content of hetero atoms (of hydrogen and oxygen) other than nitrogen and has large specific surface area owing to small diameter of each particle and particularly owing to surface area in many pores developed in the each particle, thus increasing the surface activity and improving the dispersion stability. The productivity of the purified UDD (in relation to amount of explosive used) is between 1% and 5%, usually.

EXAMPLES

UDD, UDD Suspension, their Methods

Examples illustrated below are for the understanding aid of the present invention and not intended to restrict the scope of the present invention.

Example 1

With regard to the UDD of the present invention, Samples which depend on the degree of oxidative decomposition and oxidative etching, were obtained from preparation methods as shown in FIG. 4, and elements compositions of the Samples were analyzed. The result is shown in Table 3 below, which is of course be changeable to conventional data of element compositions based on 100 carbon atoms by calculations.

according to the present invention that increase in oxidative degree such as temperature increase, acid concentration increase, influences gradually on gasification of carbon to carbon dioxide occurrence.

In the oxidative etching step of the present invention, first of all amorphous carbons which are arranged at random are oxidized, then carbons forming micro-graphite phases are oxidized, thus initial BD including non-diamond forms of carbon may be sequentially shifted to purified substantially complete diamonds which are no more oxidized but in chemically inert state.

However, the present invention can further decompose partially the diamonds to more pure ones, by conducting more sufficient oxidative etching under the more severe condition for an extended period of time. Degree of the oxidative etching step in the present invention reaches up to substantially 45% of the UDD, or 76.5% of the initial BD.

TABLE 3

| The element composition of BD | | | |
|---|---|---|---|
| Treatment conditions initial BD (wt. %) | Sample No. | Gross-formula | Relative quantity of heteroatoms on 100 atoms of carbon |
| initial, $\alpha = 0$ (Comparative Example 1) | 1 | $C_{100}H_{5.3}N_{2.8}O_{4.1}$ C: 86.48%, H: 0.81%, N: 2.22%, O: 10.49% | 12.2 |
| $\alpha = 26.3\%$ (Comparative Example 2) | 2 | $C_{100}H_{25.4}N_{2.9}O_{22.5}$ C: 73.80%, H: 1.56%, N: 2.50%, O: 22.14% | 50.8 |
| $\alpha = 31.8\%$ (Comparative Example 3) | 3 | $C_{100}H_{34.9}N_{2.9}O_{23.1}$ C: 72.94%, H: 2.12%, N: 2.47%, O: 22.47% | 60.9 |
| $\alpha = 55.0\%$ | 4 | $C_{100}H_{11.2}N_{2.2}O_{9.1}$ C: 86.48%, H: 0.81%, N: 2.22%, O: 10.49% | 22.5 |
| $\alpha = 64.9\%$ | 5 | $C_{100}H_{19.3}N_{2.1}O_{23.5}$ C: 73.86%, H: 1.19%, N: 1.18%, O: 23.14% | 44.9 |
| $\alpha = 74.4\%$ | 6 | $C_{100}H_{18.7}N_{2.0}O_{22.8}$ C: 74.46%, H: 1.16%, N: 1.74%, O: 22.64% | 43.5 |
| $\alpha = 75.5$ | 7 | $C_{100}H_{23.7}N_{2.4}O_{22.9}$ C: 73.91%, H: 1.46%, N: 2.07%, O: 22.57% | 48.8 |

In the Table 3, degree of oxidization a is identical to that described previously. The result of the analysis exhibits important, interesting technical aspects. Namely, products from the BD oxidizing (oxidative decomposition and oxidative etching) are significantly varied in the ratio of carbon atoms and hetero atoms. It is apparent from Table 3 that the contents of hetero atoms in the BD and ODD is not simply proportional to the process condition (the degree of oxidization $\alpha$). It is also apparent from both Table 3 and Table 2 that the amount of hydrogen atoms as the hetero atoms contained in the BD or UDD are significantly varied within range of 5 to 35 for 100 carbon atoms, while the amount of oxygen atoms is also varied in the range of 4 to 32 for 100 carbon atoms. However, the amount of nitrogen atoms is slightly varied in the narrow range of 2 to 4 for 100 carbon atoms, therefore will hardly be affected by the process condition (the degree of oxidization $\alpha$).

It is assumed that the generation of carbon dioxide gas is strongly relating to the surface state of the BD of UDD. Therefore, though description of specific result is omitted here in Table 3, it was confirmed by a series of examinations

Example 2

Figure 6:
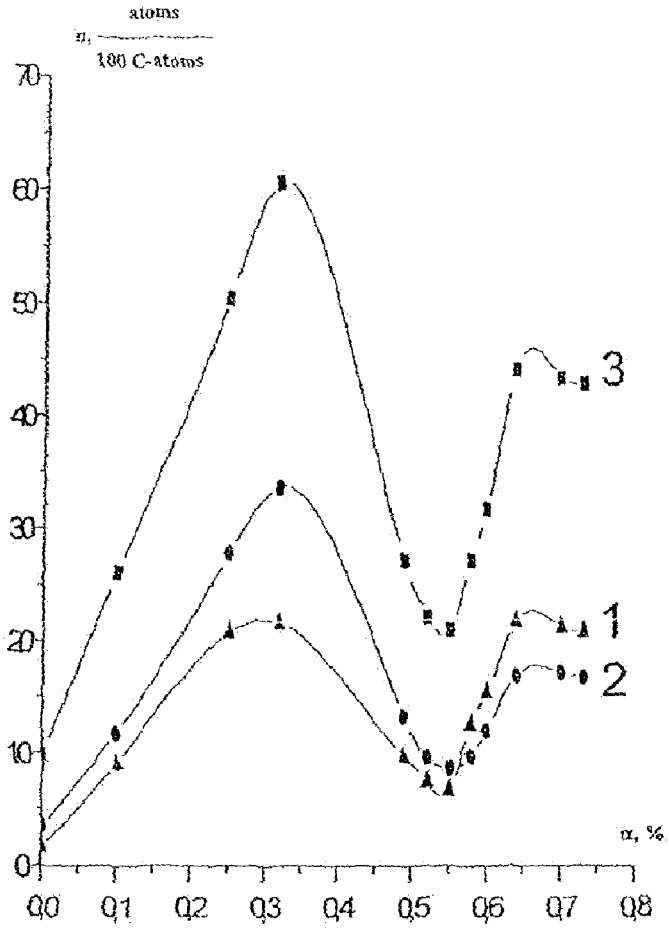
FIG. 6 is a diagram showing the relation between the degree of oxidization and the elemental composition of the UDD of the present invention.

Similar processes as that of oxidizing steps described in Example 1 were conducted using same initial BD, to prepare twelve Samples which were different in the degree of oxidization as shown in FIG. 6.

As apparent from a graphic diagram of FIG. 6, the relationship between degrees of oxidative decomposition and etching and compositions of finished BD is not simple. In other words, the BD composition does not depend proportionally on the degree of oxidization. Content of hetero atoms for 100 carbon atoms in the initial BD was minimum, and content of hetero atoms for 100 carbon atoms in partially oxidized BD (at $\alpha$=26 to 31%) was 53.5, while content of hetero atoms for 100 carbon atoms in partially oxidatively etched BD (at $\alpha$=65 to 75%) is 4.9. As the oxidization was proceeded on, content of hydrogen and oxygen atoms was varied, thus chemical constituent of surface functional groups was approaching to a certain magnitude.

According to the present invention, for metastable structures such as partially oxidized BD or partially etched UDD the activity of partially oxidized BD or partially etched UDD, relaxation of surface is realized at the presence of active interaction with reaction medium to form a maximum number of heterobonds More stable structure form such as the BD or UDD of the present invention contains a minimum hetero atoms, even so, activity thereof is however much higher than that of conventional fine particles of diamonds synthesized by static conversion, $C_{100}H_{1.1}O_{2.2}$, or soot $C_{100}H_{5.1}O_{4.1}$.

It is understood from a chemical point of view on the above illustrated result that the oxidative decomposition step as change of phases to be interpreted; 1) primary etching of carbon matrix by structural defects and inter-particle bonds, in so doing an increase of the reaction surface and its saturation with semi-products of oxidation occurs; 2) etching of loosed surface, gasification and removing of oxidation products. Character of change of these phases shows that a non-uniform material by structure is subjected to decomposition, and an effect of oxidant is selective to different structural forms.

The presence of such high content hetero atoms in the BD or UDD of the present invention reveals a possible localization and a character of bonds with carbons. As a resulted calculation of measured, each diamond particle having about $4\times10^{-9}$ m diameter, consists of maximum $12\times10^{3}$ carbon atoms, and $3\times10^{3}$ atoms of them are surface ones. Accordingly, the composition of the UDD of the present invention is expressed by Formula bellow Table 4.

TABLE 4

| Internal atoms | Surface atoms |
|---|---|
| $C_{75}$ | $C_{25}H_{11.2}N_{2.8}O_{9.1}$ |

The other examples, not explained herein, also have similar compositions. As apparent from above mentioned aspects, it is concluded that substantially all of surface carbon atoms of the UDD of the present invention are bonded with hetero atoms. Expression of "Substantially all of surface carbon atoms are bonded to hetero-atoms" used in here the specification means this state.

It is understood from the result of studies for the concentration of active hydrogen $H_{act}$ at the surface of the UDD of the present invention that hydrogen atoms are active when they are bonded with any other atoms than the carbon atoms. The active hydrogen atoms $H_{act}$ at the surface may be identified as ones which provided in possible functional group such as hydroxy, carbonyl, amino, or sulfone groups.

With regard to the interactions between the functional group at the UDD surface of the present invention and methyl magnesium iodide under the presence of anisole, symbolic interactions in three processes, namely interactions (1) between impurity molecules and the outer surface functional group (which is easier accessible functional group) and the impurity molecules, (2) between the porous surface and the same; and (3) between the free surface by mechanical fracturing of UDD aggregates, were picked out.

The concentration of protogenic functional groups in the UDD was 0.34 to 2.52 micro kilogram equivalent weight per square meter, while the amount of active hydrogen was 0.49 to 7.52 micro kilogram equivalent weight per square meter, depending on different processing conditions. Accordingly, the amount of releasable radical hydrogen on the UDD surface was 4 to 22% of the total of hydrogen atoms contained in the UDD particle.

Onto surfaces of the UDD particles in the present invention, various kind of oxygen-containing functional groups are being provided which rules dispersible concentration of the particles in aqueous liquids, amount of electric charges influencing to pH values of the liquids, also concentration of phonon electrolytes used, affinity of the particles for other surfaces. Ions $H^+$ and $OH^-$ are potential-determining. Dependence of specific adsorption value of a degree of dissociation of surface group having acid properties.

The specific absorptivities of the surfaces depending on the increase of separation of acid groups were able to estimate, from the pH values in the suspension liquid of each Sample. Change of the specific absorptivities by effects of decomposition and etching of the carbon material were not continuous mono-tone but random and sharp.

The low specific absorptivity of the initial BD indicates that the BD was prepared in non-oxidative medium, therefore only small amount of the oxygen-containing groups are positioned on the BD surface. In the present invention, by the result of two steps in which the BD was exposed to different oxidizers, the surface of BD was saturated with the oxygen-contained groups and carbon components were etched. By emphasized oxidizinations, the carbon surface was growing in saturated with the oxygen-containing groups, hence maximizing the specific absorptivity, and thereafter, occurring no more change. However, when the remained amount of oxidative carbons exceeds 18 to 20%, the specific absorptivity was declined.

Such phenomenon is coincident with the result depicted in Russian Patent No. 2046094 by Bjuljuten Izobretenij, (29), 189 (1995), "Synthetic diamond contained materials". The Russian technology is briefly illustrated in FIG. 7 for reference.

Figure 7:
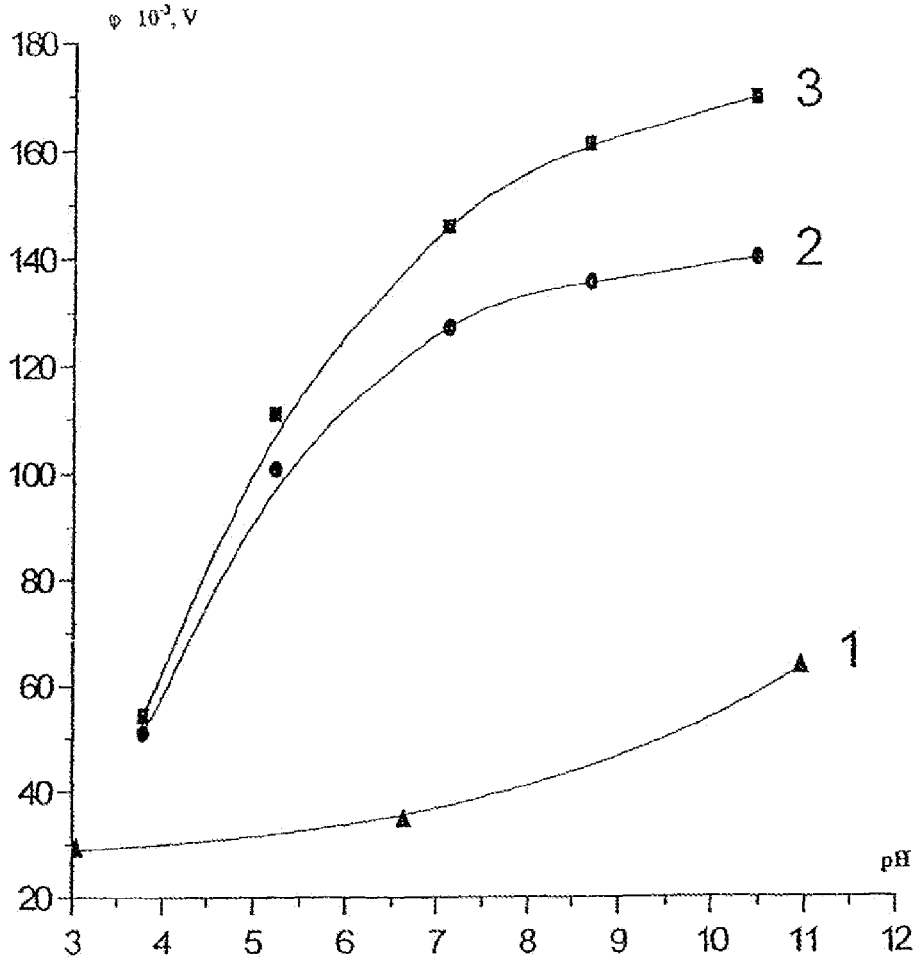
FIG. 7 is a diagram showing the relation between the pH and the activity of the UDD of the present invention.

Remarkable curves shown in FIG. 7 represent a change in the structural property of the BD surface during the treatment with an oxidizer, namely shifts from the graphite structures to the diamond structures (similar to the shifts in the present invention). The materials have high absorptivities in middle courses of the conversions. With oxidations under intensive oxidizing conditions, merely stable structure forms were remained. By moderated oxidizing conditions, the interfaces between the diamond carbons and the non-diamond carbons were replaced. Actually, 18 to 20% of the remaining last oxidative carbon amount as diamond phase (close to real diamond) are carbons constituting a shell surrounding each diamond cluster.

Example 3

Next, advantageous surface properties of the UDD of the present invention will be described in conjunction with Example 3.

Figure 8:
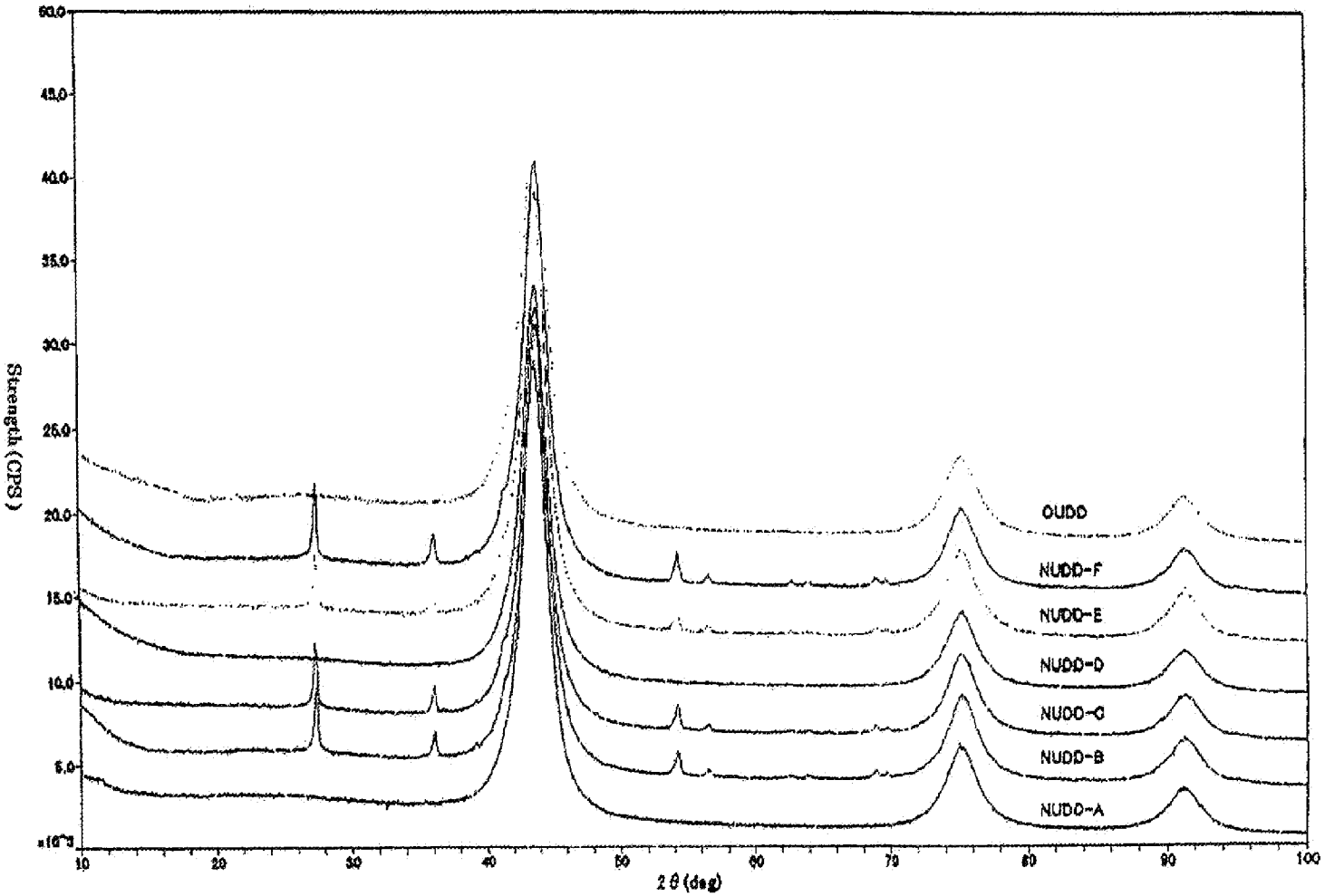
FIG. 8 is an X-ray diffraction chart showing some examples of the UDD of the present invention.

FIG. 8 illustrates measured results of the Bragg angle (2θ±2°) on the X-ray diffraction (XRD) spectrum using Cu—Kα radiation of seven samples: No. 13 of Example 5 (at α=49%, sample A), No. 14 of Example 5 (at α=56%, sample B), No. 4 of Example 1 (at α=55%, sample C), No. 5 of Example 1 (at α=64.9%, sample D), No. 6 of Example 1 (at α=74.4%, sample E), No. 1 of Example 1, No. 8 of Example 5 (at α=0%, sample F), and a conventional UDD sample (in dry powder, sample G). Also, XRD profiles of sample A and sample B are shown in FIGS. 9 and 10, respectively.

Figure 9:
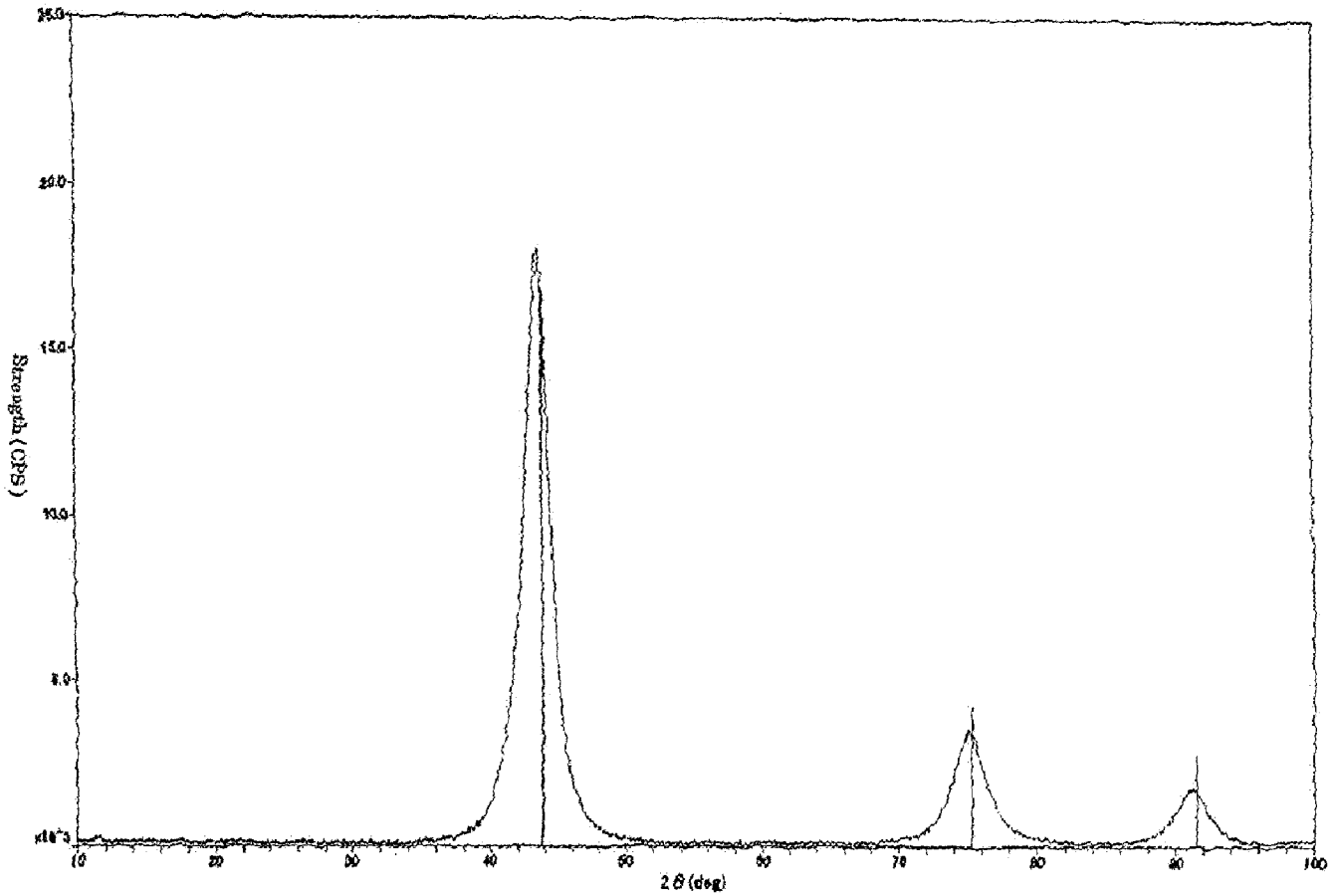
FIG. 9 is an X-ray diffraction chart showing in more detail one of the examples of the UDD of the present invention.
Figure 10:
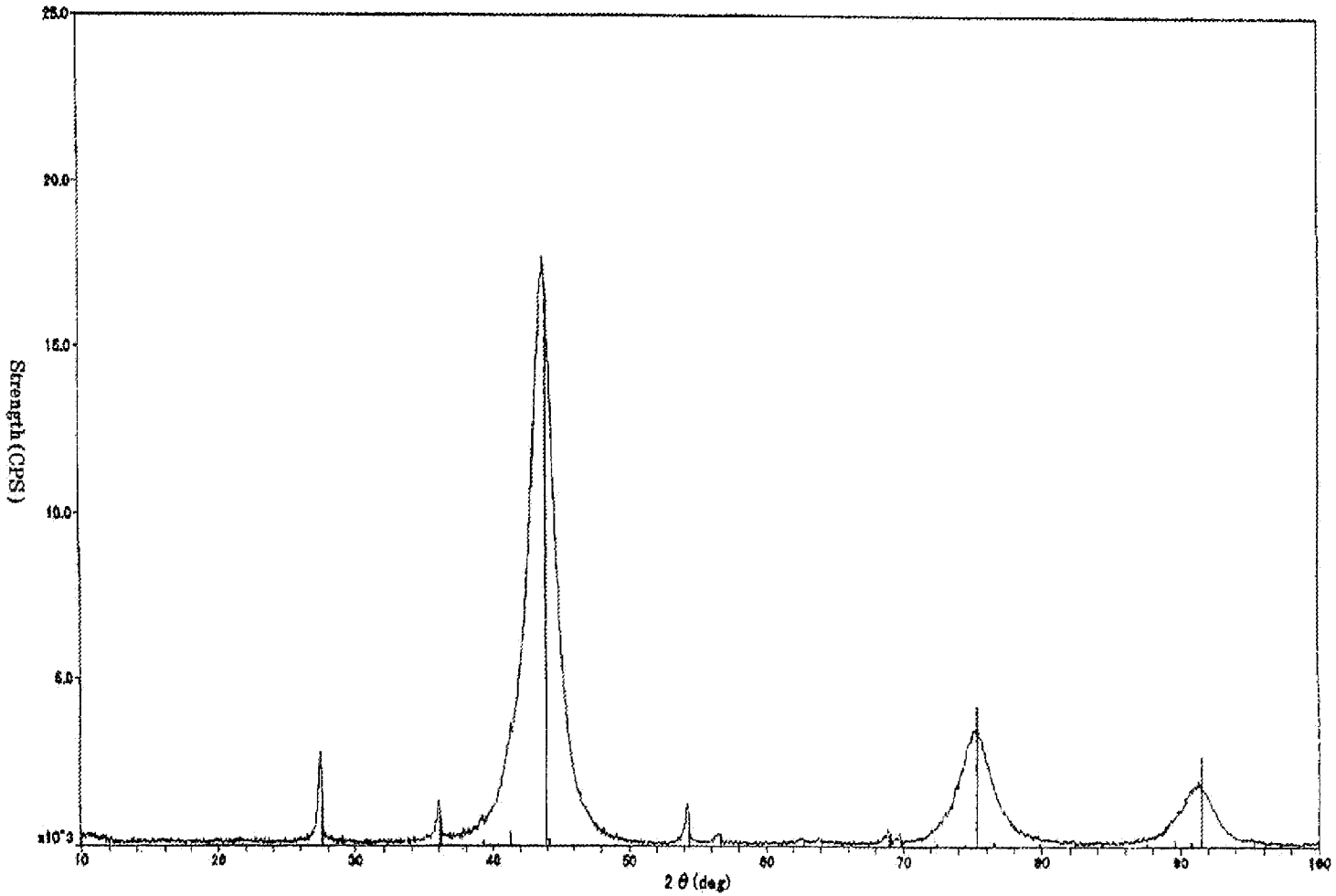
FIG. 10 is an X-ray diffraction chart showing in more detail another example of the UDD of the present invention.

It is apparent from the charts of FIGS. 8, 9, and 10 that the UDD samples of according to the present invention exhibit some peaks of the reflective intensity, the highest of 85.0% at 44° of the Bragg angle (2θ±2° pertinent to the (111) crystal structure, 14.0% at 73.5° pertinent to the (220) crystal structure, 0.2% at 91° pertinent to the (311) crystal structure, and 0.2% pertinent to the (400) crystal structure. And, there was no peat at 26.5±2° pertinent to a (002) graphite plane. Therefore it is obvious that the UDD of the present invention does not contain (002) graphite plane.

As a result from measurements, it is proved that presence of many patterns pertinent to the particular of $Sp^a$ carbon concentrations, thereby diamond phases are existing around a graphite phase of minimum size in the UDD.

In the XRD graphs of samples of containing as a main sample of the UDD at the degree of oxidization $\alpha$=64.9% according to the present invention, some Lorenz diffraction spectrum peaks having a wide, symmetrical shape appear at $2\theta$=43.9° of the Bragg angle pertinent to the (111) crystal structure, at $2\theta$=73.5° pertinent to the (220) crystal structure, and at $2\theta$=95.5° pertinent to the (311) crystal structure were recorded.

These spectra were ones reflected by the diamond form having a crystalline lattice parameter $\alpha=(3.565\pm0.005)\times10^{-10}$ m. Using Shehre's equation, the average particle diameter of the UDD is then calculated from values of half width of these spectra curves. Mean particle diameter $L=(42\pm2)\times10^{-10}$ m was obtained.

There was also provided a biased halo at 17° of the Bragg angle. When drawn with the primary beam, the intensity of scattering was high and stable. The intensive scattering of the primary beam represents the diffraction property based on amorphous structure. Apparently, the measured halo dose not imply diffracted light on the macro structure, however the halo is closely related to the scattering on very small structure such as a molecular size (for example, the size of graffin or a benzene ring). Such structure may be regular chains of carbon atoms or a planar assembly of regular carbon layers as well as peripheral particle (in diamond structure) of not smaller than $4\times10^{-9}$ m in size. By such halo having a high intensity, as compared with the peak intensity of the (333) crystal structure, there is existence of a structure of the molecular size. It was then assumed from a half the intensity of the halo by Shehre's equation, that the size of the structure was substantially $1.5\times10^{-9}$ m. Since there are detected smaller particles of the order of $4\times10^{-9}$ m, the amorphous form of diamond and graphite specified in a Raman scattering spectrum may be present.

It is also apparent from the analysis of the X-ray diffraction (XRD) spectrum charts that a sum of the intensity levels of the other peaks than the highest peak at 43.9°, for the intensity of the highest peak at 43.9° of the Bragg angles ($2\theta\pm2°$) in the XRD spectrum using Cu—K$\alpha$ radiation is 11/89 to 19/81 (namely intensity ratio of the highest peak at 43.9° for other total peaks is 89/11 to 89/19. In other words, the (111) plane diffraction is as high as 81 to 89.

Example 4

Figure 11:
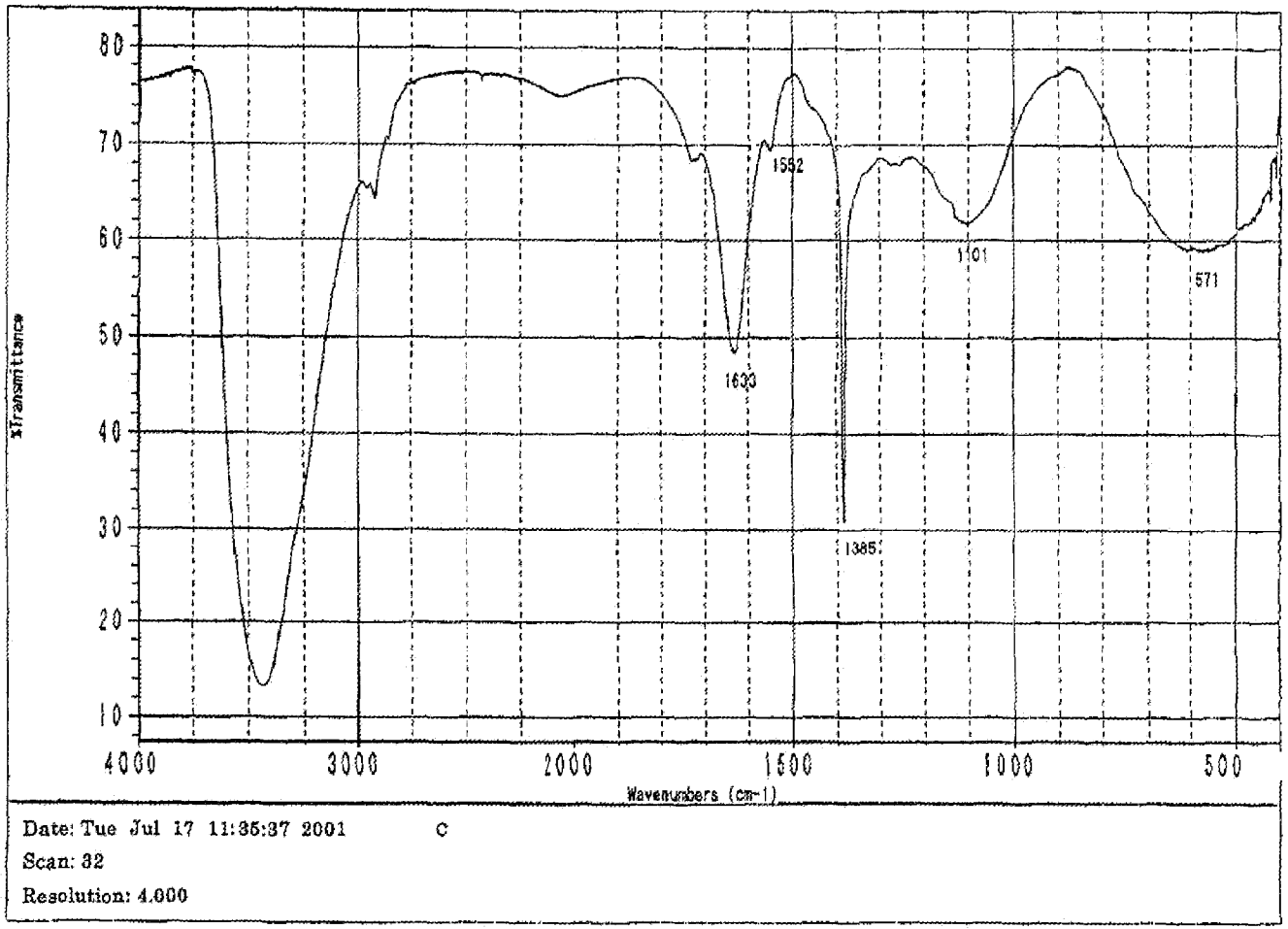
FIG. 11 is an IR measurement chart showing an example of the UDD of the present invention.
Figure 12:
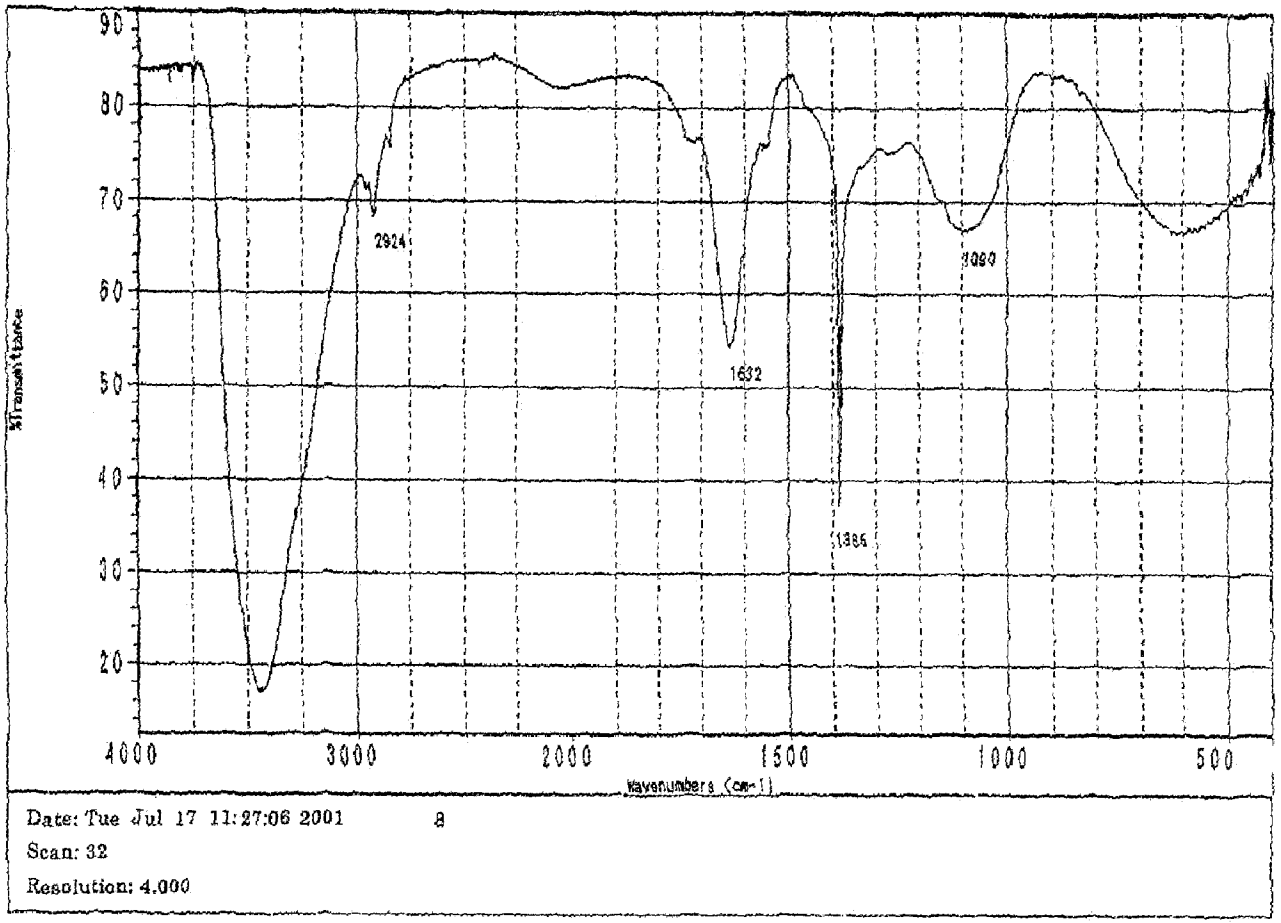
FIG. 12 is an IR measurement chart showing another example of the UDD of the present invention.
Figure 13:
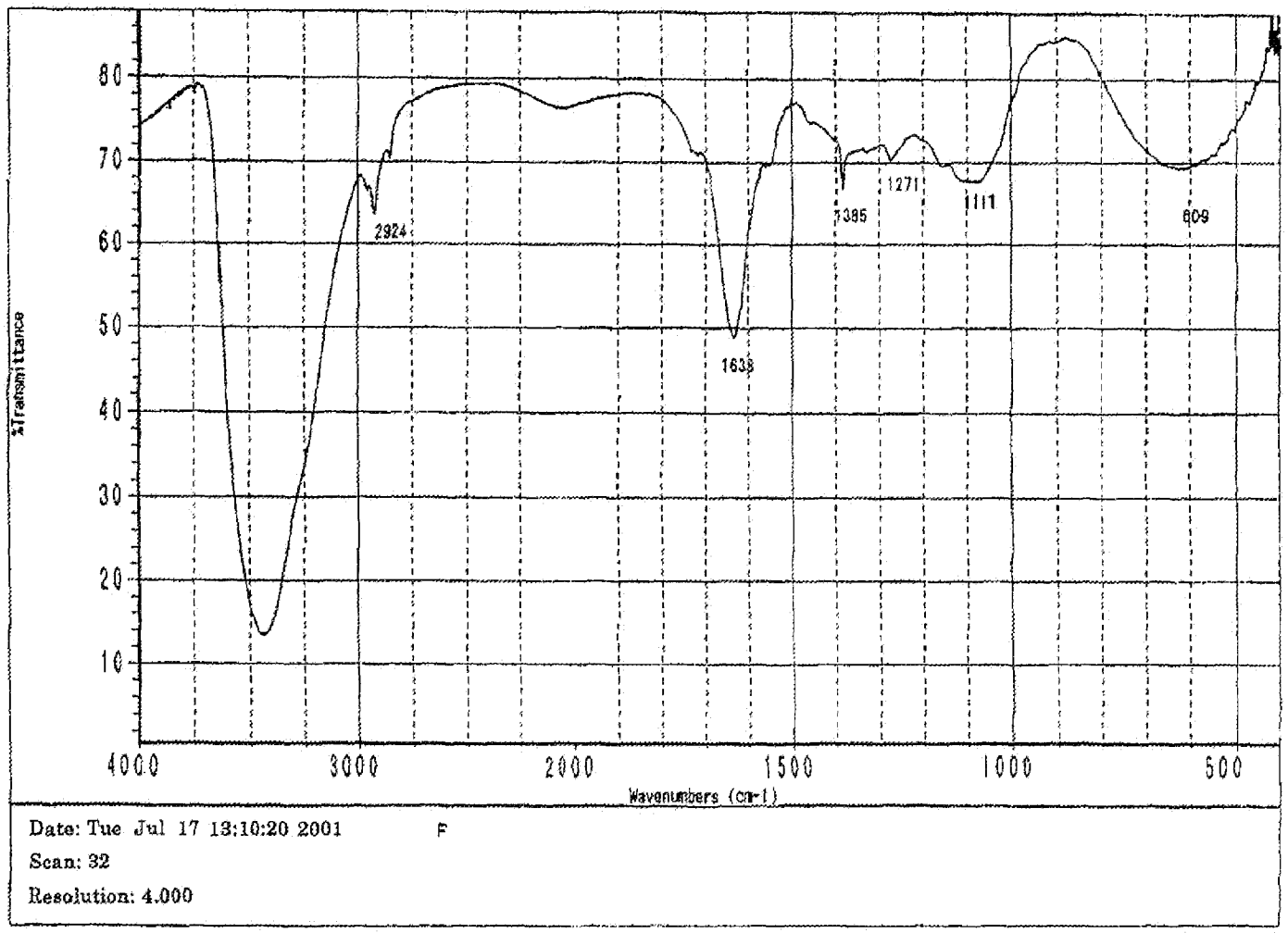
FIG. 13 is an IR measurement chart showing a further example of the UDD of the present invention.

Shown in FIGS. 11, 12, and 13 are the result of measurements of three UDD samples, similar to Example 1, on the FTIR spectrum for KBr crystal synthesized from the BD materials at $\alpha$=64.9%, $\alpha$=74.4%, and $\alpha$=75.6% denoted in Table 3. In case of the UDD sample which were not sufficiently purified, there are detected an absorption pertinent to carbonyl group which is widely biased throughout a range of 1730 to 1790 $cm^{-1}$ by influences of many other groups existing on the Sample surface, and absorptions of at 1640 $cm^{-1}$ and 3400 $cm^{-1}$ pertinent to hydroxy group which were shifted forward and backward by influences of many other groups existing the surface, as shown in FIGS. 11, 12, and 13. The absorption at 1640 $cm^{-1}$ is affected by bonded water and water releasing. An absorption at 1750 $cm^{-1}$ concerns with vibration of OH group. An absorption at a wider range of 1100 to 1140 $cm^{-1}$ is composed one of absorption by impurity nitro group and absorption by ≡C—O—C≡ group. As said absorption is high, it may positively be explained that not only nitro group (generally at 1540 $cm^{-1}$ and 1330 $cm^{-1}$), but also group are existence. It is high possibility that in an absorption at a range of 1730 to 1790 $cm^{-1}$ pertinent to carbony group, there are contained an absorption essentially positioned around 1750 $cm^{-1}$ pertinent to R—COO$\phi$, an absorption essentially positioned around 1740 $cm^{-1}$ pertinent to —RCOOR'(ester or lactone) and —RCOOH (carbonic acid), and an absorption essentially positioned around 1710 $cm^{-1}$ pertinent to ═C═O group. Also, an absorption of a group —CON at 680 $cm^{-1}$ may also be included.

As apparent from above mentioned results, the intensity and the location of the absorptions of the carbonyl group on the UDD of the present invention largely depend on the purifying conditions of the UDD. When heated to 700° C. under an atmosphere of nitrogen gas, both the carbonyl group and the carboxyl group were decomposed thus declining the physical strength of corresponding regions thereof. As the UDD has been heated to 673 degree K, an absorption thereof was shifted from 1730 $cm^{-1}$ to a position of 1780 to 1790 $cm^{-1}$, thus this implies the building up of O═C—O—C═O structure.

As a conclusion, the UDD of the present invention after purified with nitric acid, its absorptions are shifted from the locations and to next locations and patterns as denoted below in Table 5.

TABLE 5

| IR-spectrum of UDD | |
|---|---|
| 3500 $cm^{-1}$ | An intensive wide band |
| 1740 $cm^{-1}$ | A band of mean intensity |
| 1640 $cm^{-1}$ | A band of mean intensity |
| 1260 $cm^{-1}$ | An intensive wide band |
| 1170 $cm^{-1}$ | An intensive wide band |
| 610 $cm^{-1}$ | A wide band of mean intensity |

In these absorptions, an absorption band around 3500 $cm^{-1}$ is the highest one. Absorption band around 1740 $cm^{-1}$ is smaller than the absorption band around 1640 $cm^{-1}$, and consists of a plural of gathered absorption bands, and its profile is complex and flat at the top. The absorption band around 1640 $cm^{-1}$ is second highest absorption. The band around 1170 $cm^{-1}$ is third highest absorption and its profile has at least two small peaks at longer wavelength side and at least two shoulders moderately sloping down. The absorption band at about 610 $cm^{-1}$ is complex and wide one in the profile and medium in the absorption level.

Further, the UDD of the present invention has small peaks or at least shoulders at 2940 $cm^{-1}$ (pertinent to C—H saturation), 1505 $cm^{-1}$, 1390 $cm^{-1}$, and 650 $cm^{-1}$.

Figure 14:
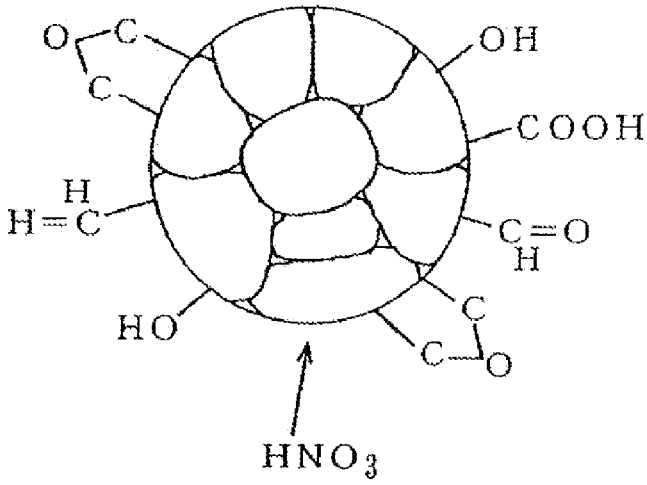
FIG. 14 is an enlarged schematic view of a particle of the UDD of the present invention.

As apparent from the result, the UDD of the present invention, as shown in FIG. 14, is covered with many active functional groups such as —COOH, —C—O—C—, —CHO, and —OH and the like groups.

Example 5

Samples of No. 8 to No. 19 were prepared by the same manner as of Example 1, however, these samples were different in the degree of oxidization from those of Example 1, therefore their surface properties about the oxidative decomposition and the oxidative etching were also different as shown in Table 6, including Sample 8 ($\alpha$=0.0%), Sample 9 ($\alpha$=17%), Sample 10 ($\alpha$=28%), Sample 11 ($\alpha$=32%), Sample 12 ($\alpha$=48%), Sample 13 ($\alpha$=49%), Sample 14 ($\alpha$=56%), Sample 15 ($\alpha$=63%), Sample 16 ($\alpha$=81% as Comparison 4), Sample 17 ($\alpha$=85% as Comparison 5), Sample 18 ($\alpha$=94% as Comparison 6), and Sample 19 ($\alpha$=98% as Comparison 7). Then, their surface characteristics in connection with the degrees of oxidative decomposition and oxidative etching were measured, Results were shown in Table 6.

TABLE 6

| No. of sample | Fraction of total mass of oxidizable carbon (%) | Degree of oxidative decomposition (α) | Specific surface ($10^3 \times m^2/kg$) | Limit volume of sorption space ($m^3/kg$) | Size of space ($10^{-9}$ m) | Size of critical pores ($10^{-9}$ m) |
|---|---|---|---|---|---|---|
| No. 8 | 53.4 (DB) | 0 | 404 | 1.2451 | 9.1 | 8.8 |
| No. 9 | 44.4 | 0.17 | 409 | 1.0746 | 8.1 | 8.0 |
| No. 10 | 38.4 | 0.28 | 399 | 0.9931 | 7.7 | 7.9 |
| No. 11 | 36.3 | 0.32 | 314 | 0.7488 | 7.5 | 7.6 |
| No. 12 | 27.8 | 0.48 | 244 | 0.6621 | 8.6 | 6.8 |
| No. 13 | 27.6 | 0.49 | 209 | 0.5406 | 8.7 | 8.8 |
| No. 14 | 23.7 | 0.56 | 198 | 0.5236 | 9.1 | 9.1 |
| No. 15 | 19.5 | 0.63 | 195 | 0.5089 | 9.5 | 9.3 |
| No. 16 (Comparative 4) | 9.9 | 0.81 | 240 | — | — | — |
| No. 17 (Comparative 5) | 7.9 | 0.85 | 252 | — | — | — |
| No. 18 (Comparative 6) | 20 3.4 | 0.94 | 276 | 0.8241 | 9.8 | 9.6 |
| No. 19 (Comparative 7) | 21 1.2 | 0.98 | 290 | 0.8396 | 9.2 | 9.2 |

1) Limit volume of sorption space ($m^3/kg$) is presented by (p/Ps) = 0.995 (Where p is degree of filled up surface of inner pores by $N_2$, Ps is limit pressure of $N_2$ gas to create mono layer of Nitrogen.)
2) Size of critical pores is the maximum size of pores by which atoms of adsorbing gas are able to pass into adsorbent (UDD).

It is apparent from Table 6 that the absorptivity of the UDD substantially do not necessarily depend on the pore size and the limit pore size, but depend on the activity ratio and the magnitude of activated surface area in all of the UDD surface.

Hitherto, there were reported studied about the activity of UDD, including one which was depicted in GP. Bogatiryonva, M. N. Voloshin, M. A. Mirinich, V. G. Malogolovets, V. L. Gvyazdovskaya, V. S. Gavrilova, Sverhtvjordii Materiali, No. 6, pp. 42 (1999), "Surface and electro-physical properties of dynamic synthesis nano-diamond". For just purposes of comparison and reference, it is shown in Table 7.

TABLE 7

| Sample | Unburnt residuum (%) | Specific magnetic susceptibility (X) ($m^3/kg$) | Specific surface (S sp) ($10^2 \times m^2/kg$) | Adsorption potential (A) ($10^3$ J/kg) | Specific adsorption potential (A') ($J/m^2$) |
|---|---|---|---|---|---|
| UDD a (Comparative Example 8) | 0.75 | $\sim 0.35 \cdot 10^{-8}$ | 167 | 400 | 2.4 |
| UDD b (Comparative Example 9) | 1.16 | 0 | 162 | 550 | 3.4 |

1) Susceptibility (X) were determined by the technique of V. N. Bakul Institute of superhard materials.
2) Specific surface (S sp), adsorption potential (A) and specific adsorption potential (A') were isotherms of low temperature adsorption of nitrogen gas by mean of the instrument "Akusorb-2100" and calculated therefrom.

It is proved from the technical knowledge relating to adsorption and desorption of nitrogen gas measured by PET shown in Tables 6 and 7 that the UDD Samples of the present invention having an oxidation degree a lower than 81% were sufficiently developed in the activity and greater in the specific surface area, $4.5 \times 10^5$ $m^2/kg$ at the maximum, and in the surface area carbon content ($C_{surface}/C_{total}$), and), in comparison with conventional samples (Comparison Examples 8 and 9). The density of the functional groups in $C_{surface}$ was as high as 100%. In general, the rate of carbon atoms bonded to hetero atoms in the total number of carbon atoms of the conventional synthetic diamonds was as low as 15%.

Example 6

Also, samples of the UDD of the present invention were subjected to thermal differential analysis in atmospheres of air and inert gas. Result is shown as follow.

Namely, in case of heated at a heating speed of 10 degree K per minute in the air, every sample started oxidization at 703 degree K. On the other hand by literature, in case of three different samples synthesized by the conventional static conversion, starting temperatures of oxidizations were 863 degree K, 843 degree K, and 823 degree K, respectively. Accordingly, the UDD of the present invention has higher activity for oxidizing.

When heated to 1273 degree K under a neutral atmosphere, one of the samples of the present invention exhibited a weight loss of 3 to 4%. The same sample, when heated at a proper speed from 443 degree K to 753 degree K under carbon dioxide gas, increased its weight by 5% and when heated to a higher temperature, its weight was declined. This sample, when heated under an atmosphere of hydrogen gas, caused separation of HCN gas. The same UDD sample was then composite thermal differential analyzed.

The result of the analysis was denoted in the form of a thermograph curve having the three features (a) to (c) below.

(a) The weight loss was 5 to 7% when heated at 373 to 383 degree K (of two samples at α=63% and α=27%). This was reversible. As the resultant gas product was measured at the same temperature, it contained 97 to 98% of nitrogen gas. It may be concluded that the gas is one absorbed and separated from the air.

(b) The UDD sample was declined in the weight at 523 degree K, with heat absorption.

(c) The weight loss was detected at a range from 753 degree K to 1023 degree K, with heat generation. Particularly, the weight loss was large (up to 95%) at 753 to 773 degree K, with large amount of heat generation, and this was lasted until the temperature reached to the range of 1023 to 1053 degree K, and thereafter, any more no change was shown at higher temperatures than before. Non-combustible residue was then measured by a known manner and its amount was corresponding to 10% of the initial weight of the Sample. It was considered that in the temperature range of 773 degree K to 1023 degree K, strong oxidization of carbon was carried out, and finally, non-combustible residue was remained. During the oxidization, intensive grows were detected.

Example 7

Then, Samples 11, 13, and 14 were heated at a heating speed of 10 degree K per minute under a carbon dioxide atmosphere until the temperature reaches 1273 degree K. Then, their weight and specific surface area were examined for increase or decrease, similar to Example 5. The weight measurements exhibited no particular increase or decrease (more specifically, Sample 11 was decreased by 0.25%, Sample 12 increased by 0.22%, Sample 13 decreased by 0.15%, and Sample 14 increased by 0.22%). The specific surface area of each sample also remained substantially unchanged. This may be explained by the condensates of carbon atoms in the pores were remained in stable non-graphite form, and the hydrophilic groups as electron donors, such as hydroxy, carboxy, carbonyl, or aldehyde were remained, not eliminated by heating.

Example 8

Figure 20:
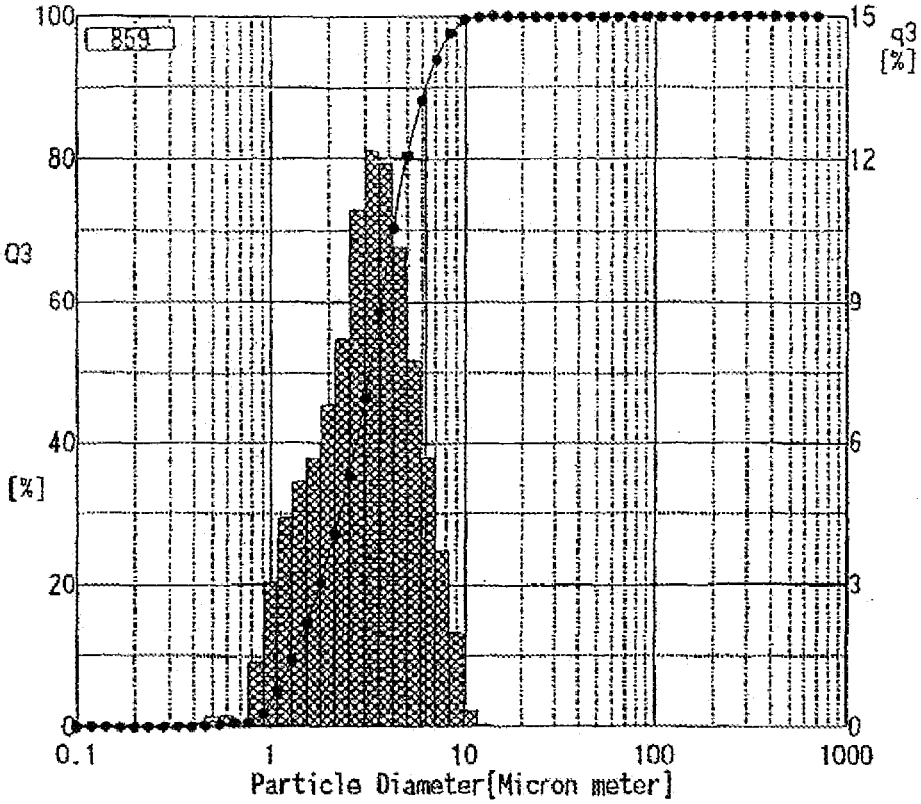
FIG. 20 is a graphic diagram showing a profile of particle sizes of an imperfectly oxidized crude diamond powder synthesized by conventional shock conversion.
Figure 21:
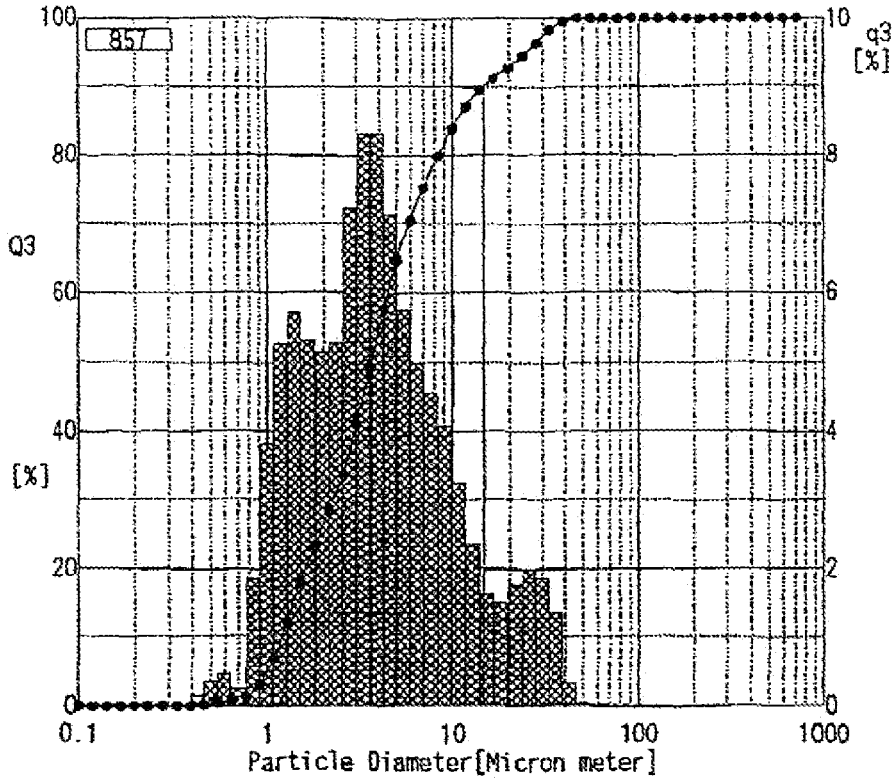
FIG. 21 is a graphic diagram showing a profile of particle sizes of a conventional UDD powder.

Seven samples were examined for determining profile of particle sizes, including Sample 13 of Example 5 (at $\alpha$=49% denoted as Sample AS in FIG. 15), Sample 14 of Example 5 (at $\alpha$=56% as Sample BS in FIG. 16), Sample 4 of Example 1 (at $\alpha$=55% as Sample CS in FIG. 17), Sample 5 of Example 1 (at $\alpha$=64.9% as Sample DS in FIG. 18), Sample 6 of Example 1 (at $\alpha$=74.4% as Sample ES in FIG. 19), Sample 8 of Example 5 (at $\alpha$=0% as Sample FS in FIG. 20), and a conventional UDD sample (in dry powder as Sample GS in FIG. 21).

Figure 15:
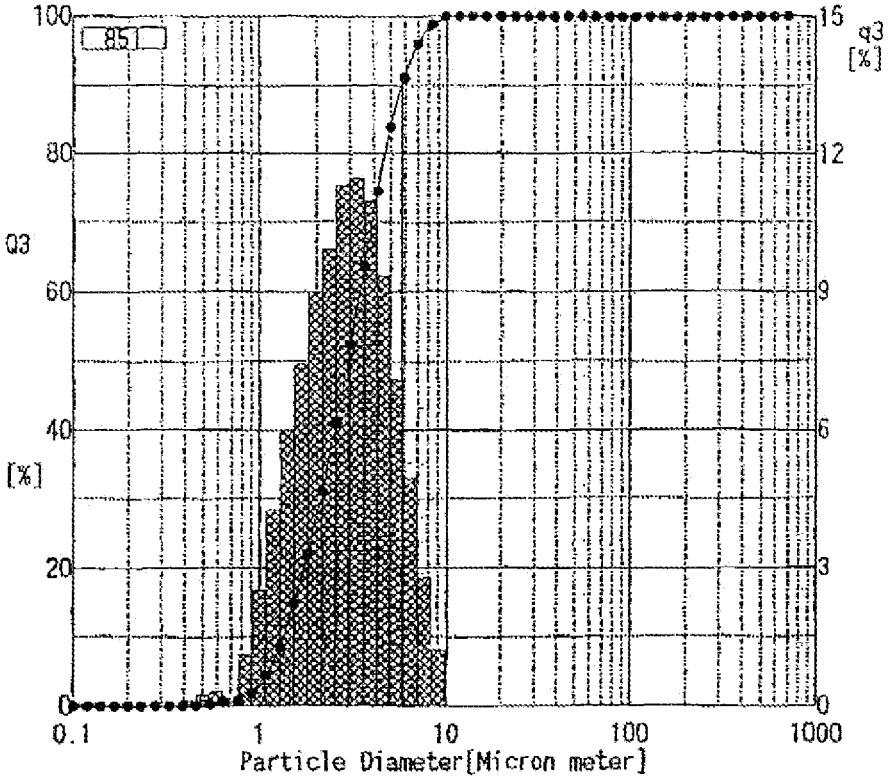
FIG. 15 is a graphic diagram showing a profile of particle sizes of an example of the UDD powder of the present invention.
Figure 16:
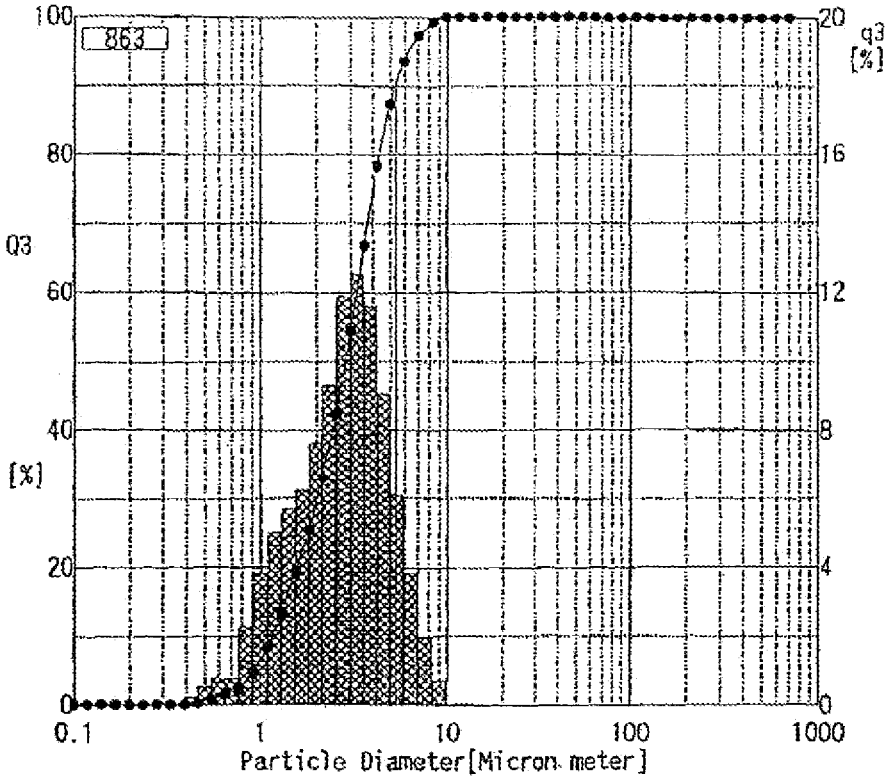
FIG. 16 is a graphic diagram showing a profile of particle sizes of another example of the UDD powder of the present invention.
Figure 17:
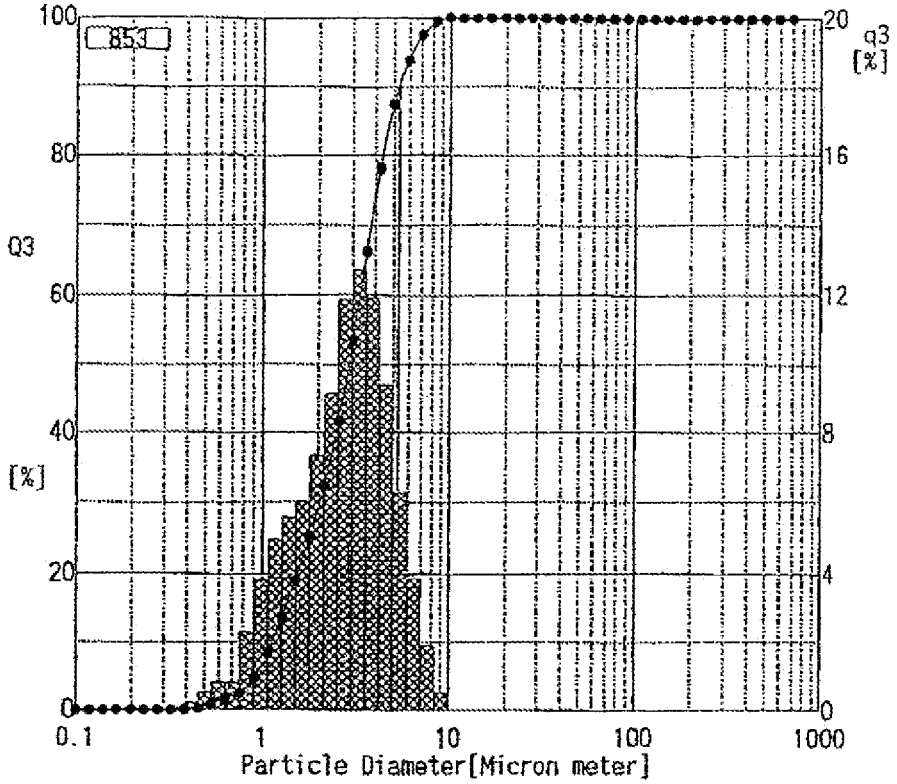
FIG. 17 is a graphic diagram showing a profile of particle sizes of a further example of the UDD powder of the present invention.
Figure 18:
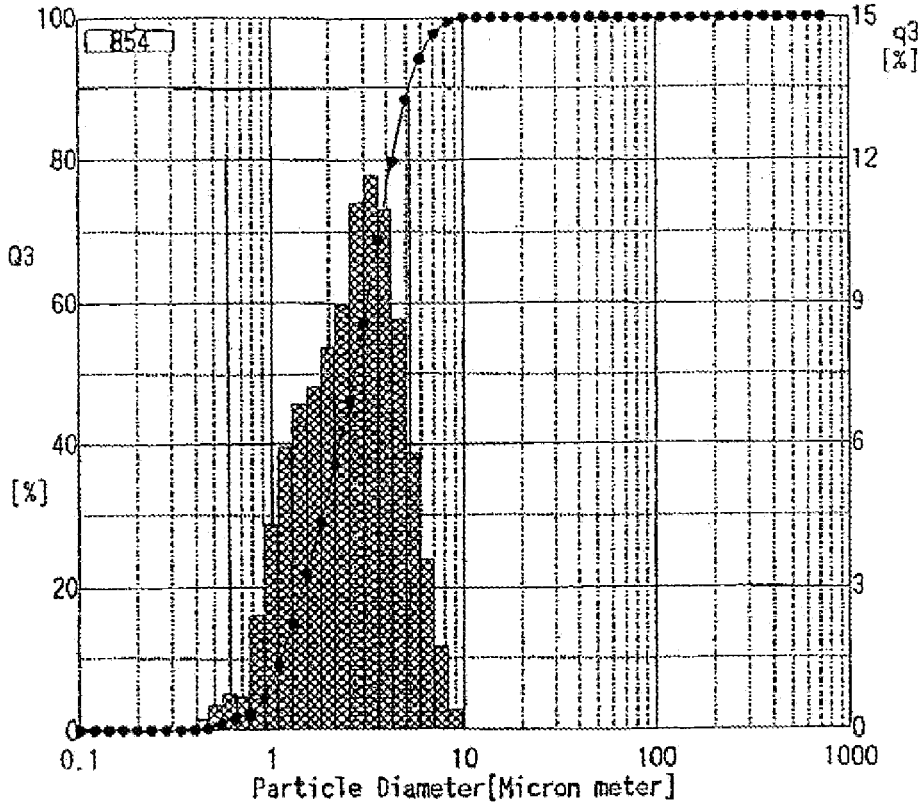
FIG. 18 is a graphic diagram showing a profile of particle sizes of a still further example of the UDD powder of the present invention.
Figure 19:
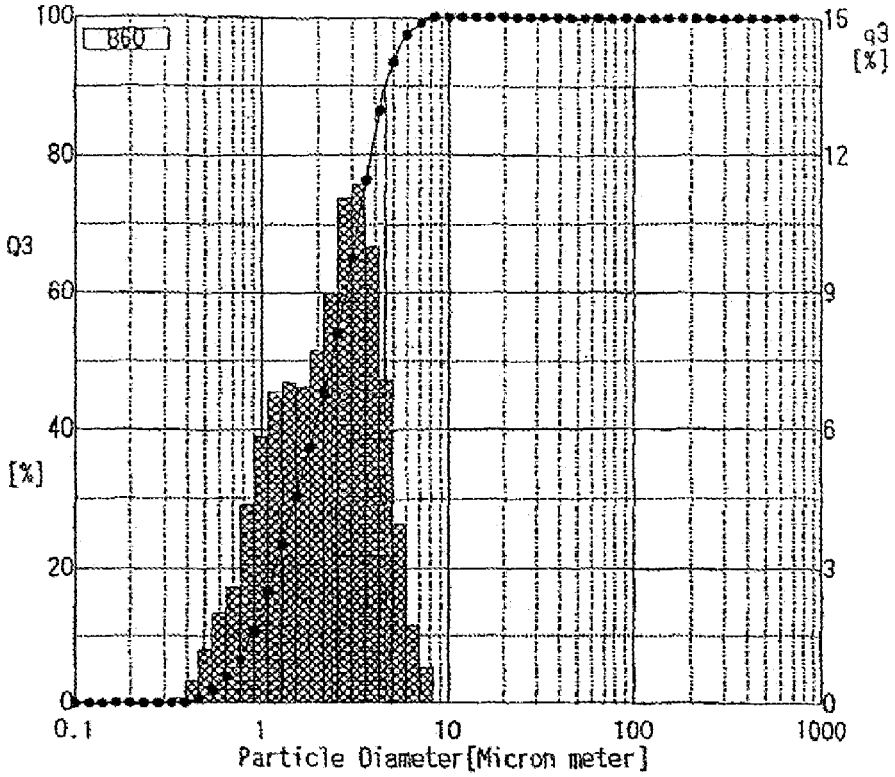
FIG. 19 is a graphic diagram showing a profile of particle sizes of a still further example of the UDD powder of the present invention.

The resultant profiles of Samples AS to GS were shown in FIG. 15 (Sample AS), FIG. 16 (Sample BS), FIG. 17 (Sample CS), FIG. 18 (Sample DS), FIG. 19 (Sample ES), FIG. 20 (Sample FS), and FIG. 21 (Sample GS).

It was found from the result that while the conventional UDD sample (Sample GS) and the non-oxidized UDD powder (Sample FS) containing large particles of 1000 nm or greater in the diameter and widely varying in the particle size, samples of the present invention (Samples AS, BS, CS, DS, and ES) were smaller range by diameter distribution and containing no large particles of 1000 nm or greater diameter.

Example 9

On the other hand, wet UDD of the present invention lost humid substantially, when heated to a temperature in the range of 403 to 433 degree K. At higher temperature than that of before, the parameter change was similar to that of the dried samples. In case of heated to 383 to 393 degree K under an inert gas (He) atmosphere, the wet UDD started releasing nitrogen which was absorbed from and desorbed to the air, reversibly. At a range from 673 degree K to 1173 degree K, the weight was lost by about 10%, with heat generation. Thereafter, carbon dioxide and nitrogen were released (ratio thereof were 4:1 by molar), accompanying with morphology changes of the UDD. At a temperature in the range of 1153 degree K to 1163 degree K, any more no change was detected, while very slight heat absorption was susceptible. This process was conducted without any change in the structure and color of the UDD. On the other hand, by data provided from prior arts, the functional groups are eliminated from the surface at the range of said temperature during annealing procedure conducted under the inert gas atmosphere.

Example 10

The volumetric examination of structural defects in the UDD of the present invention was conducted.

With regard to all crystal states which were considered as diamond structures in the wide meaning depend upon aforementioned IR analysis denoted in Example 4, volumetric ratio of structural defects was examined by positron-electron annihilation method.

The UDD samples were prepared by shock conversion processes in water from TNT/RDT alloys containing 5 to 70% by weight of highly dispersible RDX.

For purposes of determining concentration, volume, and dispersion state of structural defects of the UDD samples in the sintering processes, changes were made in the carbon/hydrogen ratio in the explosive, the diameter of imposed shock wave (at a higher pressure and a higher temperature), and the harden level. After chemical purification, the crystal structure of obtained UDD was measured by the positron-electron annihilation method to determine the volumetric ratio of the structural defects. And specific area of the UDD was measured by absorption of nitrogen at low temperature.

Also, for the purpose of studying the sintering process of the UDD having the volume ((3.05 to 3.10)$\times 10^3$ kg/m$^3$) of maximum density of the structural defects, selections were made with an average diameter ((1.5 to 2.0)$\times 10^{-9}$ m) of the UDD by a coherent dispersion technique, and with maximum dispersibility (specific surface area of $4.2\times 10^5$ m$^2$/kg) of the UDD. The UDD powder was sintered under 4 to 12 GPa, and resultant poly-crystalline powder condensate was measured to study the micro hardness and the compression fracture strength.

Then, the densities of vacancy defects of cluster and the density of pores in the UDD were studied.

In the detonation of a carbon-contained explosive, the densities of vacancy defects of cluster and pores were increase in proportion with the increase of carbon content and increase detonating temperature, and there were peak points in curve lines showing the maximum density of vacancy defects of cluster and the maximum pores, after passing through the peak points, the density of vacancy defects of cluster and density of pores were began to decrease. The peak was at substantially 3900 degree K degree, and concentration of sub-micro pores having diameter of (1 to 2)$\times 10^{-9}$ m was increased to the maximum. The trap centers for trapping the electrons to disappear were total defects. Every defect was eventually core of a sub-micro pore. Such site of positronium in the UDD was not located in the inside of diamond but formed in the inner surface of sub-micro pore and thus was constituted by the defect.

When the volume of the sub-micro pores in the UDD prepared from TNT was decreased and the structural defects were decreased (to the density $3.3\times 10^3$ kg/m$^3$), the quality of the UDD approached to similar to that of static conversion synthesized diamonds. IR spectra of conventional UDD powder sample told this nature.

The generation of the structural defects in the UDD of the present invention may thus be explained by the following hypothesis (which is shown for only the purpose of description and not intended to limit the present invention).

Namely, the formation process by detonation of carbon-containing explosive can be represented as the results of unbalanced phase transitions, involving: (1) by cabon-contaning explosive, occurring of a primary plasma-like dense state which is characterized by a high density of ions, free electrons, excited particles, the simplest radicals et al.; (2) occurring a plasma-like dense state, a state of primary small carbon clusters containing hydrogen; (3) occurring a state of primary cluster, a ultradispersed diamonds phase. All of the transitions produced within $10^{-8}$ to $10^{-9}$ second, just when an electronic subsystem of particles is excited, that creates additional conditions for ultra high-speed formation of diamond phase according to new mechanisms. Then, both in the zone of chemical transformation of explosives and outside it, in the zone of high pressure and temperature, there are slower diffusion processes of coalescence, recystallization and growing of cores of diamond phase, splitting out and diffusion of hydrogen, formation of vacancies, their accumulation to vacancy clusters and submicropores. This is a slow-speed stage closing formation of crystalline structure of UDD, it proceeds for $10^{-6}$ second and more being interrupted by hardening of the powder.

Example 11

The magnetic properties of UDD samples of the present invention were compared with those of conventional diamonds synthesized by static conversion.

In general, diamonds are diamagnetic having a constant value of magnetic susceptibility ($\chi$) of $\chi=-0.62\times10^{-8}$ $m^3/kg$. However, the UDD of the present invention has a different magnetic susceptibility value from above general value. Specific magnetic susceptibility of a powder material is a quantity characteristic properties of all volume of a powder and is defined at the expense of additive addition of specific magnetic susceptibilities ($\chi_i$) of all components in a powder with due regard for their concrete content. In Table 8 below, the magnetic susceptibilities of impurities in the UDD Samples of the present invention are shown.

TABLE 8

Magnetic susceptibility of impurities in UDD

| Component name | UDD Samples | Static synthesis Diamond | Approximate value of magnetic susceptibility ($\chi_i$) ($\chi_i = \times10^{-8}$ $m^3/kg$) |
|---|---|---|---|
| Diamond | + | + | −(0.1~0.5) |
| Metal | Traces | + | $10^3$~$10^4$ |
| Graphite | + | + | −(8.2~0.1) |
| Carbon materials | + | | −(2.0~0.1) |
| Gelatine | | + | −(0.5~0.9) |
| Silicon | + | + | |

According to the present invention, conductivity of the UDD was minimum for the Samples warmed up at 573 degree K degree in carbon dioxide atmosphere and had the value of about $10^{12}$ Ω·m. The subsequent warm up in carbon dioxide atmosphere increased the conductivity changed to in the range of $6.0\times10^{10}$ to $2.0\times10^{11}$ Ω·m. The electrical conductivity may drop down to $2.3\times10^4$ Ω·m when heated up to 1173 degree K which is a threshold level prior to turning to a graphite form.

The dielectric constant or permeability of the UDD sample was 2.4 to 2.7 at $E_{0.1}$, 1.7 to 2.0 at $E_{1.0}$, and 1.7 to 2.0 at $E_{1.5}$, while the high-frequency dielectric loss (tan δ) was ranged of about $0.5\times10^{-3}$ to $1.0\times10^{-2}$.

As shown, the UDD of the present invention has a number of properties differing them from well known various synthetic diamonds, and in spite of its higher reactivity, a diamond-like phase of carbon is stable in physico-chemical parameters in neutral and reducing atmosphere up to 1273 degree K.

The specific resistance of the UDD of the present invention formed in compact tablets which was in the range of $10^6$ Ω·m to $10^7$ Ω·m at the room temperature and when humidifying this value were sharply decreases, thus content was as small as 5% moisture, and this specific resistance was than $10^3$ Ω·m. When subsequent increasing of moisture content, the specific resistance did not change. Accordingly, it seems to be defined by absorbed water quantity. Also, the water content 5% may be a reference level for determining a method of measuring the content of remaining water in the UDD.

There is one of the important properties of the diamond surface, that is an electrokinetic potential or an interface potential K potential or zeta potential) value. Taking into account that potential value considerably depends on a condition of nanodiamond surface, the differences in both the potential values for different UDD fractions of the same quality, and especially for UDD of different purification and modification ways should be expected.

Determination of potential values of UDD can be carried out by electrophoretic method based on directed movement of particles of dispersed medium relative to liquid phase under current effect, as disclosed in S. I. Chuhaeva et al. (S. I. Chuhaeva, P. Ya. Detkov, A. P. Tkachenko, A. D. Toropov, "Physical chemistry properties of fractions isolated from ultra-dispersed diamonds (nano-diamonds)", and Sverhtvjordii Materiali, Vol. 42, pp. 29 (1998) in which, the zeta potential was measured from three separated layers, a precipitated layer, an intermediate layer, and a suspension layer, of a concentrated UDD suspension synthesized by Russian Federal Nuclear Center, showing potentials of $+16\times10^{-3}$ V at the precipitation, $+32\times10^{-3}$ V at the intermediate layer, and $+39\times10^{-3}$ Vat the suspension layer. And, study of IR-spectra of isolated fractions shows that in the specimens there are practically ones and the same functional groups, however, the fractions are differed in their content.

There are reported studies by V. L. Kuznetsov, A. L. Chuvilin, Yu. V. Butenkov, I. Yu. Malkov, A. K. Gutakovskii, S. V. Stankus, R. Kharulin, Mat. Res. Soc. Symp. Proc. 396, pp. 105 (1995), for three of precipitated layer, intermediate layer, and suspension layer, as below, shown in Table 9.

TABLE 9

Basic physical-chemical characteristics of isolated UDD-fractions

| Characteristic | Values for fractions 1 (precipitated) | 2 (intermediate) | 3 (suspended) |
|---|---|---|---|
| 1. Appearance | Light-grey scattering powder | Grey powder | Black filiform crystal-like formations |
| 2. Pycnometric density ($10^3$ $kg/m^3$) | 3.3 | 3.2 | 3.1 |
| 3. Unburnt residuum (wt. %) | 1.6 | 1.3 | 0.9 |
| 4. Oxidizable carbon (wt. %) | 1.0 | 1.5 | 1.9 |
| 5. Viscosity of aqueous suspension with concentration of UDD of 10 $kg/m^3$ at 293° K (mPa sec) | 1.04 | 1.07 | 1.12 |

TABLE 9-continued

Basic physical-chemical characteristics of isolated UDD-fractions

| Characteristic | Values for fractions 1 (precipitated) | 2 (intermediate) | 3 (suspended) |
|---|---|---|---|
| 6. Viscosity of aqueous suspension with concentration of UDD of 60 kg/m$^3$ at 293° K (mPa sec) | 1.32 | 1.63 | 5.15 |
| 7. Electrokinetic potential ($10^{-3}$ V) | +16 | +32 | +39 |

Hitherto, it is known that three fractional suspensions from layer-separation is different one other in characteristics and the difference is caused by different velocities based on compositions and diameters of UDD particles, influences of functional surface groups of the particles to the characteristics of UDD are not known exactly.

Example 12

In the present invention, Samples of the UDD suspension of the present invention were measured by three times at temperatures in the range of 297 to 298 degree K after they were purified by ions exchange resin. The measurements of the zeta potential given the data of (32 to 34)×$10^{-3}$ V. For comparison, measurement of potential value of UDD suspension by conventional preparation method (not divided into three fractions) prepared by conventional given data of (25 to 26)×$10^{-3}$ V.

Conventional procedures of fraction separation based on simple stirring of nanodiamonds in the chosen liquid and precipitation by composition and particle sizes from suspensions by gravity for highly dispersed UDD are not suitable. On the other hand, in the present invention as best case, decantation of very fine fractions will take place. The fine fractions are easily aggregated when drying, and the dried aggregates containing very fine particles are in same cases difficult to break not into original very fine particles. Diameter of aggregates from the UDD suspension in the present invention was minimum 3×$10^{-7}$ m.

Also, the nano-diamonds has a higher level of organic solvent-absorptivity, therefore the use of organic solvent is not favorable. On the other hand, when the present invention, when dried powder in the present invention is again made into the suspension form using ultrasonic dispersing technique, the obtained suspension remains unchanged in the dispersibility for over one month in its storage condition.

Samples of various qualities UDD compositions of the present invention have a typical set of functional groups provided therein. Such typical set of functional groups remains constantly until the diamond structure itself is broken up. The set comprises polar functional groups such as —OH, —NH, —C═O, —C—H, or —C═N. In particular, —C═O and —OH may serve as fundamental parameters for determining the aggregation of UDD particles in the suspension liquid. It is found from the IR analysis of fractions in the UDD samples that the samples have a number of functional groups which are different in the proportion of the functional groups.

The stabilization of the UDD suspension of the present invention by surfactant is not inevitable essential, except use of short-chain surfactants having ωω' type two-end di-cationic groups. In practice, the UDD particles in the suspension are surrounded by the molecules of the surface-active agent. This causes the tail or in other words hydrophobic portion (a long-chain alicyclic group) of the surfactant to face to be exposed to an aqueous medium. As a result, the UDD particles will be water repellent thus declining the dispersion stability.

Example 13

The UDD particles of the present invention were examined for the compatibility with different dispersant agents. The compatibility and thus the dispersion stability of the UDD particles is increased by the order of acetone<benzene<isopropanol<water. It is apparently essential for improving the dispersibility of the UDD particles to determine the polarity of the dispersant as well as the preparation of a n-composite between the dispersant and the UDD particles which can contribute to the compatibility and the dispersion stability at the surface of the UDD clusters. The UDD suspension using a non-polar organic solvent is most favorable in view of the practical use. Providing that such a nano-diamond dispersed suspension liquid is feasible, the development of elastomer based clusters is initiated. This can be implemented by a technique of changing the surface of the UDD particles from hydrophilic property to hydrophobic property. For the purpose, the present invention permits a dry powder of nano-diamond to be dispersed in a benzene solution which contains an elastomer consisting mainly of poly-dimethyl silane and poly-isoprene. More specifically, the suspension of the present invention is stabilized by its diamond cluster absorbed at the surface with polymer hydrophobic chains. As a result, it is proved that the dispersibility of the UDD in the organic solvent is improved. It is then found that the optimum modifier for use on the UDD surface is a polymer of diene material such as poly-isoprene. Hence, a method of modifying the UDD surface and a method of optimizing the suspension liquid can successfully be developed. As the UDD cluster surface is modified by the action of poly-isoprene or the like, the UDD suspension can include large particles having a maximum diameter of about 300 nm. The stability of the suspension liquid for inhibiting the deposition lasts as long as ten days.

Example 14

The UDD of the present invention is then examined for shift from the diamond phase to the graphite phase. The phase shift is triggered when the UDD is heated in an inert medium at a temperature of 720 to 1400 degree K. For identifying the phase shift, a Raman scattering (RS) method and an X-ray diffraction method are used in a combination. It is concluded from the result of the RS scattering and the X-ray diffraction that the UDD is a clustered substance having a diamond crystal structure pertinent to nano-diamonds of about 4.3×$10^{-9}$ m in size.

In most cases, the UDD nano-clusters stay in a small range of the diameter from 4×$10^{-9}$ m 5×$10^{-9}$ m. It is accordingly understood that the nano-size crystal is more thermally stable in a diamond form than in a graphite form. This is supported by a report of M. Gamarnik, Phys. Rev. Vol. 54, pp. 2150 (1996).

A profile in the RS spectrum which corresponds to the maximum function of the lattice oscillator density of diamond and graphite represents the presence of small amounts of amorphous diamond and graphite in a sample.

As depicted in G. V. Sakovich, V. D. Gubarevich, F. Z. Badaev, P. M. Brilyakov, O. A. Besedina, Proceeding of Science of USSR, Vol. 310, No. 402 (1990), "Aggregation of diamonds obtained from explosives", the UDD cluster or any other ultra-dispersed substance is a single aggregate and its amorphous phase possibly incorporates an aggregate on the surface of its diamond core.

It is confirmed from the X-ray diffraction data of the present invention that the amorphous phase with a particle size of about $1.5\times10^{-9}$ m is present. As the peak at 1322 $cm^{-1}$ remains unchanged on the RS spectrum when the annealing temperature $T_{ann}$ is 1000 degree K, it is true that the structure of diamond is not varied by the annealing temperature. This is also confirmed by the result of the X-ray diffraction analysis which holds the graphite phase when $T_{ann}$>1200 degree K. The phase shift from the diamond phase to the graphite phase is commenced from the cluster surface during the annealing under the inert atmosphere. It is also confirmed from the result of the X-ray diffraction that the graphite phase is a set of equally spaced graphite nano-plates having a size of not greater than $4\times10^{-9}$ m and that the graphite is substantially created by consumption of the diamond core at $T_{ann}$>1200 degree K.

As depicted in L. Kuznetsov, A. L. Chuvilin, Yu. V. Butenkov, L. Yu. Malkov, A. K. Gutakovskii, S. V. Stankus, R. Kharulin, Mat. Res. Soc. Symp. Proc., 396, pp. 105 (1995), measurements of the initial phase shift temperature $T_{pt}$ correspond to data of an electron microscope. According to the present invention, the nano-crystalline diamond core having a bulb-like shape of carbon is declined in the size at T>1300 degree K. As the RS spectrum exhibits a particular shape at 1575 $cm^{-1}$ which represents T=1400 degree K, the report by V. L. Kuznetsov et al is found correct where 1400 degree K is the temperature when the bulb-like shape of carbon is developed.

According to the present invention, the shift from the diamond phase to the graphite phase is started at $T_{ann}$>1900 degree K which is lower than the temperature for triggering the volumetric mono-crystallization of diamond. It is reported in E. L. nagaev, Ussspehifizicheskoi nauki, No. 162, pp. 49 (1992) that the temperature for starting the phase shift or the melting point is low with metal clusters.

At $T_{ann}$>720 degree K, the regularization of $sp^2$ portions of the UDD is commenced while the graphite phase is developed on the diamond cluster core. The $sp^2$ regularized crystallization is created outside of the diamond crystal core as representing the conversion to $sp^2$ bonded amorphous carbon. This is expressed by the development of micro structures with diffusion patterns throughout small or medium angles of X-ray diffraction at $T_{ann}$>1300 degree K and an increase in the intensity at 1350 to 1600 $cm^{-1}$ of the RS spectrum.

The cluster of UDD particles comprises a relatively high-density, regular crystalline core and a soft, chemically breakable shell. The diamond core guarantees the fundamental properties of the UDD including the thermal stability, the chemical stability, the high thermal transmissivity, the high thermal diffusivity, the low electrical conductivity, the low X-ray diffraction, the quasi-wear resistance, and the quasi-hardness. The shell of the cluster contributes to the negative sign of the charge at the surface of the UDD particles, the absorptivity, the adsorptivity, the chemisorptivity, the chemical composition of each surface functional group, and the colloidal stability of the UDD particles in a liquid or medium. Unlike any conventional metal cluster which consists of chemically hetero elements at the core and ligand shell or a combination of metal atoms and complex forming ions, the UDD cluster is arranged of which the core and the shell both consist substantially of carbon atoms. This allows the diamond lattice structure to be converted via a polyhedron frame, a polycyclic structure, and a net structure to a non-diamond structure of shell form. The cluster boundary can be stabilized by a composite product between carbon atoms of the shell and a gas product from the detonation of an explosive, an air/oxidizer mixture, or an atmospheric substance such as a modifier. For the aggregation of diamond clusters, the shell plays a primary role to react with the matrix component of the explosive and the coating material. The two different components of carbon in the UDD particles are explained in T. M. Gubarevich, Yu. V. Kulagina, L. I. Poleva, Sverhtvjordii materali, No. 2, pp. 34 (1993), "Oxidation of ultra-dispersed diamonds in liquid media" as well as this description of the present invention. The result according to the present invention is similar to that of the above mentioned article.

As depicted in A. I. Lyamkin, E. A. Petrov, A. P. Ershov, G. V. Sakovich, A. M. Stayer, V. M. Titov, Proceeding of Academy of Science of USSR, No. 302, pp. 611 (1988), A. M. Stayer, N. V. Gubareva, A. I. Lyamkin, E. A. Petrov, Phisika Gorenniya Ivzriva, Vol. 20, No 5, pp. 100 (1984), Ultra-dispersed diamond powders obtained with the use of explosive, and N. V. Kozirev, P. M. Brilyakov, Sen Chel Su, M. A. Stein, Proceeding of Academy of Science of USSR, Vol. 314, No. 4, pp. 889 (1990), "Investigation of synthesis of ultra-dispersed diamonds by mean of tracer method, the structure of an aggregate product fabricated by shock conversion is developed by a primary step of generating a chemical reaction by the detonation of an explosive, and a two-period step of releasing of the reactive phase or the explosion product and permitting the reflection of shock waves to pass across the explosion product. In the N. V. Kozirev's report, the possibility is discussed of the secondary step for shifting diamond to graphite or from the crystal phase to the amorphous phase. Other than the structural conversion and the phase shift which largely affects the carbon frame in each particle, a reaction between the condensation and the gaseous substance in the detonation chamber takes place. Such chemical reactions may be varied depending on the temperature and the duration of impressing a shock wave determined by the life of the carbon condensate in the reactor.

Assuming that the aggregation of a diamond substance from the detonation product is carried out within a moment of some microseconds, the present invention may be bound to (1) that the primary detonation product of an explosive is hardly made uniform in a chemically reactive range and (2) that the separation between condensation components and molecular components in the detonation product is hardly completed in a desired length of time. This implies that a chemical marking for the diamond synthesizing process, which incorporates a molecular compound and a fragment of the aggregate structure for identifying the aggregating mechanism of free carbons in the explosive and the reconstructing mechanism of carbon atoms, is possibly stored in the aggregate of the detonation product.

The chemical marking is classified into four categories: (i) a frame, bridge, alicyclic carbon compound as a fragment of the diamond or diamond-like structure consisting of $sp^3$ carbons; (ii) a derivative of a homocyclic or polycyclic aromatic compound as a fragment of the graphite structure (an $sp^2$ hybrid orbital); (iii) a straight-chain or branched alicyclic compound as a fragment of the amorphous compound up to the boundary of a carbon cluster or a fragment of the indication of a carbyne (R—$CH_2$—) structure; and (iv) a —C—N or —C—O bond contained compound as a fragment of the carbon particle at the surface.

Example 15

For clarifying and analyzing the chemical marking, a thermally decomposed product and a decomposed product (so-called organolytic decomposed product) in a super-critical organic solvent of the non-diamond phase of the UDD or BD of the present invention are examined.

More specifically, a cool extracting process is conducted by a Soxhlet apparatus at a range of solid:liquid=1:10 for an extracting duration of (3.6 to 4.32)$\times 10^5$ seconds. When the extracting of liquid is maximum, the organolytic decomposing process is carried out at a super-critical state. A pressure of not smaller than 5 MPa is applied at 573 to 673 degree K in an autoclave of $4\times 10^{-4}$ $m^3$ in volume. Resultant extracts are subjected to low-temperature fluorescent spectrum analysis, gas-liquid chromatography analysis, chromatography-mass-spectrum analysis, IR spectrum analysis, and paramagnetic resonance spectrum analysis. For having different extracts, different types of the explosive mixture are provided including no-diamond contained reference samples. Depending on the synthesizing conditions, each explosive mixture produces different extracts which are bicyclic aromatic hydrocarbon and polycyclic aromatic hydrocarbon having one or more substituents. Also, various compounds including an $sp^2$ hybrid orbital or $sp^3$ hybrid orbital are obtained from the molecular product extracted at low temperature from the mixture. It is however understood that ultra-dispersed graphite or turbostrate (such as smectite or coal in a meso-phase where bonded atom layers are in parallel to each other, oriented in different directions, and/or placed one over another at random intervals) is more similar to any natural substance having such compounds than diamond. During the cool extracting process, the solid carbon matrix is not fractured but allows desorption/adsorption and washing out (extraction) of compound molecules dissoluble in $a_9$ organic solvent. It is hence concluded that the identified compound is a carbon compound in an intermediate state between the detonation product and the carbon aggregate. Then, the relationship between the poly-aromatic compound discharged into an extract in the mixture, the diamond phase completed structure, and their proportion is examined. As a result, 5% at maximum of a soluble substance is discharged from the detonation product containing no diamonds.

Example 16

The extracting process allowing partial decomposition of a solid substance is carried out at 200 to 400° C. under a boosting condition or a super-critical condition of the organic solvent. The maximum super-critical liquifying of carbon is conducted in pyridine which is one of the most active solvents. Table 10 illustrates the compositions thermally extracted using a relatively moderate solvent (hydrocarbon).

TABLE 10

Aromatic Polyheterocycles in high-temperature extracts from UDD and BD

| Structual formula of a compound | BD | | UDD | |
|---|---|---|---|---|
| | Solvents-extragents | | | |
| | Toluene | Benzene | Cyclohexane | Hydronaphtalene |
| 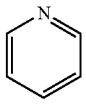 | + | | | |

TABLE 10-continued

Aromatic Polyheterocycles in high-temperature extracts from UDD and BD

| Structual formula of a compound | BD | | UDD | |
|---|---|---|---|---|
| | Solvents-extragents | | | |
| | Toluene | Benzene | Cyclohexane | Hydronaphtalene |
| 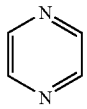 | + | | | + |
| 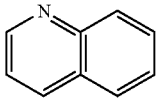 | | | + | + |
| 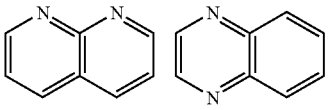 | + | + | + | + |
| 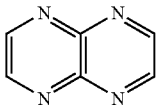 | + | + | | + |
| 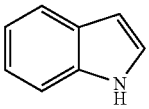 | | | + | + |
| 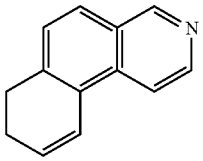 | | | + | |
| 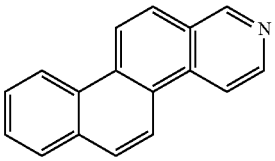 | + | | | |

Note.
"+" is the presence of a substance in extract
-normal structure -heptane, decane -aromatic structure -benzene, toluene -alicyclic structure -cyclohexane -hydronaphtalene -tetralin, decalin
These compounds are characterized by relative stability in the experiment conditions. an increase of solution power is pointed by the arrow.

In fact, the extracts are tinted different from thin yellow (n-hydrocarbon) to dark brown (hydro-naphthalene). The ratio of the carbon between the diamond phase and the graphite phase is changed after the extracting process and so the properties on the surface. Through 30 minutes of the super-critical liquifying process, 10% or more of the carbon contained diamond phase is turned to a soluble state. As the decomposition to active chemical bonds of carbon is relatively slow, the surface of each cluster becomes not uniform. Stable structure units such as microscopic units of solid carbon discharged into the solution or micro units of individual molecules remain unaffected. In the units, nitrogen contained, poly-hetero-cyclic molecules up to tetra-cyclic having one or two nitrogen atoms in each ring are identified.

The formation of such a compound conforming to the organic chemistry principles may be explained by nitrogen consumed during the poly-condensation of a nitrogen contained monomer having carbon-nitrogen bonds and contained in the aggregate which has primary dressed diamonds in the UDD synthesizing. In this point, the present invention is differentiated from the conventional report, A. L. Vereshagin, V. F. Komarov, V. M. Mastinhin, V. V. Novosyolov, L. A. Patrova, I. I. Zolotuhina, N. V. Vichin, K. S. Baraboshikin, A. E. Petrov, Published Documents for the Conference Entitled name of In Proceeding of 5th All-Union Meeting on detonation, held in Krasnoyarsk, January 1991, pp. 99, "Investigation of properties of detonation synthesis diamond phase" where no characteristic triplet signals are present in the EPR spectrum of a UDD having carbon atoms in the diamond lattice replaced by impurity nitrogen atoms. However, this results from a difference between "poly-condensation for synthesizing the UDD during the detonation" in the present invention and common "dispersing growth of diamond crystals". It is found after the dispersing growth of diamond crystals that nitrogen impurities are trapped and dispersed in the diamond crystals. The synthesizing of the UDD of the present invention allows nitrogen impurities (more precisely, nitrogen-carbon bonds) to be taken into the aromatic rings (having a cyclic aromatic structure with high bonding energy) and then trapped in a preliminarily condensed packing. In the latter case, the paramagnetic properties of nitrogen are different from those of nitrogen impurities.

It is also assumed from the data of thermal absorption that the two are equal in the structure of the outer side of the shell of diamond clusters. The thermal absorption is measured in the present invention using a chromatography-mass-spectrum meter LKB-209 (made in Sweden). After thermal adsorption and desorption at 573 degree K in a helium flow, resultant products are continuously trapped in a capillary tube cooled down with liquid nitrogen. Then, the thermal adsorption/desorption product is evaporated by program heating at a rate of 4 degrees per minute from 293 degree K to 543 degree K under a flow of helium gas carrier ($V_{He}=2.5\times10^{-6}$ m·m$^3$) in a capillary column of a low polar phase (SPB-5, $l_k=60$ m, $d_c=3.2\times10^{-4}$ m).

Example 17

The product is identified through mass spectrum processing with a computer using a mass spectrum library. The composition of the products generated by adsorption and desorption at the surface of the UDD and the diamond contained mixture is shown in Table 11.

TABLE 11

Thermal desorption (T = 573° K) from surface of UDD and BD (in 3 samples)

| Compound | | BD | UDD | UDD after treatment with hydrogen |
|---|---|---|---|---|
| Acetonitrile | | | ++ | |
| Nitromethane | | | + | |
| Butanone | | | + | |
| Teterahydrofuran | | | + | |
| Ethanol | | | | + |
| Acetone | | | | + |
| Ethyl acetate | | | ++ | +++ |
| Benzene and homologs | | ++ | +++ | ++ |
| Alcylbenzenes | $C_9$ | + | +++ | |
| | $C_{10}$ | +++ | + | |

TABLE 11-continued

Thermal desorption (T = 573° K) from surface of UDD and BD (in 3 samples)

| Compound | | BD | UDD | UDD after treatment with hydrogen |
|---|---|---|---|---|
| Alkanes | $C_7$ | | + | +++ |
| | $C_8$ | | + | + |
| | $C_9$ | | + | |
| | $C_{10}$ | +++ | +++ | |
| | $C_{11}$ | + | + | |
| Alkenes | $C_7$ | | + | |
| | $C_8$ | + | + | |
| | $C_9$ | | + | |
| | $C_{10}$ | | ++ | |
| Terpadienes | $C_{10}$ | + | ++ | |
| Alcylcyclopentanes | | + | | |
| Naphtalene | $C_{10}$ | + | + | |

"+" is the presence of a substance in thermal desorption products.

Generated by adsorption and desorption on the BD surface are only hydrocarbons including saturated $C_8$-$C_{11}$ hydrocarbon, unsaturated $C_8$-$C_9$ hydrocarbon, alicyclic hydrocarbon, and aromatic hydrocarbon. As alkane from $C_{10}$ is redundant, the adsorption/desorption product contains mainly n-decane $C_{10}H_{22}$. This is explained by the data of a carbyne structure (R—$CH_2$) as a thermodynamically efficient structure when a hydrocarbon chain of $C_{10}$-$C_{12}$ is packed by the consumption of cumulene bonds ($C_3H_7.C_6H_4.CH$) in the detonation product. While the presence of poly-cyclic aromatic net in the BD is confirmed by the present invention, aromatic hydrocarbon including alkylbenzene from $C_{10}$ is a small portion of the total mass generated by adsorption and desorption from the BD. It is hence apparent that the condensation of $sp^2$ carbon is high enough. However, the poly-cyclic aromatic net is highly mismatched and thus has fatty peripheral groups or so-called hydrocarbon fringes. Hydrogen in the adsorption and desorption product from the BD surface is of C—H bonding, inert type. This result is not differentiated from the teaching of ultra-dispersed carbon surface active hydrogen disclosed in Russian Patent No. 2046094 (synthetic carbon diamond material), Bjuljuten Izoberetnji (29), pp. 189 (1995).

The composition of the adsorption and desorption products from the UDD surface is highly complex and significantly varied. Other than hydrocarbon, nitrogen contained compounds and oxygen contain compounds are the products from oxidization at the carbon surface. As benzene and $C_7$-$C_{10}$ congeners have been developed, alkane of $C_{ho}$ is generated from them. In particular, n-decane is redundant. The bridge alicyclic is developed as camphene and terpadiene $C_{10}$-$C_{16}$. The composition of the adsorption and desorption product indicates that the interface in the diamond structure is exposed at minimum possibility.

The UDD cluster structure can be stabilized with transient carbon structures. When the UDD is processed at 400° C. in a hydrogen flow (as a hydrogen processed UDD in Table 11), the adsorption and desorption of a large amount of hydrocarbon $C_8$-$C_{11}$ is reversibly effected. However, when the surface carbon structure is decomposed, continuous or metastable surface structures are reconstructed as $C_2$-$C_7$ of hydrocarbon are developed.

It is known that the diamond particles synthesized by shock conversion are defined by the fractal rule (an infinite geometric series rule of having the shape of a set arranged similar to the shape of each member of the set and repeating this regularity to develop greater sets) and consists mainly of clusters of non-continuously aggregated small particles where at least a particle or clusters are joined together, as depicted in G. V. Sakovich, V. D. Gubarevich, F. Z. Badaev, P. M. Brilyakov, O. A. Besedina, Proceeding of Science of USSR, Vol. 310, No. 2, pp. 402 (1990), "Aggregation of diamonds obtained from explosives" and Luciano Pietronero, Erio Tosatti, Fractals in physics, Proceeding of the Sixth Trieste International Symposium of Fractals in Physics (1985), ICTP, Trieste, Italy, "Investigation of synthesis of ultra-dispersed diamonds", and A. V. Igonatchenko, A. B. Solohina, published domcument for the Conference entitled name of In proceeding of 5th All-Union Meeting on detonation, held in Krasnoyarsk, January 1991, pp. 164, "Fractal structure of ultra-dispersed diamonds".

The ion intensity in the UDD suspension liquid of the present invention is varied in a range from pH 4.0 to pH 10.0 but its pH increase with a higher temperature may initiate flocculation of suspended particles. The aggregation of the UDD of the present invention takes place in two steps. At the first step, the non-diamond components in the BD are clustered by oxidization during the chemical dressing process to develop a first aggregate which is relatively compact in the size. The second step involves aggregation of clusters to develop a second cluster structure which may easily be fractured. The second step lasts until the first aggregate starts flocculation. In some cases, there may be developed undesired aggregates between clusters and particles or between the second cluster structures.

Example 18

The properties are compared between the different UDD structures synthesized by a static conversion method (Method I, not shock conversion), a conventional shock conversion method (Method II, as depicted in G A. Adadurov, A. V. Baluev, O. N. Breusov, V. N. Drobishev, A, I, Rogechyov, A. M. Sapegin, B. F. Tatsji, Proceeding of Academy of Science of USSR, Inorganic Materials, Vol. 13, No. 4, pp. 649 (1977), "Some properties of diamonds obtained by explosion method"), and the method of the present invention (Method III). The result is shown in Table 12.

TABLE 12

Characteristics of UDD powders of different nature.

| Name of Characteristic | Method of diamond production and its brand | | |
|---|---|---|---|
| | Method I, static synthesis. ACM I/O | Method II, conventional detonation | Method III, detonation of the present invention |
| 1. Phase compositon | Diamond of cubic syngony ($a = 3.57 \times 10^{-10}$ m) | Diamond of cubic ($a = 3.57 \times 10^{-10}$ m) and hexagonal syngony ($a = 2.52 \times 10^{-10}$ m) or cubic syngony | Diamond of cubic syngony ($a = 3.57 \times 10^{-10}$ m) |
| 2. Substructure | | | |
| dimensions of coherent dispersion bands, ($\times 10^{-10}$ m): | Not found | 100~120 | 40 |
| microstresses of the II type ($\Delta\alpha/\alpha$): | — | $(1.0\sim1.9) \times 10^{-3}$ | Absent |
| density of dislocation, $m^{-2}$ | — | — | $1.8 \times 10^{17}$ |
| 3. Picnometric density, ($\times 10^{-3}$ kg/m$^3$) | 3.49 | 3.20-3.40 | 3.30 |
| 4. The particle size, ($\times 10^{-9}$ m) | 0~2000 | 41~82<br>10~50 (from graphite)<br>20~800 (carbon black) | 48.1 (2~50)<br>19.6<br>(2~20 (from graphite))<br>4 (carbon black) |
| 5. Specific surface ($\times 10^3$ m$^2$/kg) | 13.5 | 20.42 | 217 |
| 6. Chemical composition, mass. % | C = 99.0<br>Ni, Mn, Cr, Fe = 0.5<br>Si = 0.2<br>B = 0.2<br>H = 0.1<br>O = 0.1 | | C = 80.75<br>H = 1.35<br>N = 2.00<br>O = 15.90<br>Si = traces |
| 7. Incombustible (unburnt) resdiue, mass. % | <0.1 | 0.1 | <2.0 |
| 8. Temparature of the beginning of oxidation in air. °K | 723 | — | 673 |
| 9. Temparature of the beginning of graphitisation in vacuum, °K | 1373 | >1073 | 1423 (1373~1473) |
| 10. Electrocal resistance, (Ω) | $1 \times 10^{11}$ | — | $7.7 \times 10^9$<br>( $(7.7 \times 8.1) \times 10^9$) |
| 11. The loss tangent of a dielectric at requency $\theta = 10^3$ Hz | 0.0100 | — | 0.0145<br>(0.0143~0.0363) |
| 12. Specific magnetic susceptibility ($\times 10^3$/kg) | $0.5 \times 10^{-8}$ | — | $<1.0 \times 10^{-8}$ |

TABLE 12-continued

| Characteristics of UDD powders of different nature. | | | |
|---|---|---|---|
| | Method of diamond production and its brand | | |
| Name of Characteristic | Method I, static synthesis. ACM I/O | Method II, conventional detonation | Method III, detonation of the present invention |
| 13. Degree of water receptivity, (Joule/mol · kg) | −1480 | — | >−3100 |
| 14. Electrophoretic charge of the surface ($\times 10^3$ V) | −6.53 | — | >−78.44 |
| 15. Adsorption potential A ($\times 10^3$ J/kg) | 14.2 | — | >384 |
| Specific adsorption potential A. (Joule/$m^2$) | 1.005 | — | >2.16 |

As apparent from Table 12, the UDD synthesized by the method III of the present invention has as a low carbon content as smaller than 90%, as a high hydrogen content as not smaller than 0.8%, and as a high oxygen content as not smaller than 6.8%. This is also differentiated from other diamonds by the fact that the specific surface area is substantially 10 times greater, the absorptivity is $384\times10^3$ J/kg or more as almost 10 times greater, and the surface potential is not smaller than $-77.44\times10^3$ V as almost 10 times greater. Also, the UDD of the present invention has a level of the surface conductivity and is slightly greater in the water absorptivity. However, the UDD of the present invention is relatively lower in the intra-air oxidization start temperature and the intra-vacuum graphitization start temperature while not different in the electrical and magnetic physical properties from other diamonds. The UDD synthesized by the conventional method II has two phases, a cubic crystal with a crystalline constant of $a=3.57\times10^{-10}$ m and a hexagonal crystal with a crystalline constant of $a=2.52\times10^{-10}$ m. The UDD synthesized by the method III of the present invention has only a cubic crystal phase at a crystalline constant of $a=3.57\times10^{-10}$ m.
$10^{-3}$ $m^3$/kg or more.

[Plating, Metal Film]

The plating bath according to the present invention will now be described in more detail.

The plating bath is added with the UDD of the present invention so that the UDD concentration is 0.05 to 160 g, preferably 0.05 to 120 g, more preferably 0.1 to 32 g, or most preferably 1 to 16 g for one liter of the plating solution. Practically, the UDD concentration in the plating solution is preferably not smaller than 2 g or more preferably 3 to 14 g for one liter of the plating solution.

Example 19

Nickel Plating

The metal film and plating of nickel Ni has characteristic physical properties shown in Table 13.

TABLE 13

| Item<br>Unit<br>Kind | Hardness HV | Flexibility elongation ratio % | Tensile strength MPa | Internal stress MPa |
|---|---|---|---|---|
| Rolling, Annealing | — | — | — | — |

TABLE 13-continued

| Item<br>Unit<br>Kind | Hardness HV | Flexibility elongation ratio % | Tensile strength MPa | Internal stress MPa |
|---|---|---|---|---|
| Nickel plate | 90~140 | 40~ | more than 38 | — |
| Watt bath | — | — | — | — |
| Ni plating | 130~200 | 23~30 | 410 | (150 tension) |
| Sulfamic asid | — | — | — | — |
| Ni plating | 160~200 | 18 | 410 | (14 tension) |

The internal stress of the Ni plating is a (tensile) force for initiating separation from the basic material and may create a trouble. The internal stress becomes smaller when the thickness of the plating was increased, the content of chloride was reduced, or the temperature was elevated. The current density during the plating was not smaller than 5 A/$dm^2$ while the pH level was as low as 3.5 to 4.0.

When doped with an appropriate organic additive, the plating can be increased to HV 700 of a hardness level or so but its resistance to corrosion may be declined. In particular, this is emphasized with a sulfur compound. Also, the hardness can be increased with the use of ammonium ions but the elongation may be declined.

The Ni plating with the plating bath containing no organic substance was improved in the resistance to corrosion of e.g. steel with having no pin holes.

When the plating bath was used for Au or Ag plating on the Cu base, it can inhibit diffusion of Au or Ag. Also, the plating bath can contribute to the minimum development of pores.

Example 20

The concentration of nickel chloride was increased to have a modified form of the Watt bath. As the content of nickel chloride was increased, the current efficiency at high current density regions declines and the bath voltage drop down. This allows the current to run more across low current density regions thus improving the electro-deposition uniformity. Although the dissolution at the anode was improved cathode, more slimes may be deposited on the electro nickel plate. This can be suppressed by decreasing the pH level. When the plating bath with a higher chloride level is prepared by a combination of the following components, its plating may have a higher internal stress and a lower toughness as compared with the Watt bath plating. Yet, the plating according to the present invention can exhibit minimum burns while its graininess is very small.

| (High Chloride Bath) | |
|---|---|
| Nickel sulfate: | 200 g/l |
| Nickel chloride: | 150-200 g/l |
| Boric acid: | 40 g/l |
| Pit inhibitor: | a few |
| pH: | 1.5 to 2.0 |
| Temperature: | 40 to 50° C. |
| Dk: | 1.5 to 15 A/dm$^2$ |
| Stirring: | air blowing |

Example 21

As a low temperature type of the plating bath is similar to a conventional double salt bath and is used for thin plating at a normal temperature, it is unfavorable in the resistance to corrosion. The bath was however higher in the electro-deposition uniformity than the Watt bath and its plating was smaller in the crystalline graininess. As its resultant plating was susceptible to metal impurities, it can be rinsed with a metal impurity remover when its color was darkened. The components and the conditions are:

| | |
|---|---|
| Nickel sulfate: | 120-150 g/l |
| Ammonium chloride: | 15 g/l |
| Boric acid: | 15 g/l. |
| pH: | 5 to 6 |
| Dk: | 0.5 to 1 A/dm$^2$ |

Example 22

Total Chloride Bath

This bath was low in the bath voltage and improved in the cathode current efficiency while its plating was planar and rigid enough to increase the thickness. On the other hand, the plating was low in the flexibility and high in the internal stress.

Also, the plating was dark brown and not glossy at the appearance. When semi-glossy at a low temperature, the plating will be increased in the internal stress. The components and the conditions are:

| | |
|---|---|
| Nickel chloride: | 300 g/l |
| Boric acid: | 30 g/l |
| Pit inhibitor: | a few |
| pH: | 2 to 4 |
| Temperature: | 55 to 70° C. |
| Dk: | 2 to 20 A/dm$^2$ |

Example 23

Low Concentration Bath

In the Ni plating bath using a dissoluble Ni anode, a replenishment of Ni salt is equivalent to the amount of the plating solution lost in the picking up of a plated object and proportional to the concentration of Ni. Accordingly, as the plating solution was lowered in the concentration, it can substantially contribute to the energy saving. Also, when its operating temperature remains low, the plating can also contribute to the energy saving. As a result, the plating at low concentration and low-temperature is preferable. However, even if the plating needs a level of the glossiness, it may be darkened with no use of an appropriate additive. For depositing the plating similar in the appearance and the physical properties (not the hardness which is higher) to that of the Watt bath, the components and the conditions are:

| | |
|---|---|
| Nickel chloride: | 120 g/l |
| Nickel sulfate: | 30 g/l |
| Boric acid: | 50 g/l |
| pH: | 3.8 to 4.2 |
| Temperature: | 40 to 45° C. |
| Dk: | 1 to 10 A/dm$^2$ |

When the temperature was too high, the plating becomes darkened. Because the concentration of boric acid was high, care should be taken for crystallization at a lower temperature. When the content of boric acid was 40 WI, the plating may slightly be darkened.

When the amount of nickel sulfate was lowered, the generation of pits may occur. It is hence desired to hold not smaller than 25 WI.

Example 24

Total Sulfate Bath

This bath was used for plating with an insoluble anode and was low in the depositability. When impurities such as iron are absent, burns will less appear. The stirring was needed. For speeding up the plating, 500 WI or more of nickel sulfate can be used. The components and the conditions are:

| | |
|---|---|
| Nickel sulfate: | 300 g/l |
| Boric acid: | 40 g/l |
| Pit inhibitor: | non or a few |
| pH: | 2.5 to 4.5 |
| Temperature: | 50 to 55° C. |
| Dk: | 1 to 10 A/dm$^2$. |

Example 25

This bath employs nickel sulfamate having specific advantages and was used for electro-forming. However, when thin plating was lower in the resistance to corrosion than that of the Watt bath and may hardly be improved when using a pulse plating technique. When nickel sulfate in the Watt bath was replace partially (up to 35% of Ni) by nickel sulfamate, a resultant plating has a low internal stress and can be improved in the depositability. A nickel borofluoride bath may be provided in combination with high current but its cost is enormous. A weak-alkali plating bath produces a rigid, brittle plating and can thus be used for a limited range of applications. A barrel Ni bath has a higher rate of the nickel chloride concentration than of the Watt bath and was added with an organic brightener so as to increase the electric conductivity of the solution thus ensuring a favorable distribution of current throughout a target object to be plated. For eliminating the glossiness, the components and the conditions are:

| | |
|---|---|
| Nickel sulfate: | 270 g/l |
| Nickel chloride: | 70 g/l |
| Boric acid: | 40 g/l |
| Magnesium sulfate: | 225 g/l. |
| pH: | 4 to 5.6 |
| Temperature: | 50 to 55° C. |
| Voltage: | 8 to 12 V |

Since the barrel plating provides a low current density on the plating surface, it may be affected by metal impurities. It is hence essential to carefully rinse an object to be plated prior and clean the bath prior to the plating. Desirably, a series of filtering processes with a metal impurity remover or activated carbons may be carried out periodically.

Example 26

Black Ni Plating

Although black Ni plating unlike black Cr plating has no particular physical properties, it can be used for depositing a metallic, black plating with much ease.

As the resultant plating was brittle and not glossy, its thickness is preferably not greater than 2 μm and may be protected with a resin coating. Because its glossiness and resistance to corrosion largely depend on the base material, the plating can be deposited over a glossy Ni pre-plating as the lower layer. The components and the conditions are:

| | |
|---|---|
| Nickel sulfate: | 60 to 80 g/l |
| Nickel sulfate ammonium: | 35-50 g/l |
| Zinc sulfate: | 20 to 35 g/l |
| Sodium thiocyanate: | 18-25 g/l. |
| pH: | 4 to 6 |
| Temperature: | 50 to 60° C. |
| Dk: | 0.5 to 1.5 A/dm$^2$ |

The pH level can be controlled using sodium hydroxide and sulfuric acid. This bath when used at a lower temperature may crystallize and has to hold at 20 to 30° C. even when not operating. The lower the Zn concentration, the higher the color can be tinted. When the concentration was too high, the color at low current density regions may turn to gray. A pit inhibitor can be effective in some cases and if improperly selected, will deteriorate the color. When the plating has a thickness of 0.1 μm or smaller, it may exhibit rainbow colors. Some commercially available plating baths are easy in the handling. For plating on a stainless steel base to fabricate any space appliance, the compositions and the conditions of the chloride bath are:

| | |
|---|---|
| Nickel chloride: | 75 g/l |
| Ammonium chloride: | 30 g/l |
| Zinc chloride: | 30 g/l |
| Sodium thiocyanate | 15 g/l |
| pH: | 4.8 to 5.2 |
| Temperature: | room temp. |
| Dk: | 0.16 A/dm$^2$ |
| Anode: | Nickel plate. |

The stirring was conducted at 8 cm/s by a cathode rocker while the continuous filtering was employed for long-run plating. A stainless steel base has to be plated with nickel strike.

Example 27

Industrial Ni Plating

There are few examples for use in the industrial Ni plating. A resultant Ni plating according to the present invention is never harder than that of any industrial Cr plating but its properties are superior. In view of the flexibility, the resistance to corrosion, and the operability, the plating bath of the present invention can be applied to a wide range of plating applications. For example, its plating is advantageous in the protection from wear and corrosion and can thus be applied for protecting any material used under corrosive conditions and minimizing declination in the strength against fatigue. The components of a favorable Watt bath or sulfamine acid bath used for the plating are:

| | |
|---|---|
| Nickel sulfate: | 300 g/l |
| Nickel chloride: | 20 g/l |
| Boric acid: | 10 to 30 g/l. |

When more hardness is required, another Watt bath having the following components can be used with equal success. The components and the conditions are:

| | |
|---|---|
| Nickel sulfate: | 200 g/l |
| Sodium chloride: | 15 g/l |
| Boric acid: | 20 g/l |
| pH: | 4.8 to 5.2 |
| Temperature: | 25 to 40° C. |
| Dk: | 1 to 3 A/dm$^2$. |

For decreasing the internal stress and increasing the hardness, an organic sulfur compound may be added. It is however noted that when deposited from such a sulfur added bath, the plating becomes sulfur deteriorated at 200° C. or higher. Such deterioration can effectively be avoided by co-deposition of manganese. The higher the current density, the more the co-deposition of manganese will be increased. The requirement of the co-deposition depends on a combination of the amount of sulfur in the bath and the temperature to be used. For withstanding 200° C. of the temperature, the plating has to be deposited at not lower than 4 A/dm$^2$ of the current density in the Watt bath containing 15 g/l of manganese sulfate. The higher the temperature, the higher the current density shall be increased. Accordingly, when an object to be plated has an intricate shape, its low current density regions may be declined in the effectiveness of co-deposition. As the industrial plating develops a considerable thickness, a pre-plating process or etching was needed for ensuring the depositing strength. After rinsed and coated with plating inhibitor, the object to be plated was etched at 25° C. or lower using a 30% sulfuric acid solution. When the object was low-carbon steel, it was subjected to anode electrolysis at 18 to 25 A/dm$^2$ for 30 to 300 seconds. When the object was cast iron, it was subjected to anode electrolysis at not lower than 20 A/dm$^2$, continued for more 30 to 120 seconds after the generation of oxygen, rinsed and cleaned down by brushing to remove undesired carbon smut, immersed into an acid solution, rinsed again, and plated. When the object was stainless steel, it was subjected to anode electrolysis at 20 to 25 A/dm$^2$ for one minute, immersed in a nickel strike bath such as described below, when becoming the same temperature as of the bath, plated for six minutes, and then subjected without washing to the Ni plating.

Example 28

Nickel Hydrochloride Strike Bath

| (Nickel Hydrochloride Strike Bath) | |
|---|---|
| Nickel chloride: | 220 g/l |
| Hydrochloric acid: | 45 g/l |
| Temperature: | 27° C. |
| Dk: | 8 to 15 A/dm$^2$. |

When the anode was insoluble such as lead, a nickel sulfate strike bath was used. This bath should be free from chlorine ions.

(Nickel Sulfate Strike Bath)

| (Nickel Sulfate Strike Bath) | |
|---|---|
| Nickel Sulfate: | 200-240 g/l |
| Sulfuric acid: | 50-100 g/l |
| Temperature: | 25 to 40° C. |
| Dk: | 8 to 15 A/dm$^2$. |

For the aqueous brittleness, the Ni plating is significantly smaller in the permeation of hydrogen into an iron object than any other plating technique. This may be explained by the fact that the permeation of hydrogen occurs only at the beginning of the electro-deposition and once an Ni film is developed, not takes place. The permeation appears less in the Watt bath and after initial striking, will rarely be effected. Accordingly, it is said that the Ni plating provides a less level of the aqueous brittleness. However, this is true only during the plating process. Because hydrogen is accumulated in the acid washing step before the plating and in the cathode electrolysis washing step, it may affect the brittleness more or less.

Example 29

Decorative Nickel Plating

Decorative nickel plating is intended for providing steel, brass, zinc diecast, or other objects to be plated with decorations as well as anti-corrosion protections. As the Ni plating was gradually oxidized in the atmosphere and turned less glossy, it may preferably be coated with a Cr or rare-metal plating to prevent color fading. In common, the decorative nickel plating employs a combination of copper, nickel, and chrome which was however unfavorable in the resistance to corrosion. Although the decorative nickel plating was normally implemented by a glossy, leveling technique, other appropriate techniques may equally be used such as less leveling, glossy Ni plating, not-glossy, satin appearance Ni plating, or black Ni plating.

Example 30

Glossy Nickel Plating

The glossy nickel plating was varied in type depending on the type of a brightener, from medium leveling type to super-glossy leveling type developing as thin as some micrometers. An optimum type can thus be selected and used for matching every specific application. As this Ni plating was improved in the leveling function, its plating layer can make the surface of a base planer and provide a favorable metallic appearance. Also, this plating is highly compatible with Cr or rare-metal plating and can successfully be used as a lower plating. This plating was improved in the resistance to corrosion and particularly higher in combination with an upper Cr plating, thus protecting the base material from rusting. As the plating was relatively high in the ductility, it can withstand during machining process after the plating process. Moreover, the super-glossy Ni plating may contribute to elimination of the pre-plating polishing process.

The components and the conditions of a typical glossy Ni plating solution are:

| | |
|---|---|
| Nickel sulfate ($NiSO_4 \cdot 6H_2O$): | 220 to 370 g/l |
| Nickel chloride ($NiCl_3 \cdot 6H_2O$): | 30 to 90 g/l |
| Boric acid ($H_3BO_3$): | 30 to 50 g/l |
| Brightener: | (commonly two types available) |
| Bit inhibitor: | a few |
| pH: | 2.5 to 5.0 |
| Temperature: | 45 to 70° C. |
| Cathode current density: | 0.5 to 15 A/dm$^2$ |
| Stirring: | by air blowing or cathode rocker. |

Nickel sulfate as a primary component has as a high solubility as 460 g/l in a room temperature. Generally, the higher the concentration of nickel ions, the higher the cathode current efficiency will be increased thus allowing the operation at a higher current density. Nickel chloride was preferably 40 g/l or more. When the content of nickel chloride of nickel chloride was declined, the nickel anode may be turned inert. The high the concentration of nickel chloride, the higher the electro-deposition stress will be increased. The stress can be attenuated by applying a brightener. The chloride bath can be prepared as a high-speed plating bath which includes 60 g/l of nickel sulfate, 225 g/l of nickel chloride, and 45 g/l of boric acid. Boric acid was low in the solubility and preferably not smaller than 40 g/l. The high concentration of boric acid can prevent undesired burns and also contribute to the bonding stiffness and the flexibility of the plating.

Example 31

The brightener for glossy Ni plating was normally one of organic compounds which are classified into two types, a primary brightener and a secondary brightener. The primary brightener when used alone provides no leveling function but assists the secondary brightener, declines the tensile stress, and provides a compression stress. The primary brightener is hence called a stress attenuator. The secondary brightener is a highly adsorptive compound providing a glossiness and a leveling function. When used alone, the secondary brightener provides no glossiness and causes the plating to be high in the internal stress and thus brittle. When the second brightener is use in combination with the primary brightener, the advantages will be enhanced.

The plating process for common two-layer or three-layer Ni plating comprises the steps of carrying out a pre-plating step, semi-glossy Ni plating after depositing a Cu plating or not in most cases, glossy Ni plating after providing a high sulfur contained nickel strike or not, and Cr plating at the last. When the object to be plated is iron, a copper plating may first be deposited as a lower layer prior to the Ni plating for increasing the resistance to corrosion and improving the appearance. It is common and preferable for minimizing the drainage trouble to eliminate the step of copper plating. Also, while no washing bath was provided between the Ni plating baths, the high sulfur contained nickel strike bath may be doped with a semi-glossy brightener or the semi-glossy brightener contained or sulfur contained nickel strike bath may be doped with a full brightener. As no reverse action was permitted, the concentration of Ni in the semi-glossy bath will be declined or the concentration of Ni in the full brightener bath will be increased. For compensation, a recovery bath may be provided between the nickel plating baths. The bath was fundamentally of Watt type and provided with two or three additives for plating under predetermined conditions. The components and the conditions of the bath are listed in Table 14.

TABLE 14

| | Semi bright | Semi bright | Tri-Ni | bright | bright |
|---|---|---|---|---|---|
| $NiSO_4 \cdot 6H_2O$ (g/l) | 300~350 | 300~350 | 250~350 | 270~300 | 40~60 |
| $NiCl_2 \cdot 6H_2O$ (g/l) | 38~47 | 38~60 | 60~110 | 45~90 | 225 |
| $H_3BO_3$ (g/l) | 45~48 | 40~45 | 30~40 | 40~50 | 40~50 |
| Primary brighter (ml/l) | 0.6~1.2 | 0.8~1.6 | 10~25 | 10~15 | 25~35 |
| Secondary brighter (ml/l) | 0.6~1.2 | 0.3~0.6 | | 5~7 | 5~10 |
| Pit preventing agent (ml/l) | 2~5 | 3~5 | 0~5 | 0~5 | 0~5 |
| pH | 3.6~4.5 | 3.5~4.5 | 2~3.5 | 3.5~4.5 | 3.5~4.5 |
| Temperature of bath (° C.) | 50~65 | 45~50 | 40~50 | 55~65 | 55~70 |
| Density of current ($A/dm^2$) | | | | | |
| Anode | 3.3~6.6 | 2~6 | 3~4 | 1~12 | 2~16 |
| Cathode | 1.0~3.3 | 1~3 | 1~3 | 1~4 | 1~5 |
| Stirrering | Air | Air | Liquid recycling by continuous filtration with filter aid alone | Air | Air |
| Filtration | Continuous filtration with active carbon | Liquid recycling by continuous filtration with filter aid alone | | Continuous filtration with active carbon | Continuous filtration with active carbon |

Example 32

Semi-Glossy Nickel Plating

This plating was lower in the concentration of nickel chloride than the glossy nickel plating. The concentration was about 45 g/l and if too high, may produce no glossiness on the high current density regions or increase the internal stress. The requirements for the semi-glossy nickel plating are no content of sulfur and minimum of the internal stress in the plating, high stability of the additive, ease of controlling the plating solution, semi-glossy in the appearance, and a desired degree of the leveling function.

The additive may be selected from coumalines and non-coumalines. Coumalines provide a degree of the leveling function equivalent to that of glossy nickel but are susceptible to heat and tend to accumulate decomposed products and generate unwanted pits. This requires the bath to be dressed periodically with activated carbon. Also, the bath was not easy to be managed.

Example 33

Decorative Chrome Plating on Ni Plating

Decorative chrome plating was used as a protective layer on the Ni plating and its highly glossy finish and color can be appreciated. This plating bath comprises a known sergeant bath or chromic acid/sulfuric acid bath added with a mixture catalyst attenuator which contains a commercially available silicofluoride. As a result, the bath was improved in the depositability thus allowing a wider range of operating conditions to be implemented regardless of the surface quality of the glossy nickel plating.

Different types of the plating bath and their conditions are shown below. Chromic acid/sulfuric acid, chromic acid/sodium silicofluoride/sulfuric acid, tetrachromate,

| | (Sergeant) | Hayashi | Konishi | Barrel | Bornhauser |
|---|---|---|---|---|---|
| Chromic acid (g/l): | 200-300 | 250 | 50 | 300 | 320 |
| Chromic acid/sulfuric acid: | 100/1 | — | — | — | 500/1 |
| Sodium silicofluoride (g/l): | — | 5-10 | 0.5 | 20 | — |
| Sulfuric acid (g/l): | 2-3 | 0.7-1.5 | 0.5 | 0.25 | — |
| Sodium hydroxide (g/l): | — | — | — | — | 50 |
| Trivalent chrome (g/l): | — | — | — | — | 6-10 |
| Temperature (° C.): | 40-55 | 50-60 | 50-60 | 35 | 15-21 |
| Current Density ($A/dm^2$): | 10-60 | 30-60 | 30-60 | — | 20-90 |

The Cr plating bath can easily be controlled using a specific gravity meter and a Hull cell tester. Using ion electrodes, silico-fluoride can be quantized precisely and readily. The Hull cell test may be implemented using two sets of brass plates and glossy nickel plates. When the bath contains chloride, the brass plates was plated at 5 amperes for 3 minutes so that its back side was etched. When the content of chloride was large, the etching was deepened to the front side. A small amount of chloride in the Cr plating solution may gradually be eliminated by electrolytic action. It was also desired to add silver carbonate for developing a deposit of silver chloride which was then removed. The glossy nickel plate was chrome plated at 10 amperes for 1 minute. A resultant chrome layer was 80 to 90 mm. While the plating was feasible at 5 amperes for 3 minutes in standard, its optimum conditions may be different according to the type of the bath, the current, and the duration. It is hence desirable to predetermine the criterion of the plating.

Example 34

Stannate (Alkali Tin) Bath

Practically used was a K bath which was higher in the cathode current efficiency than an Na bath thus allowing the plating at a high current density under a wider range of operating conditions.

The components and the conditions are:

| | Standard (K bath) | High-current density (K bath) | Standard (Na bath) |
|---|---|---|---|
| Potassium stannate: | 120 (g/l) | 210 (g/l) | (g/l) |
| Sodium stannate: | | | 105 |
| Tin (as metal): | 47.6 | 80 | 42 |
| Free potassium hydroxide: | 15 | 22.5 | |
| Free sodium hydroxide: | | | 9.4 |
| Acetate: | 0-15 | 0-15 | 0-15 |
| Cathode Dk ($A/dm^2$): | 3-10 | 3-16 | 0.6-3 |
| Anode Dk ($A/dm^2$): | 1.5-4 | 1.5-5 | 0.5-3 |
| Voltage (V): | 4-6 | 4-6 | 4-6 |
| Bath temperature (° C.): | 65-87 | 76-87 | 60-82 |

The barrel plating bath contains 150 g/l of potassium stannate and 22 to 26 g/l of free potassium hydroxide.

As involved chemicals are non-corrosive, the plating bath and its heater can be made of iron. The iron bath should remain heated. The iron bath and its heater have to be isolated by an insulating material from the anode. The plating solution was heated by the iron heater or the use of steam. Steam heats up the bath more quickly. An exhaust system may preferably be provided for discharging a mist of hydrogen gas. As the plating solution was filtered with much difficulty, its bath was increased in the depth for minimizing the effect of deposits and may preferably be equipped with a filter.

The plating comprises the steps of (1) providing the plating bath with water up to a half, (2) dissolving a calculated amount of an alkali substance, (3) heating to about 50° C., (4) mixing a proper amount of stannate and adding water to a predetermined level, (5) adding a 1/10 dilute of hydrogen peroxide and stirring the mixture, and (6) analyzing free alkali in the plating solution and adding acetic acid to neutralize a redundancy of alkali.

In routine, while a yellowish green plating was deposited on the anode, $Sn^{4+}$ was eluted in the solution. The stannate bath incorporates a tetravalent tin plating solution. If any bivalent tin ions are present, the resultant grains become course thus allowing no smooth plating surface. Accordingly, care should be taken to manage the bath.

| (Nickel Chloride Strike Bath) | |
|---|---|
| Nickel sulfate: 200-240 g/l | Temperature: 25-40° C. |
| Sulfuric acid: 50-100 g/l | Gk: 8-15 $A/dm^2$ |

For the aqueous brittleness, the Ni plating is significantly smaller in the permeation of hydrogen into an iron object than any other plating technique. This may be explained by the fact that the permeation of hydrogen occurs only at the beginning of the electro-deposition and once an Ni film was developed, not takes place. The permeation appears less in the Watt bath and after initial striking, will rarely be effected. Accordingly, it is said that the Ni plating provides a less level of the aqueous brittleness. However, this is true only during the plating process. Because hydrogen is accumulated in the acid washing step before the plating and in the cathode electrolysis washing step, it may affect the brittleness more or less.

Example 35

Decorative Nickel Plating

Decorative nickel plating was intended for providing steel, brass, zinc diecast, or other objects to be plated with decorations as well as anti-corrosion protections. As the Ni plating was gradually oxidized in the atmosphere and turned less glossy, it may preferably be coated with a Cr or rare-metal plating to prevent color fading. In common, the decorative nickel plating employs a combination of copper, nickel, and chrome which is however unfavorable in the resistance to corrosion. Although the decorative nickel plating is normally implemented by a glossy, leveling technique, other appropriate techniques may equally be used such as less leveling, glossy Ni plating, not-glossy, satin appearance Ni plating, or black Ni plating.

(Glossy Nickel Plating)

The glossy nickel plating is varied in type depending on the type of a brightener, from medium leveling type to super-glossy leveling type developing as thin as some micrometers. An optimum type can thus be selected and used for matching every specific application. As this Ni plating was improved in the leveling function, its plating layer can make the surface of a base planer and provide a favorable metallic appearance. Also, this plating is highly compatible with Cr or rare-metal plating and can successfully be used as a lower plating. This plating was improved in the resistance to corrosion and particularly higher in combination with an upper Cr plating, thus protecting the base material from rusting. As the plating is relatively high in the ductility, it can withstand during machining process after the plating process. Moreover, the super-glossy Ni plating may contribute to elimination of the pre-plating polishing process.

The components and the conditions of a typical glossy Ni plating solution are:

| | |
|---|---|
| Nickel sulfate ($NiSO_4 \cdot 6H_2O$): | 220 to 370 g/l |
| Nickel chloride ($NiCl_3 \cdot 6H_2O$): | 30 to 90 g/l |
| Boric acid ($H_3BO_3$): | 30 to 50 g/l |
| Brightener: | (commonly two types available) |
| Bit inhibitor: | a few |
| pH: | 2.5 to 5.0 |
| Temperature: | 45 to 70° C. |
| Cathode current density: | 0.5 to 15 $A/dm^2$ |
| Stirring: | by air blowing or cathode rocker. |

Nickel sulfate as a primary component has as a high solubility as 460 g/l in a room temperature. Generally, the higher the concentration of nickel ions, the higher the cathode current efficiency will be increased thus allowing the operation at a higher current density. Nickel chloride was preferably 40 g/l or more. When the content of nickel chloride of nickel chloride was declined, the nickel anode may be turned inert. The high the concentration of nickel chloride, the higher the electro-deposition stress will be increased. The stress can be attenuated by applying a brightener. The chloride bath can be prepared as a high-speed plating bath which includes 60 g/l of nickel sulfate, 225 g/l of nickel chloride, and 45 g/l of boric acid. Boric acid was low in the solubility and preferably not smaller than 40 g/l. The high concentration of boric acid can prevent undesired burns and also contribute to the bonding stiffness and the flexibility of the plating.

The brightener for glossy Ni plating is normally one of organic compounds which are classified into two types, a primary brightener and a secondary brightener. The primary brightener when used alone provides no leveling function but assists the secondary brightener, declines the tensile stress, and provides a compression stress. The primary brightener is hence called a stress attenuator. The secondary brightener is a highly adsorptive compound providing a glossiness and a leveling function. When used alone, the secondary brightener provides no glossiness and causes the plating to be high in the internal stress and thus brittle. When the second brightener is use in combination with the primary brightener, the advantages will be enhanced.

The plating process for common two-layer or three-layer Ni plating comprises the steps of carrying out a pre-plating step, semi-glossy Ni plating after depositing a Cu plating or not in most cases, glossy Ni plating after providing a high sulfur contained nickel strike or not, and Cr plating at the last. When the object to be plated was iron, a copper plating may first be deposited as a lower layer prior to the Ni plating for increasing the resistance to corrosion and improving the appearance. It is common and preferable for minimizing the drainage trouble to eliminate the step of copper plating. Also, while no washing bath is provided between the Ni plating baths, the high sulfur contained nickel strike bath may be doped with a semi-glossy brightener or the semi-glossy brightener contained or sulfur contained nickel strike bath may be doped with a full brightener. As no reverse action is permitted, the concentration of Ni in the semi-glossy bath will be declined or the concentration of Ni in the full brightener bath will be increased. For compensation, a recovery bath may be provided between the nickel plating baths. The bath is fundamentally of Watt type and provided with two or three additives for plating under predetermined conditions. The components and the conditions of the bath are listed in Table 15.

TABLE 15

| | Semi bright | Semi bright | Tri-Ni | bright | bright |
|---|---|---|---|---|---|
| $NiSO_4 \cdot 6H_2O$ (g/l) | 300~350 | 300~350 | 260~350 | 270~300 | 40~60 |
| $NiCl_2 \cdot 6H_2O$ (g/l) | 38~47 | 38~60 | 60~110 | 45~90 | 225 |
| $H_3BO_3$ (g/l) | 45~48 | 40~45 | 30~40 | 40~50 | 40~50 |
| Primary brighter (ml/l) | 0.6~1.2 | 0.8~1.6 | 10~25 | 10~15 | 25~35 |
| Secondary brighter (ml/l) | 0.6~1.2 | 0.3~0.6 | | 5~7 | 5~10 |
| Pit preventing agent (ml/l) | 2~5 | 3~5 | 0~5 | 0~5 | 0~5 |
| pH | 3.6~4.5 | 3.5~4.5 | 2~3.5 | 3.5~4.5 | 3.5~4.5 |
| Temperature of bath (° C.) | 50~65 | 45~50 | 40~50 | 55~65 | 55~70 |
| Density of current ($A/dm^2$) | | | | | |
| Anode | 3.3~6.6 | 2~6 | 3~4 | 1~12 | 2~16 |
| Cathode | 1.0~3.3 | 1~3 | 1~3 | 1~4 | 1~5 |
| Stirrering | Air | Air | Liquid recycling by continuous filtration with filter aid alone | Air | Air |
| Filtration | Continuous filtration with active carbon | Liquid recycling by continuous filtration with filter aid alone | | Continuous filtration with active carbon | Continuous filtration with active carbon |

Example 36

Semi-Glossy Nickel Plating

This plating is lower in the concentration of nickel chloride than the glossy nickel plating. The concentration was about 45 g/l and if too high, may produce no glossiness on the high current density regions or increase the internal stress. The requirements for the semi-glossy nickel plating are no content of sulfur and minimum of the internal stress in the plating, high stability of the additive, ease of controlling the plating solution, semi-glossy in the appearance, and a desired degree of the leveling function.

The additive may be selected from coumalines and non-coumalines. Coumalines provide a degree of the leveling function equivalent to that of glossy nickel but are susceptible to heat and tend to accumulate decomposed products and generate unwanted pits. This requires the bath to be dressed periodically with activated carbon. Also, the bath is not easy to be managed.

Example 37

Decorative Chrome Plating on Ni Plating

Decorative chrome plating is used as a protective layer on the Ni plating and its highly glossy finish and color can be appreciated. This plating bath comprises a known sergeant bath or chromic acid/sulfuric acid bath added with a mixture catalyst attenuator which contains a commercially available silicofluoride. As a result, the bath was improved in the depositability thus allowing a wider range of operating conditions to be implemented regardless of the surface quality of the glossy nickel plating.

Different types of the plating bath and their conditions are shown below. Chromic acid/sulfuric acid, chromic acid/sodium silicofluoride/sulfuric acid, tetrachromate,

| | (Sergeant) | Hayashi | Konishi | Barrel | Bornhauser |
|---|---|---|---|---|---|
| Chromic acid (g/l): | 200-300 | 250 | 50 | 300 | 320 |
| Chromic acid/ sulfuric acid: | 100/1 | — | — | — | 500/1 |
| Sodium silico-fluoride (g/l): | — | 5-10 | 0.5 | 20 | |
| Sulfuric acid (g/l): | 2-3 | 0.7-1.5 | 0.5 | 0.25 | |
| Sodium hydroxide (g/l): | — | — | — | — | 50 |
| Trivalent chrome (g/l): | — | — | — | — | 6-10 |
| Temperature (° C.): | 40-55 | 50-60 | 50-60 | 35 | 15-21 |
| Current Density ($A/dm^2$): | 10-60 | 30-60 | 30-60 | — | 20-90 |

The Cr plating bath can easily be controlled using a specific gravity meter and a Hull cell tester. Using ion electrodes, silico-fluoride can be quantized precisely and readily. The Hull cell test may be implemented using two sets of brass plates and glossy nickel plates. When the bath contains chloride, the brass plates was plated at 5 amperes for 3 minutes so that its back side was etched. When the content of chloride was large, the etching was deepened to the front side. A small amount of chloride in the Cr plating solution may gradually be eliminated by electrolytic action. It is also desired to add silver carbonate for developing a deposit of silver chloride which is then removed. The glossy nickel plate is chrome plated at 10 amperes for 1 minute. A resultant chrome layer was 80 to 90 mm. While the plating was feasible at 5 amperes for 3 minutes in standard, its optimum conditions may be different according to the type of the bath, the current, and the duration. It is hence desirable to predetermine the criterion of the plating.

Example 38

Stannate (Alkali Tin) Bath

Practically used is a K bath which is higher in the cathode current efficiency than an Na bath thus allowing the plating at a high current density under a wider range of operating conditions. The components and the conditions are:

| | Standard (K bath) | High-current density (K bath) | Standard (N bath) |
|---|---|---|---|
| Potassium stannate: | 120 (g/l) | 210 (g/l) | (g/l) |
| Sodium stannate: | | | 105 |
| Tin (as metal): | 47.6 | 80 | 42 |
| Free potassium hydroxide: | 15 | 22.5 | |
| Free sodium hydroxide: | | | 9.4 |
| Acetate: | 0-15 | 0-15 | 0-15 |
| Cathode Dk ($A/dm^2$): | 3-10 | 3-16 | 0.6-3 |
| Anode Dk ($A/dm^2$): | 1.5-4 | 1.5-5 | 0.5-3 |
| Voltage (V): | 4-6 | 4-6 | 4-6 |
| Bath temperature (° C.): | 65-87 | 76-87 | 60-82 |

The barrel plating bath contains 150 g/l of potassium stannate and 22 to 26 g/l of free potassium hydroxide.

As involved chemicals are non-corrosive, the plating bath and its heater can be made of iron. The iron bath should remain heated. The iron bath and its heater have to be isolated by an insulating material from the anode. The plating solution was heated by the iron heater or the use of steam. Steam heats up the bath more quickly. An exhaust system may preferably be provided for discharging a mist of hydrogen gas. As the plating solution was filtered with much difficulty, its bath was increased in the depth for minimizing the effect of deposits and may preferably be equipped with a filter.

The plating comprises the steps of (1) providing the plating bath with water up to a half, (2) dissolving a calculated amount of an alkali substance, (3) heating to about 50° C., (4) mixing a proper amount of stannate and adding water to a predetermined level, (5) adding a 1/10 dilute of hydrogen peroxide and stirring the mixture, and (6) analyzing free alkali in the plating solution and adding acetic acid to neutralize a redundancy of alkali.

In routine, while a yellowish green plating is deposited on the anode, $Sn^{4+}$ is eluted in the solution. The stannate bath incorporates a tetravalent tin plating solution. If any bivalent tin ions are present, the resultant grains become course thus allowing no smooth plating surface. Accordingly, care should be taken to manage the bath.

More particularly, the anode current density should be held within a range of 1.5 to 4 $A/dm^2$ although it may be varied depending on the content of free potassium hydroxide and the bath temperature. The voltage prefers a higher level to a lower level. Accordingly, the plating process starts with picking up some of the anodes from the plating bath to increase the anode current density and then returning back the anodes one by one into the bath to allow a small amount of oxygen gas to emit from the anodes. As a result, a yellowish green layer is developed while tetravalent tin is eluted. Then, any contact error between the electrodes and the anodes is eliminated. If the contact is inadequate at as a low current density as 0.5 $A/dm^2$, the yellowish green layer can hardly be developed but while deposits appear on the anodes.

When such white stannate deposits (bivalent tin) on the anodes are eluted, the plating becomes rough and porous. Also, if the anode current density was increased further (4 $A/dm^2$ or higher), a redundancy of oxygen gas was released to leave a dark oxide layer allowing no more dissolution.

Considering the bath temperature and the content of free alkali, the voltage was controlled to 4 to 6 V for the static plating and 6 to 10 V for the barrel plating.

As the content of free alkali needs to be controlled to a desired level corresponding to the concentration of metal, it may preferably be 10 to 20 g/l. If free alkali is too small, the bath resistance will increase thus causing the hydrolytic action of stannate $K_2SnO_3$. As the reaction takes place, from equation $K_2SnO_3H_2O \rightarrow 2KOH+H_2SnO_3$, $H_2SnO_3$ (metastannate) is deposited thus whitening the plating solution. This phenomenon is less significant in the K bath. Since the deposits are hardly filtered, their effect on the plating layer can be minimized by deepening the plating bath. When free alkali is redundant, the cathode current efficiency will be declined. Hence, care should be taken for bathing while free alkali is present in the stannate.

The bath temperature was controlled to a range of 60 to 90° C. When the temperature was high, the cathode current efficiency remains high and the plating can be finished at quality. This may however promote the evaporation of water thus changing the quality of the solution. In practice, the operation at a temperature of over 80° C. was feasible only with some difficulty. Preferably, the temperature ranges from 65° C. to 70° C. Yet, the resultant plating becomes whiter and planer when the temperature is high. The plating can be speeded up at a cathode current density of 40 A/dm$^2$ using the high potassium salt concentration bath (290 g/l of Sn) at the temperature of 90° C.

Acetate may not be added in the beginning. It is generated when redundant potassium hydroxide is neutralized with acetic acid, $KOH+CH_3COOH \rightarrow CH_3COOK+H_2O$. Acetic acid is needed substantially 1.1 times greater in the amount than potassium hydroxide.

There are impurities of stannite ions in stannate (II). Because the ions may be present in the stannate during the bathing, a 1/100 dilute of hydrogen peroxide was added 1 ml/l as an oxidizer. If too much, the cathode current efficiency will be declined.

The typical conditions for different baths are:

| | Non-glossy bath | Glossy bath |
|---|---|---|
| Tin sulfate (II) <Tin sulfate (I)> (g/l): | 50 | 40 (30-50) |
| Sulfuric acid (g/l): | 100 | 100 (80-120) |
| Cresol sulfonate (g/l): | 100 | 30 (25-35) |
| β-naphtol (g/l): | 1 | |
| Gelatin (g/l): | 2 | |
| Formalin (37%): | | 5 (3-8) |
| Brightener (ml/l): | | 10 (8-12) |
| Dispersant (ml/l): | | 20 (15-25) |
| Cathode Current Density (A/dm$^2$): | 1.5 | 2 (0.5-5) |
| Anode Current Density (A/dm$^2$): | 0.5-2 | 0.5-2 |
| Stirring (Cathode motion): | app. | 1-2 m/min |
| Bath temperature (° C.): | 20 (15-25) | 18 (15-20) |

Example 39

Acid Tin Plating

A sulfate bath is commonly used as its cathode current efficiency is as high as 90 to 100%. The electro-deposition of bivalent tin is 2.6 times greater in the efficiency than that of sodium stannate bath. Also, as the operation was conducted at a normal temperature, its resultant tin plating can be uniform and appear milky white or semi-glossy due to an additive (gelatin, β-naphtol, or cresol sulfonate). A combination of additive and dispersant such as formalin identical to that of the glossy Sn bath can be used with equal success.

The bath may comprise preferably 30 to 60 g/l of tin sulfate (H), 30 to 150 g/l of sulfuric acid, 10 to 100 g/l of cresol sulfonate, and two or three additives. They are effective in a combination.

Example 40

Neutral Tin Plating

An organic carboxylic acid is now explained as used as a typical plating bath for the neutral tin plating. This is suited for plating on a material (such as a ceramic composite component) which is highly susceptible to acid or alkali. A resultant plating appears specific glossy white and highly dense.

The components and the conditions of the bath are:

| | |
|---|---|
| Tin sulfate (II): | 50 g/l |
| Organic carboxylic acid: | 110 g/l (90-150 g/l) |
| Inorganic electrolyte (ammonium salt): | 70 g/l (50-100 g/l) |
| Brightener: | 8 ml/l (7-9 ml/l) |
| pH: | 6.0 (5.5-7.0) |
| Bath Temperature: | 20° C. (15-25° C.) |
| Cathode current density: | 2 A/dm$^2$ (0.5-4 A/dm$^2$) |
| Stirring: | by cathode rocker |

The plating bath may be implemented by an iron vessel lined with PVC or hard rubber. The plating solution needs continuous filtering and cooling (to 15 to 25° C.). Also, other facilities (power source and stirrer) may be implemented in an equal fashion.

Example 41

Gold Plating

The components and the conditions of a gold plating bath is now explained. For gold plating, an alkali bath is commonly used as featured by:

Purity: 50% or higher, which may be provided in the form of an alloy with other metals and at a gold co-deposition of 30%, Hardness: 70 to 350 Knoop Deposition efficiency: 90% or higher.

The components and the conditions of a typical alkali gold plating bath are:

| | Au—Cu | Au—Ag | Au—Ag—Sb | Pure gold | Rinker |
|---|---|---|---|---|---|
| Potassium gold cyanide (g/l) | 6-6.5 | 15-20 | 10.8 | 1-12 | 12 |
| Copper trisodium DTPA (g/l) | 16-18 | | | | |
| Potassium di-hydrogen phosphate (g/l) | 60 | | | | |
| Potassium cyanide (g/l) | 8-12 | 50-100 | 20 | 30 | 90 |
| Potassium silver cyanide (g/l) | | 5-10 | 4.4 | 0.2 | |
| Potassium nickel cyanide (g/l) | | | | | 5 |

-continued

| | Au—Cu | Au—Ag | Au—Ag—Sb | Pure gold | Rinker |
|---|---|---|---|---|---|
| Potassium antimonyl tartrate (g/l) | | | 7.5 | | |
| Rochelle salt (g/l) | | | 70 | | |
| Potassium carbonate (g/l) | | 30 | | | |
| Hydrogen dipotassium phosphate (g/l) | | | | 30 | |
| pH | 7.5-9.0 | 11-13 | | over 9 | 11-12 |
| Bath temperature (° C.) | 65 | 25-30 | 20-25 | 50-70 | 25 |
| Current Density (A/dm$^2$) | 0.6-1.0 | 0.5-1.0 | 0.2-0.6 | 0.1-0.5 | 0.2 |
| Co-deposition of gold | *60-80% | abt. 70% | 50-70% | equal to barrel | abt 98% |

The stirring was implemented by a combination of circulation and a cathode rocker. The value accompanied with the symbol * may be varied depending on the current density.

The components and the conditions of a typical color finish plating bath are:

| | 14K | Green | Pink | Rose | White |
|---|---|---|---|---|---|
| Potassium gold cyanide (g/l) | 3.7 | 4.2 | 3.8 | 8 | 4 |
| Silver cyanide (g/l) | | 0.2 | | | |
| Copper cyanide (g/l) | | 0.25 | 1.5-3.0 | | |
| Nickel potassium cyanide (g/l) | 1.5 | | | | 15 |
| Potassium hexacyanoferrate (g/l) (Potassium ferrocyanide) | | | 30 | | |
| Potassium cyanide (g/l) | 15 | 15 | 7.5 | 8 | 8 |
| Potassium di-hydrogen phosphate (g/l) | 15 | 15 | 15 | 15 | 15 |
| Bath temperature (° C.) | 50-60 | 50-60 | 60-70 | 55-60 | 50-60 |
| Bath voltage (V) | 2-3 | 2-3 | 2-4 | 1.5-2 | 2-3 |
| Current Density (A/dm$^2$) | 0.1 | 0.1-0.2 | 2.2-4.4 | 0.1 | 0.5-1 |
| pH | 10-12 | 10-11 | 10-12 | 9-11 | 9-11 |
| Stirring | by circulation and cathode rocker. | | | | |

Example 42

Neutral Bath

Soft gold was used for plating semiconductor devices, featuring:

Purity: 99.9% or higher

Hardness: 70 to 100 Knoop

Deposition efficiency: 90% or higher.

The components and the conditions of a neutral gold plating bath are:

| | Rack & barrel | High-speed |
|---|---|---|
| Potassium gold cyanide (g/l) | 8-12 | 9-25 |
| Potassium di-hydrogen phosphate (g/l) | 15 | |
| Hydrogen di-potassium phosphate (g/l) | 34 | 110 |

-continued

| | Rack & barrel | High-speed |
|---|---|---|
| Citrate (g/l) | | 20 |
| Additive* | | app. |
| pH | 5.5-7.5 | 5.5-7.5 |
| Bath temperature (° C.) | 60-75 | 60-75 |
| Current density (A/dm$^2$) | up to 0.8 | 0.5-5 |

The stirring was implemented by a combination of circulation and a cathode rocker. For the high-speed bath, a jet flow may be used. The additives (*) may be selected from Ti, Tl, Se, Te, Al, Pb, and any nitride.

| | Rack & barrel | | High-speed |
|---|---|---|---|
| Potassium gold cyanide (g/l) | 8-12 | 12 | 9-16 |
| Potassium di-hydrogen phosphate (g/l) | 96 | | |
| Citrate (g/l) | 24 | | 80 |
| Cobalt potassium EDTA (g/l) | 1-3 | 3 | |
| Potassium citrate (g/l) | | 125 | |
| Potassium tartrate (g/l) | | 1 | |
| Hydrogen di-potassium phosphate (g/l) | 80 | | 15 |
| Cobalt carbonate (g/l) | | | 0.1-3 |
| pH | 3.5-5.0 | 3.0-4.5 | 3.5-4.5 |
| Bath temperature (° C.) | 20-50 | 13-35 | 40-70 |
| Current density(A/dm$^2$) | up to 1.5 | 0.5-1.0 | 2-10 |

The stirring was implemented by a combination of circulation and a cathode rocker. For the high-speed bath, a jet flow can be used.

(Acid Bath)

Hard gold can preferably be used for plating contacts or decorative fittings, featuring:

Purity: 99.6 to 99.9%

Hardness: 110 to 350 Knoop

Deposition efficiency: 10 to 70%.

The components and the condition of a preferable acid gold plating bath are described below.

Plating bath: A metal vessel was lined with hard vinyl chloride, polypropylene, or the like (which has a high bonding strength).

Stirring: For gold plating, air blow stirring was not used. In most cases, a circulation type can favorably be employed.

Heating: Heating means should have a resistance to the plating solution and may be implemented by a steam or a drop-in heater. In an alloy solution, the variation of the temperature may change a ratio of alloyed metals. It is hence desired to select indirect uniform heating.

Filter: A cartridge filter was preferable and its mesh size may be 3 to 10 μm. It is desirable to filter the plating solution one time in one hour.

Rectifier: A slide-action type, preferably equipped with a direct-current ampere-hour meter.

Anode: The anode is commonly made of insoluble platinum or platinum-plated titanium. In an alkali bath, a 18-8 stainless steel anode may be used.

| | Pre-plating layer | Minimum thickness (μM) Gold | Silver |
|---|---|---|---|
| Copper: | unnecessary | — | — |
| Copper alloy: (leas based brass) | Ni, Cu, Sn—Ni | 1.25 | May need Ni or Cu. |
| Iron (except austenite: and stainless steel) | Ni | 10 | 10 |
| | Cu + Ni | 10 + 5 | 10 + 5 |
| Austenite and Stainless steel: | Ni strike | Thin (or acid gold strike) | Thin |
| Zinc & its alloy: | Cu + Ni | 8 + 10 | 8 + 10 |
| Aluminum and aluminum alloy: | (Cu) + Ni | (Option) + 20 | (Option) + 20 |

-continued

| | Pre-plating layer | Minimum thickness (μM) Gold | Silver |
|---|---|---|---|
| Other materials and soldering joint contained material: | May need Ni or Cu. | According to agreement | |

Example 43

Rhodium Plating

Rhodium is a most preferable material among the rare metals (ruthenium, rhodium, paradigm, osmium, iridium, and platinum) for plating.

Although not in a platinum group, indium and its alloy can now be used for plating a variety of electronic components. Rhodium is highly resistant to corrosion and high in the reflectivity as its plating appears glossy white. Accordingly, rhodium has been widely be used for plating specific ornaments. Also, for preventing its color fading, the silver plating can often be covered with a 0.05-μm thickness of rhodium flash plating.

Paradigm plating or paradigm-nickel alloy plating is also popular for plating electrical contacts instead of the gold plating. The paradigm-nickel alloy plating may be used as a lower layer of the rhodium plating for various decorative applications.

A modification of the rhodium plating is a black rhodium plating for plating particular ornaments (binocular frames and watch cases).

The rhodium plating was commonly implemented with a sulfuric acid bath, a phosphoric acid, and a phosphoric acid-sulfuric acid bath. The sulfuric acid baths are classified into a thin plating bath for decorative applications (optimized in the reflectivity and the glossiness), a thick plating bath for electronic applications such as reed switches (optimized in the thickness and the contact resistance), and a high-speed plating bath, any of which can be utilized for the present invention. The components and the conditions of typical baths are shown in Table 16 together with the relationship between the duration and the thickness.

TABLE 16

| Item | | Decoration plating | Plating for electronic component | Quick plating |
|---|---|---|---|---|
| Attained thickness of layer by rhodium | | 1 μm | 10 μm | 5 μm |
| Bath composition & plating conditions | Rhodium (as sulphate) | 1.8~2.2 g/l | 4.5~5.5 g/l | 10~20 g/l |
| | Sulfuric acid | 40~50 g/l | 70~90 g/l | 70~90 g/l |
| | Brightener | Proper amount | — | — |
| | Temperature of bath | 40~50° C. | 40~60° C. | 55~65° C. |
| | Current density of cathode | 1~3 A/dm$^2$ | 1.0~1.5 A/dm$^2$ | 20~40 A/dm$^2$ |
| | Electric potential of bath | 2~6 V | 2~6 V | 2~6 V |
| | Surface ratio of electrodes | 1:1~2 | 1:1~2 | 1:1~2 |
| | Stirrering | Cathode locker | Circulation by pumping accompany with cathode locker | Jet injection more than 0.5 m/s |

Stirrer: Preferably equipped with a acid proofing cathode rocker was used. The stirring speed was 5 to 10 m/min for decorative applications and 20 to 30 in/min for tough industrial applications.

Filter: A cartridge filter was acid resistant. For thick plating, the flow of the solution to be filtered for one hour was preferably 10 times greater than the volume of the bath.

Exhaust unit: As unwanted mists are generated during the plating, they have to be discharged by a local exhaust unit.

Anode: The anode is made of a plate or mesh sheet of platinum or titanium plated with rhodium or platinum. Also, hooks are made of the same material.

Rectifier: The rectifier is of a slide-action adjustable type for DC output of 0 to 8 V. Its capacity is preferably 1 A for one liter of the bath.

High-speed plating system: A system is provided for blowing a jet flow of the amount more than 0.5 liter/s and its materials, filtering function, and exhaust unit are arranged similar to those described above.

The plating process (for ornaments) comprises a series of pre-plating (washing→activating—nickel plating or paradigm-nickel alloy plating)→washing→immersing into 5% sulfuric acid solution→washing→pure water washing→rhodium plating→recovering→washing→warm water washing→drying.

The plating system includes a plating bath made of an anti-corrosion material. The bath may be made of hard vinyl chloride as its temperature is not very high. The heating may be conducted directly with an electronic heater.

The components and the conditions of a typical rhodium plating bath are explained.

Since the rhodium plating is highly susceptible to the effect of impurities which may deteriorate the color of a resultant plating particularly for decorative applications, it has to maintain free from any impurities.

The possible faults and their solutions are:

| Faults | Causes | Solutions |
|---|---|---|
| Color darkened | Metal impurities (Fe, Cu, Zn, Ni etc) | When the concentration of impurities is not high, the solution was diluted. |
| | Organic impurities | Add 2 to 5 g/l of activated carbon and stir 30 minutes for deposition. |
| | Condition fault (e.g. Dk level) | Measure and analyze for holding the condition in its range. |
| | Over-washing of lower plating | Reduce the rinse duration or the concentration of a detergent. |

-continued

| Faults | Causes | Solutions |
|---|---|---|
| Bonding error | Lower plating fault | Check the washing step or lower plating step. |
| | Washing water quality | Measure the conductivity of pure water (no common supply water used) |
| | Inactivation of lower plating | Check the concentration of an activator. |
| Glossiness declined | Component fault | Measure and analyze for holding the component in its range. |
| | Condition fault | Measure and analyze for holding the condition, e.g. concentration, density, or stirring, in its range. |
| | Inorganic, organic impurities (Black Rhodium Plating) | Add activated carbon and dilute the solution. |

As a resultant black rhodium plating is close to an amorphous form when deposited, its physical properties can be improved by anodizing.

The plating and anodizing conditions of the black rhodium plating is explained. As the black rhodium plating bath was possibly deteriorated at a temperature of 30° C. or higher, it has to be accompanied with a cooling unit for cooling particularly in summer.

| Steps | Items | Conditions |
|---|---|---|
| Plating | Rhodium concentration | 2.5 to 3.5 g/l |
| | Sulfuric acid concentration | 25 to 30 g/l |
| | Additives | app. |
| | Bath temperature | 20 to 25° C. |
| | Cathode current density | 2 to 4 A/dm$^2$ |
| | Stirring | by cathode rocker |
| | Maximum plating thickness | 0.5 μm |
| | Anodizing solution | 100 g/l |
| | Bath temperature | 20 to 30° C. |
| | Bath voltage | 3 V |
| | Processing duration | 2 to 3 minutes |

Example 44

Paradigm Plating

Typical examples of paradigm plating bath are an ammonium chloride bath and a paradigm chloride bath. Since the ammonium chloride bath is alkali and susceptible to metal impurities, it may often produce a fault For compensation, the bath may be subjected to striking or modification with additives. The paradigm chloride bath is acid and can thus produce a dense plating layer having a less internal stress. Any other modified baths containing sulfates may also be used.

TABLE 17

| Item | | Ammonium chloride bath | Palladium chloride bath |
|---|---|---|---|
| Bath composition & plating conditions | Concentration of palladium | 10 g/l | 30 g/l |
| | Ammonium chloride | 60 g/l | 30 g/l |
| | pH | Proper amount | Proper amount |
| | Additive | 8.5 (By aqueous ammonia) | 0.5 (By hydrochloride) |
| | Temprature of bath | 20~35° C. | 40~50° C. |
| | Current density of cathode | 1~2 A/dm$^2$ | 0.5~1.5 A/dm$^2$ |
| | Stirrering | Cathode locker | Cathode locker |

Example 45

Paradigm-Nickel Alloy Plating

Paradigm-nickel alloy plating is commonly carried out with a sulfamic acid bath or an ammonium chloride bath.

TABLE 18

| Item | Sulfamic acid bath | Ammonium chloride bath |
|---|---|---|
| Bath composition | | |
| Concentration of palladium | 10 g/l | 15 g/l |
| Concentration of nickel | 10 g/l | 10 g/l |
| Sulfamic ammonium | 50 g/l | — |
| Ammonium sulphate | — | 35 g/l |
| Additive | Proper amount | Proper amount |
| pH | 8.5 | 8.5 |
| Composed composition | | |
| Palladium | 60% | 75% |
| Nickel | 40% | 25% |
| Plating conditions | | |
| Temperature of bath | 20~35° C. | 30~35° C. |
| Current density of cathode | 1~3 A/dm$^2$ | 1~2 A/dm$^2$ |
| Stirrering | Cathode locker | Cathode locker |

As the bath includes ammonium, it may be assaulted by metal impurities easily dissolving. However, if the deposition of metal impurities creates declination in the glossiness or the color tone, it can be removed by weak electrolytic action. Also, when either the sulfamic acid bath or the ammonium chloride bath has the concentration of paradigm and nickel favorably modified, its resulting plating can be finished with an optimum content of paradigm ranging from 50% to 80%.

Example 46

Ruthenium Plating

Although ruthenium is highly ionized in the plating solution and its bath stays unstable, it has widely been utilized for decorative applications as well as industrial applications. Typical examples of the ruthenium plating bath are a sulfuric bath, a nitrosyl chloride bath, a sulfamate bath, and any other ruthenium complex salt bath. The components and the conditions of a sulfuric acid bath are shown in Table 19. The sulfuric acid bath has a positive ion exchange membrane mounted therein for inhibiting any deposition of ruthenium oxide on the anode.

TABLE 19

| | Item | |
|---|---|---|
| Bath composition & plating conditions | Concentration of ruthenium | 3 g/l |
| | Concentration of sulfuric acid | 6 g/l |
| | Additive | Proper amount |
| | Temperature of bath | 50° C. |
| | Current density of cathode | 2 A/dm$^2$ |
| | Stirrering | Cathode locker |

Example 47

Hardness Test of Ni Plating on Al Base

Three samples are prepared by (i) depositing a copper plating on an iron substrate, depositing an Ag plating on the copper plating, and depositing on the Ag plating an electro Au plating of 15 μm thick which does not contain the UDD of the present invention (sample No. 18), by (ii) depositing on a zinc-copper alloy substrate a chemical Cu plating of 15 μm thick which contains not greater than 1% of the UDD sample No. 11 shown in Table 5 (sample No. 19), and by (iii) depositing on a chrome plated steel substrate an Ni plating of 15 μm thick which contains 5% of the UDD sample No. 11 shown in Table 5 (sample No. 20). The three samples are then examined for the Vickers hardness using a hardness meter, HMV-1 made by Shimazu and their measurements are shown in Table 20.

TABLE 20

| | surface (with plated film) | | | Backside surface (non plated film) | | |
|---|---|---|---|---|---|---|
| Sample No. | Pressure (mN) × (10 sec) (mN) | Diagonal length of produced depression (nm) | | Pressure (mN) × (10 sec) (mN) | Diagonal length of produced depression (nm) | |
| Sample 18 | F: 980.7 | Direction 1 | 162 | F: 980.7 | Direction 1 | 200 |
| | | Direction 2 | 172 | | Direction 2 | 199 |
| | | Direction 3 | 177 | | Direction 3 | 180 |
| | | d: average | 170 | | d: average | 190 |
| | | Picker's hardness(HV) = | 630 | | Picker's hardness(HV) = | 500 |
| Sample 19 | F: 980.7 | Direction 1 | 186 | F: 980.7 | Direction 1 | 240 |
| | | Direction 2 | 185 | | Direction 2 | 251 |
| | | Direction 3 | 260 | | Direction 3 | 260 |
| | | d: average | 210 | | d: average | 250 |
| | | Picker's hardness(HV) = | 410 | | Picker's hardness(HV) = | 290 |
| Sample 20 | F: 980.7 | Direction 1 | 164 | F: 980.7 | Direction 1 | 224 |
| | | Direction 2 | 171 | | Direction 2 | 240 |
| | | Direction 3 | 162 | | Direction 3 | 221 |
| | | d: average | 166 | | d: average | 228 |
| | | Picker's hardness(HV) = | 660 | | Picker's hardness(HV) = | 350 |

The Vickers hardness was determined from the relationship between a pressing force and a resultant dent as expressed by $HV=1.854\times F/d^2$.

It was found from the result that the plating according to the present invention is very hard.

Figure 22:
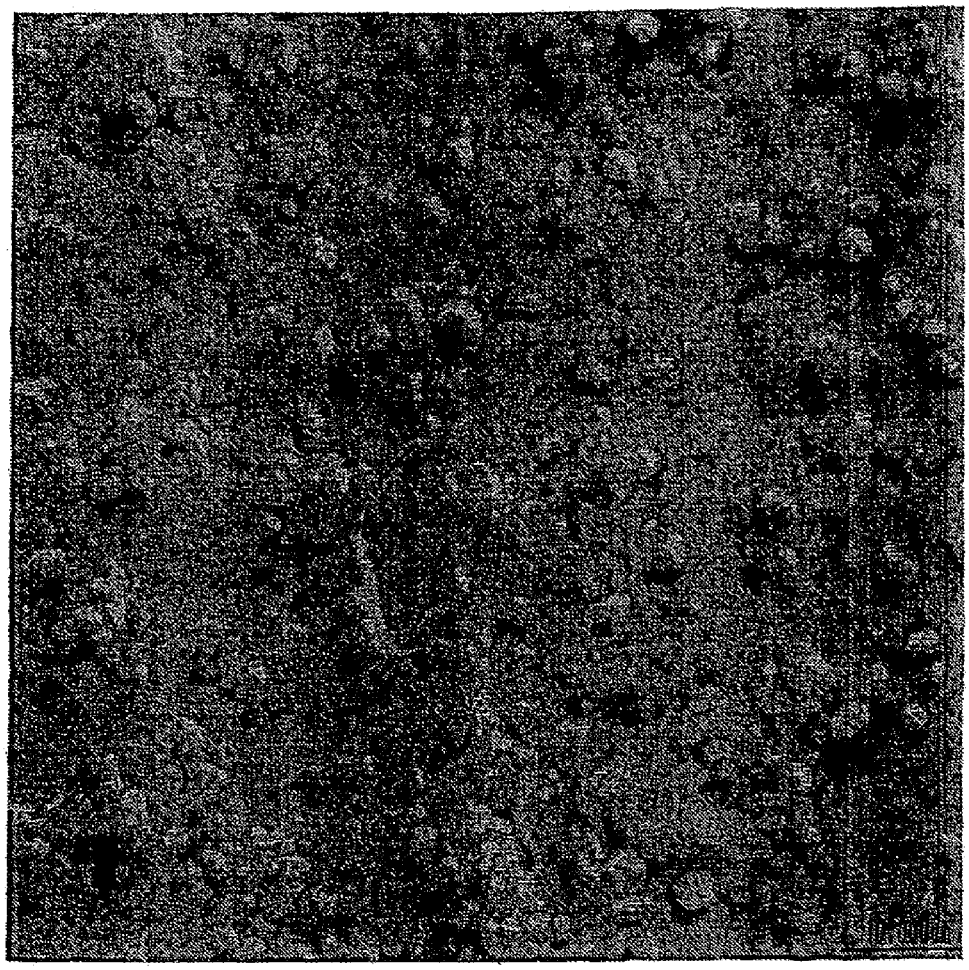
FIG. 22 is an SEM photo showing an example of the UDD contained metal film of the present invention.
Figure 23:
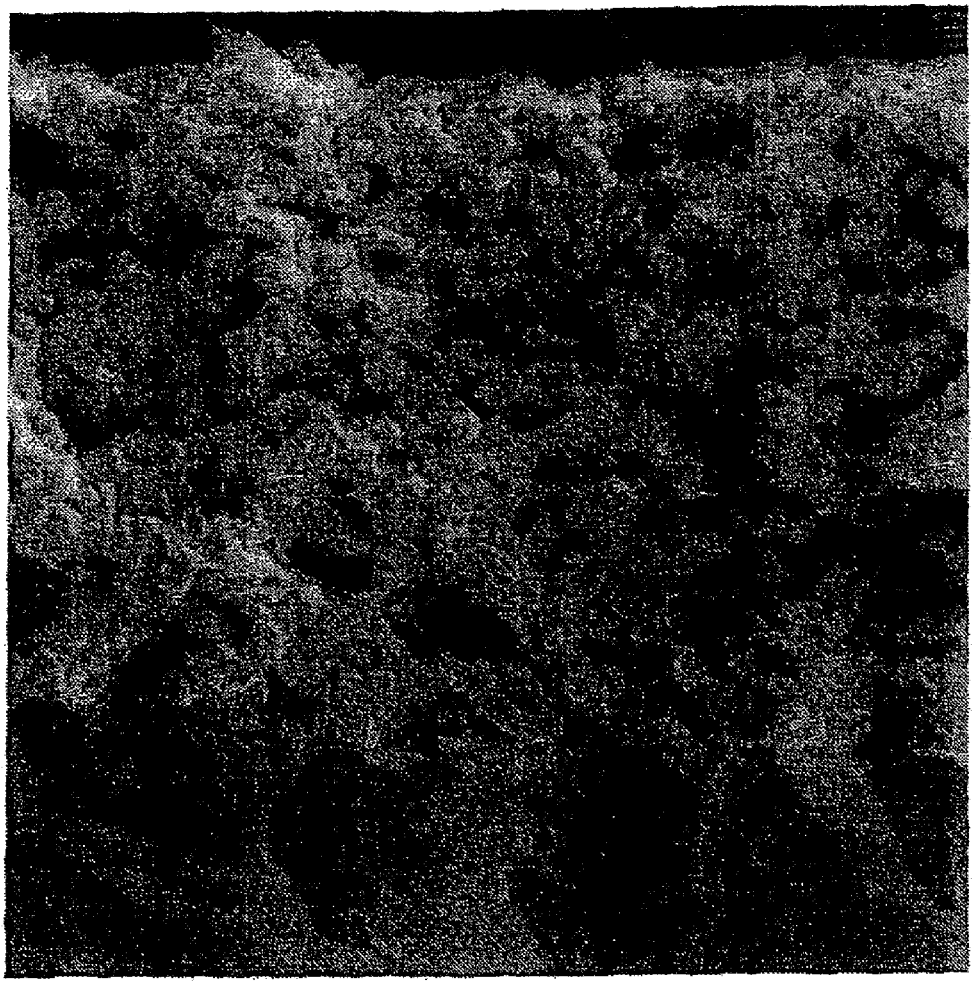
FIG. 23 is an SEM photo showing another example of the UDD contained metal film of the present invention.
Figure 24:
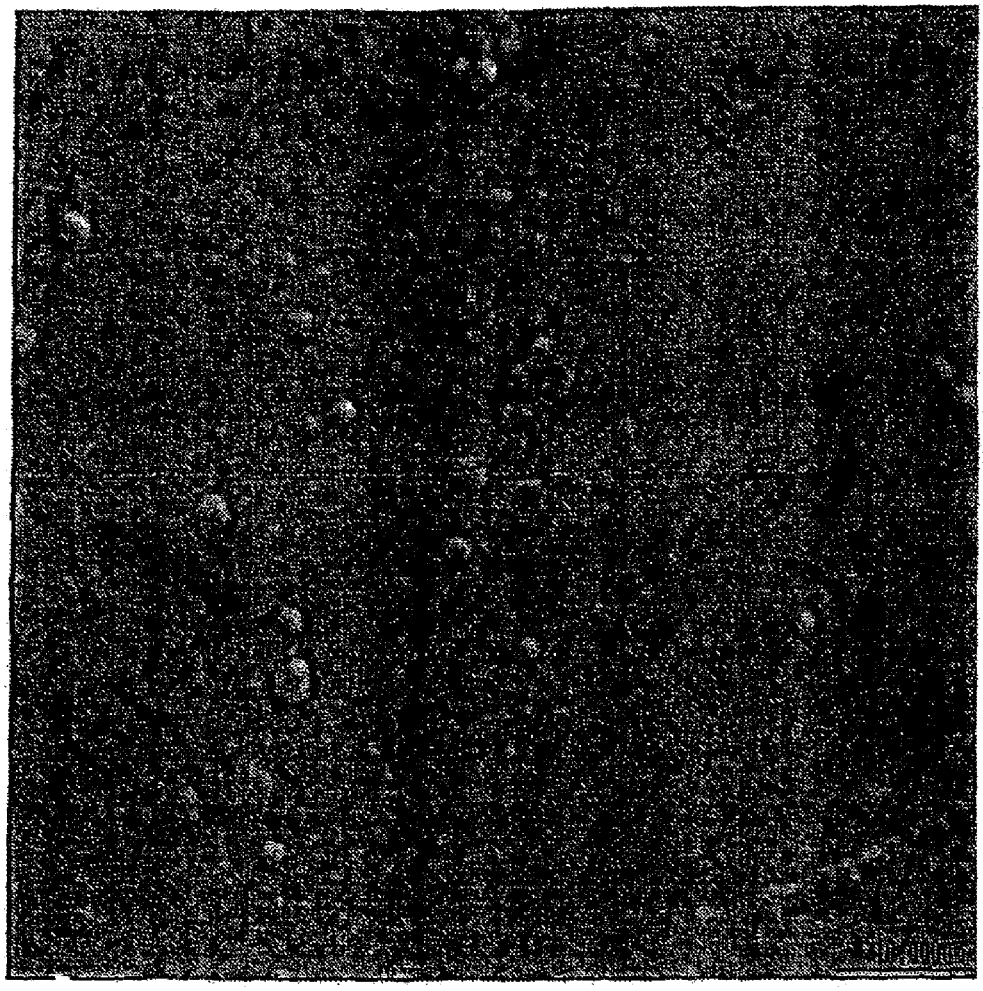
FIG. 24 is an SEM photo showing a further example of the UDD contained metal film of the present invention.
Figure 25:
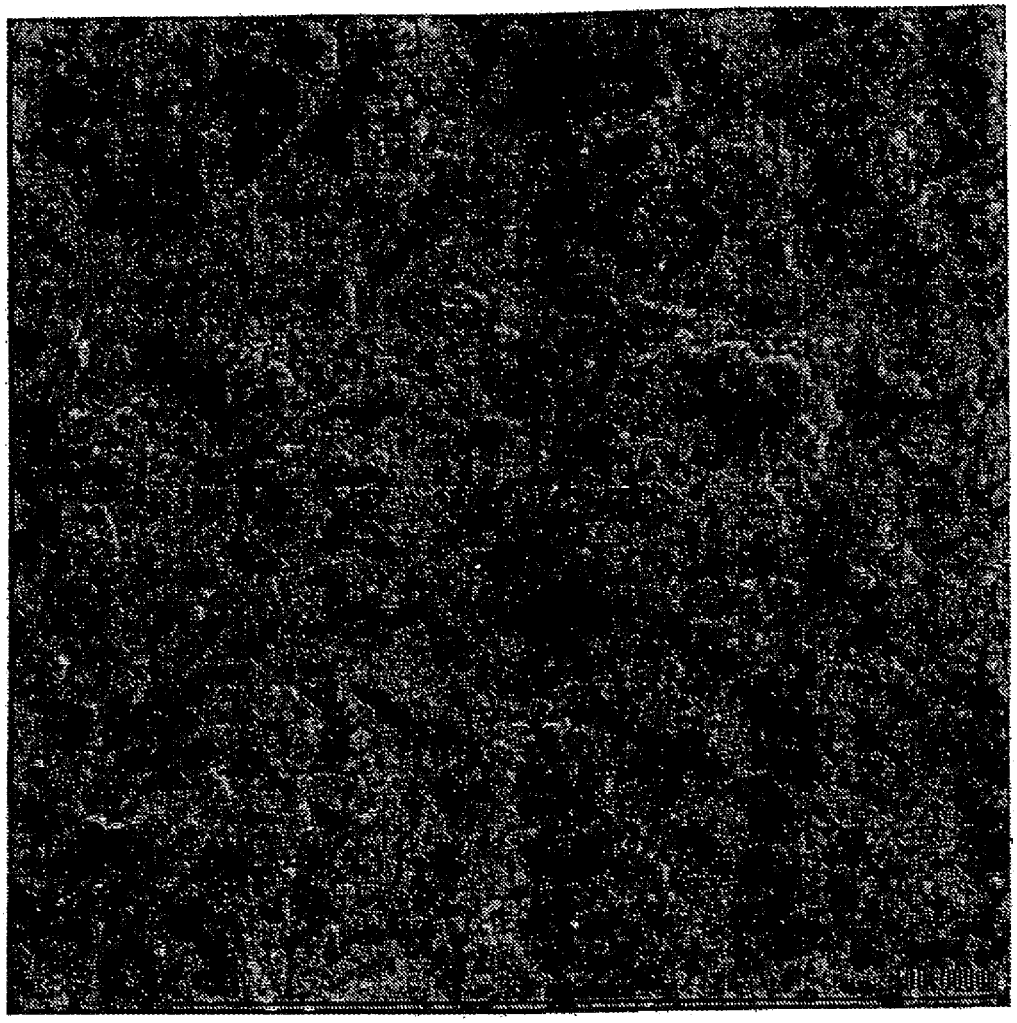
FIG. 25 is an SEM photo showing a still further example of the UDD contained metal film of the present invention.
Figure 26:
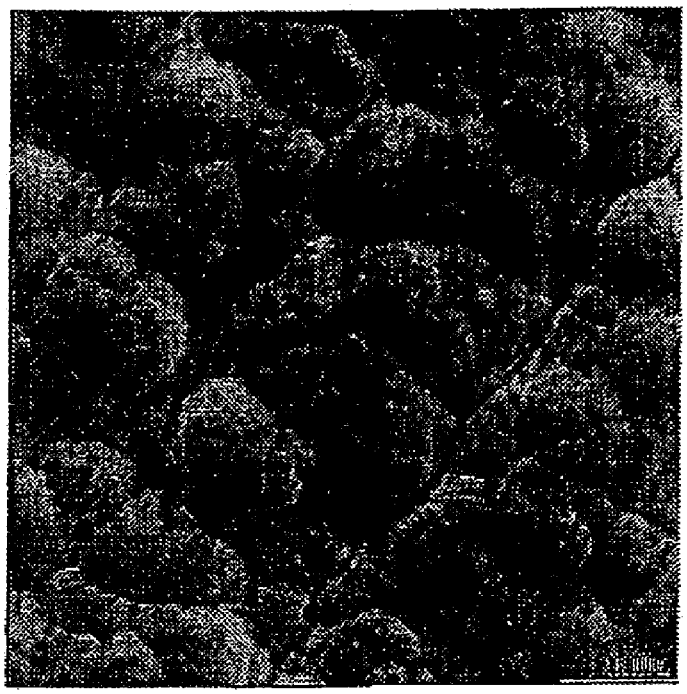
FIG. 26 is an SEM photo showing a non-UDD contained metal film.
Figure 26:
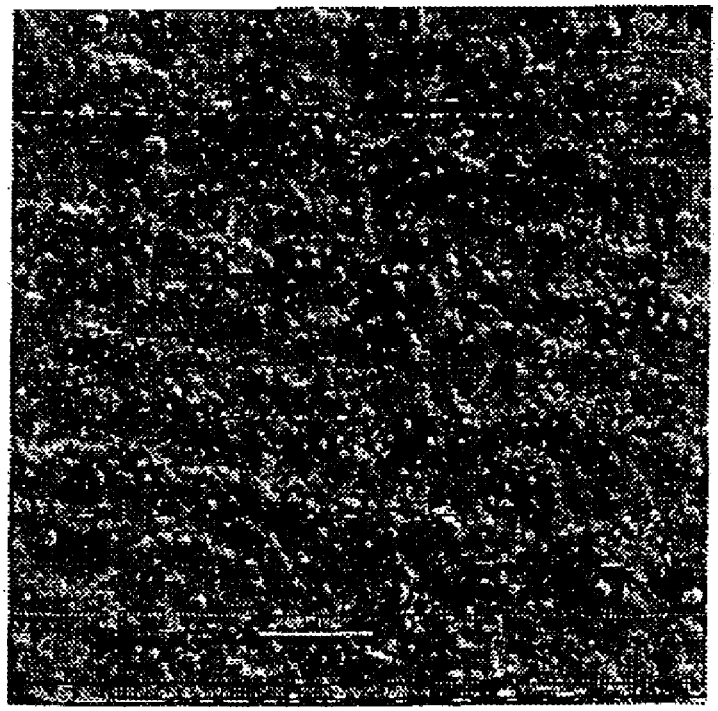
Figure 27:
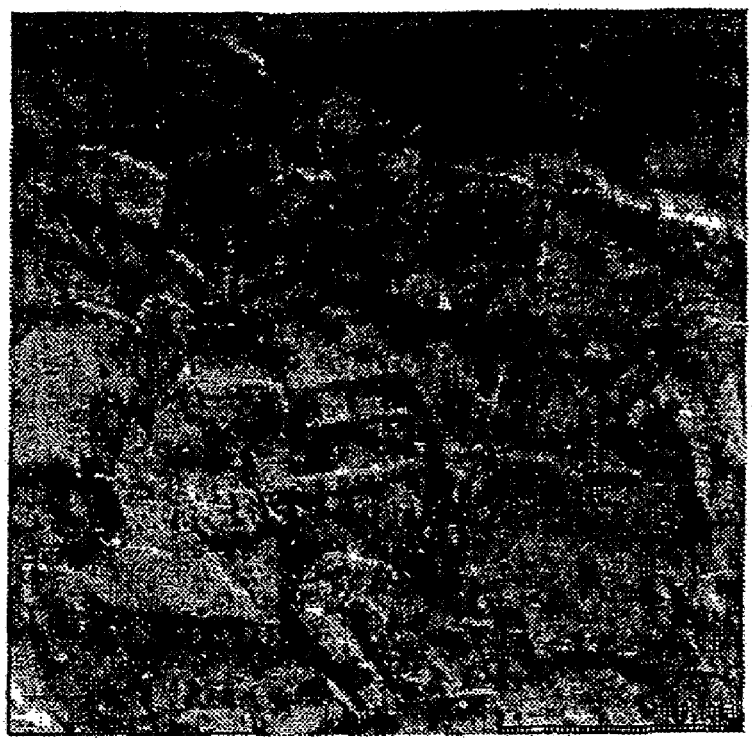
FIG. 27 is an SEM photo showing a still further example of the UDD contained metal film of the present invention.
Figure 27:
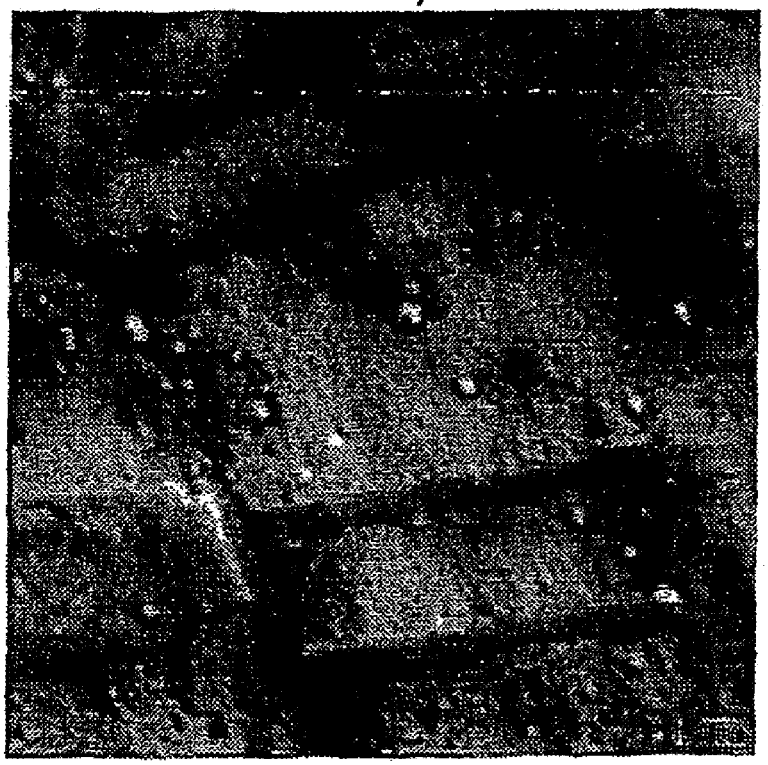
Figure 28:
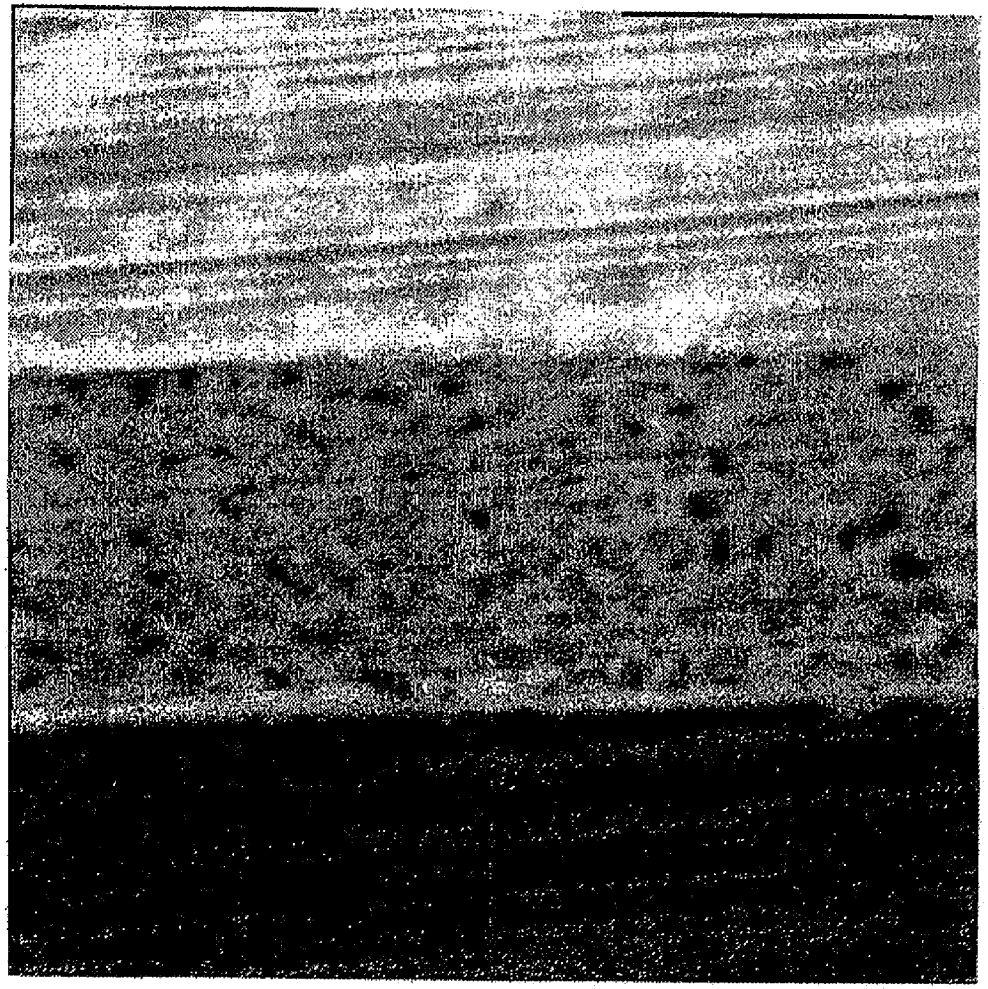
FIG. 28 is an SEM photo showing a non-UDD contained metal film.
Figure 29:
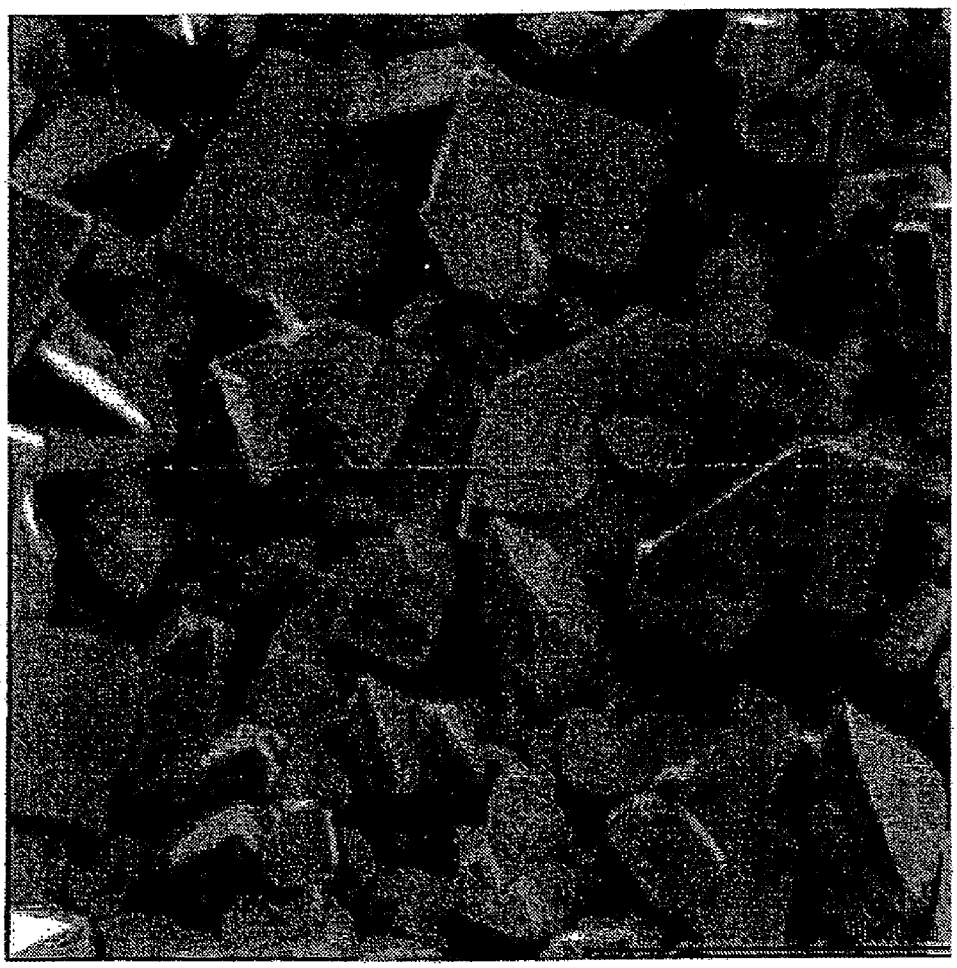
FIG. 29 is an SEM photo showing a still further example of the UDD contained metal film of the present invention.
Figure 30:
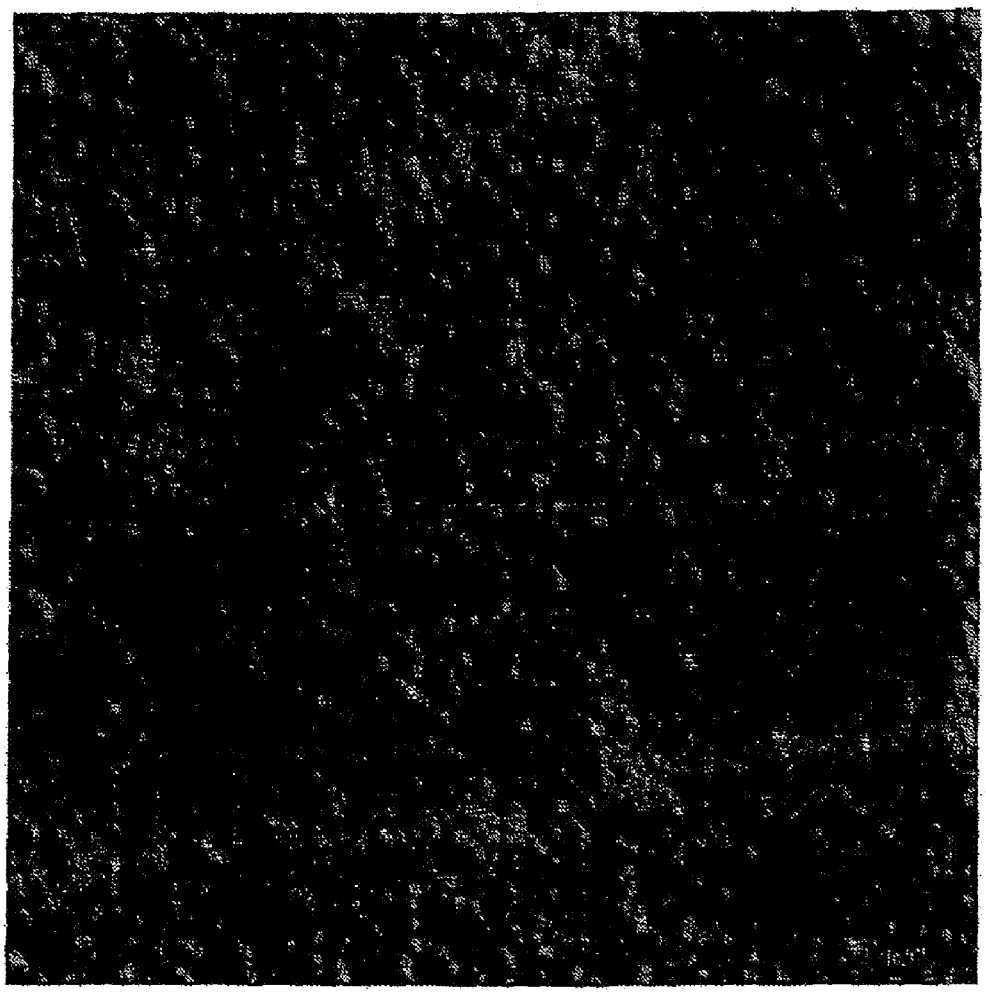
FIG. 30 is an SEM photo showing a still further example of the UDD contained metal film of the present invention.
Figure 31:
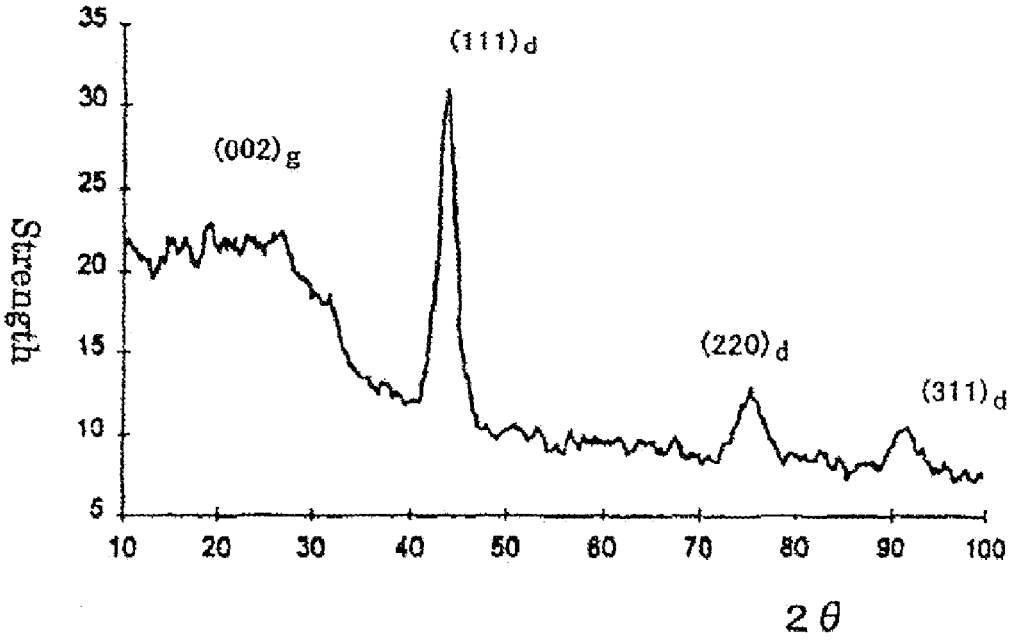
FIG. 31 is an X-ray diffraction chart of a conventional UDD form.
Figure 32:
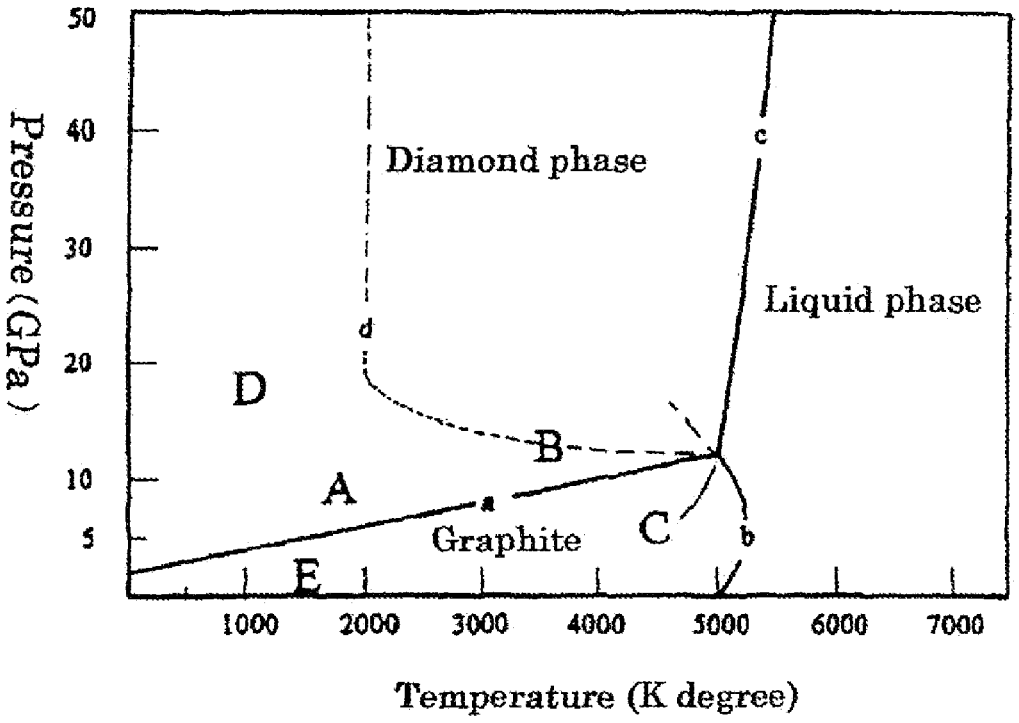
FIG. 32 is a phase-shift graph showing the dependency on temperature and pressure of a diamond carbon phase, a graphic carbon phase, and a liquid carbon phase of a conventional UDD.
Figure 33:
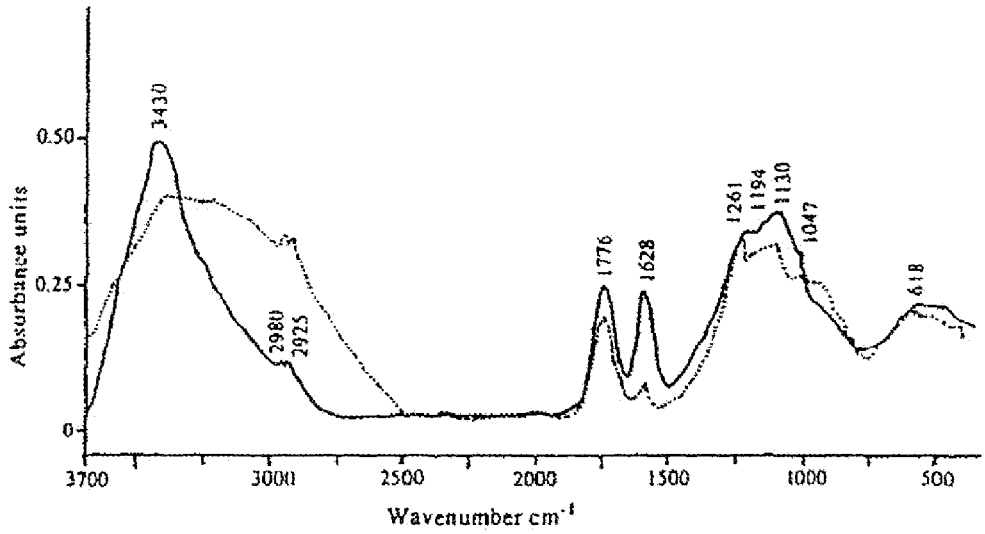
FIG. 33 is an IR spectrum chart of a conventional UDD.
Figure 34:
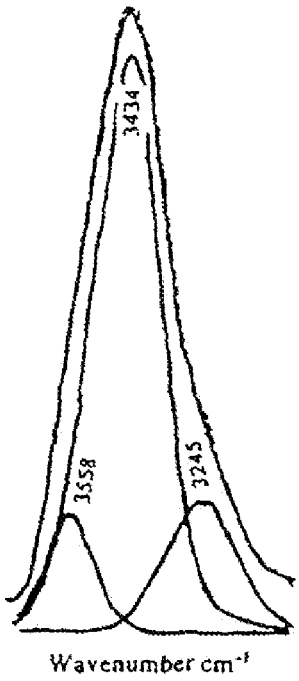
FIG. 34 is a partially detailed view of the IR spectrum chart shown in FIG. 33.
Figure 35:
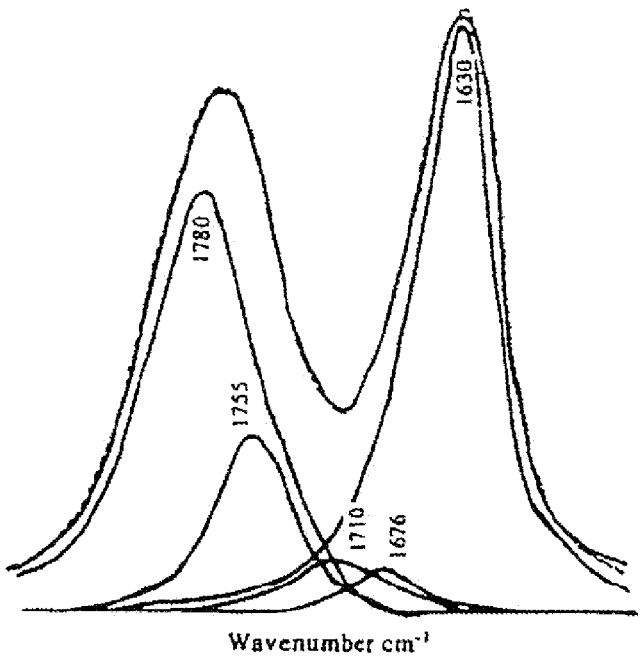
FIG. 35 is a partially enlarged view of the IR spectrum chart shown in FIG. 33.
Figure 36:
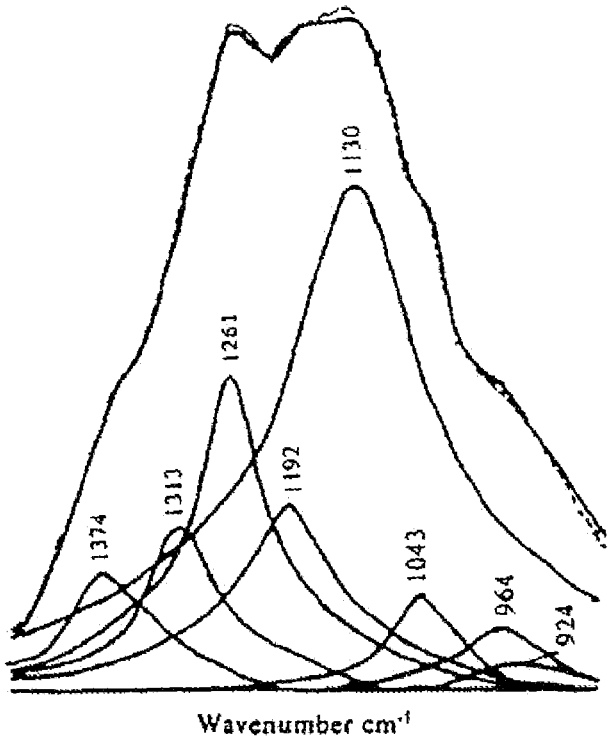
FIG. 36 is a partially enlarged view of the IR spectrum chart shown in FIG. 33.
Figure 37:
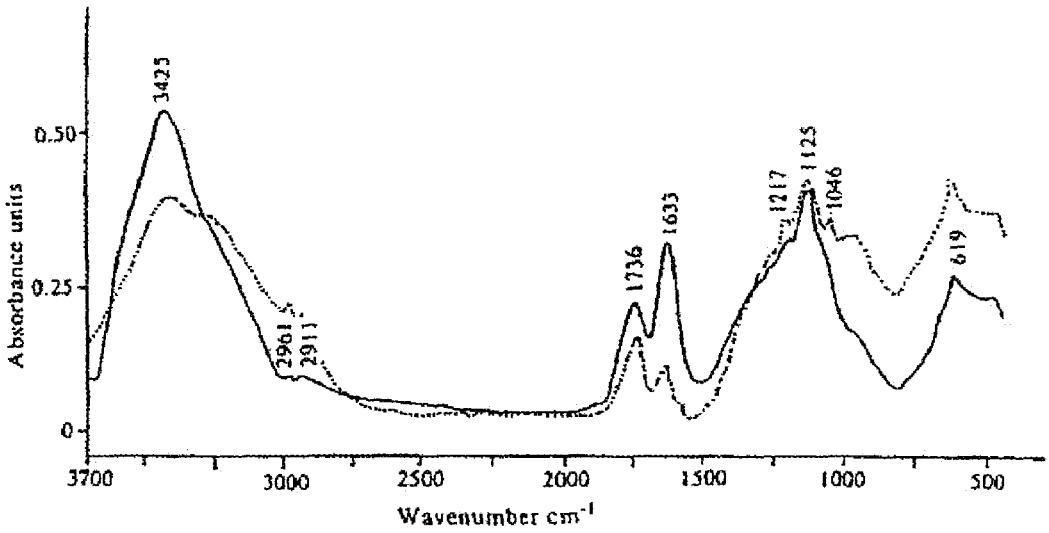
FIG. 37 is an IR spectrum chart of another conventional UDD.
Figure 38:
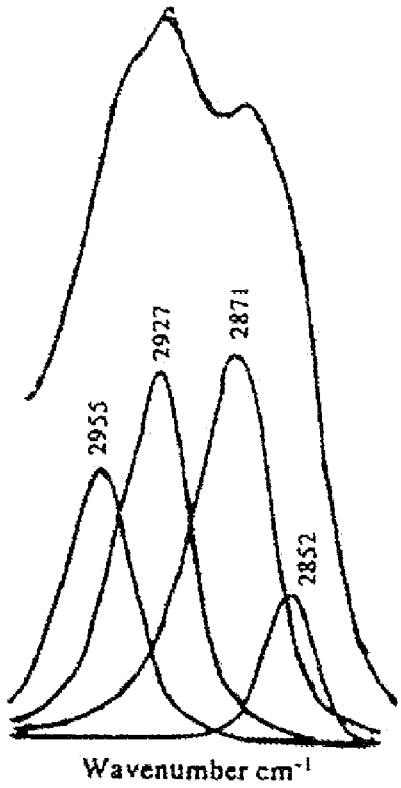
FIG. 38 is a partially enlarged view of the IR spectrum chart shown in FIG. 37.
Figure 39:
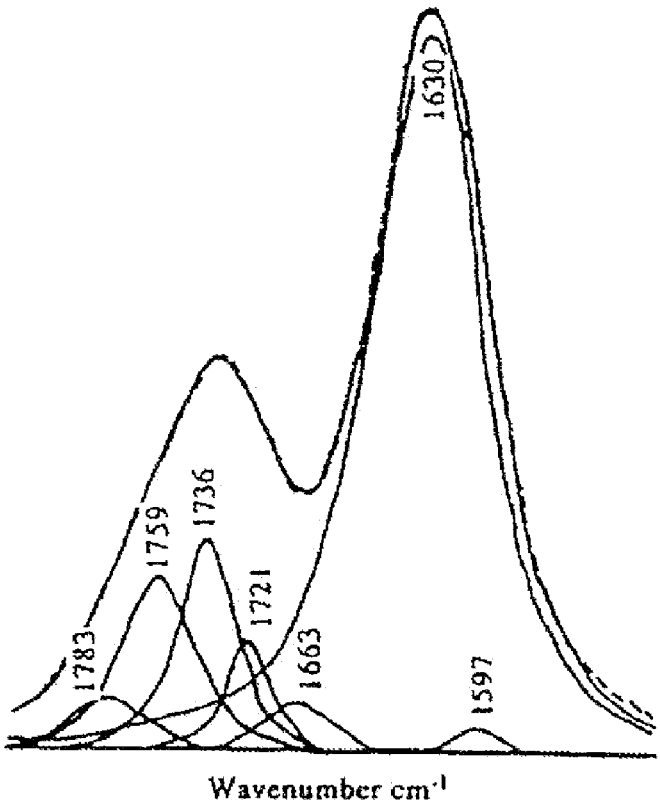
FIG. 39 is a partially enlarged view of the IR spectrum chart shown in FIG. 37.
Figure 40:
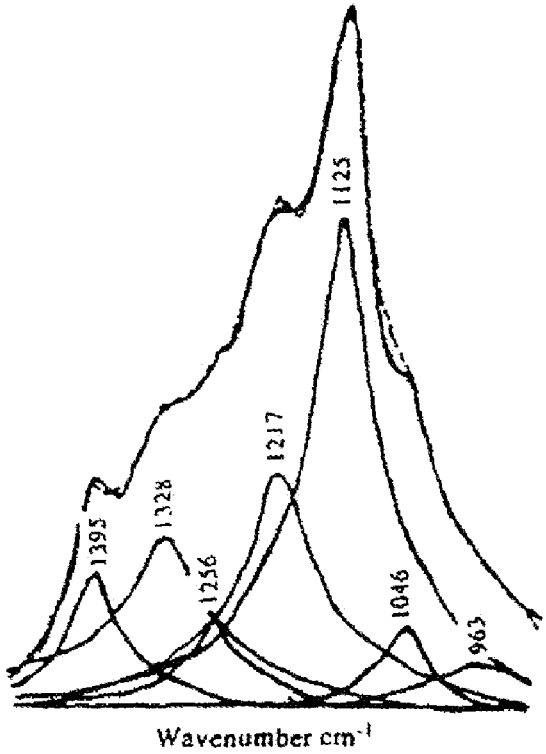
FIG. 40 is a partially enlarged view of the IR spectrum chart shown in FIG. 37.

FIGS. 22 to 30 illustrate SEM photos of the UDD contained metal plating according to the present invention. More particularly, FIG. 22 is an SEM photo (1500×) of the surface of an electro nickel plating containing the UDD of the present invention and FIG. 23 is an SEM photo (200×) showing a cross section of the electro nickel plating shown in FIG. 22. As apparent, the plating is smooth on the surface showing no definite shape of the UDD and its cross section has the UDD dispersed uniformly. FIG. 24 is an SEM photo (1000×) of the surface of a chemical nickel plating containing the UDD of the present invention while FIG. 25 is an SEM photo (1000×) of the surface of another chemical nickel plating deposited from by a plating solution which has a lower concentration of the UDD than of the example shown in FIG. 24. Both the surfaces are smooth showing no definite shape of the UDD. FIG. 26 is an SEM photo (1000×) of the surface of a chemical nickel plating deposited by the same chemical plating method as of the example shown in FIG. 24 but not containing the UDD of the present invention. It is apparent that the surface is rough. FIG. 27 is two SEM photos (not stirred at 1 and stirred at 2) of the surface of an electro nickel plating deposited by the same non-UDD contained chemical nickel plating as of the example shown in FIG. 26 and then by the same manner as of the examples shown in FIGS. 22 and 23 with and without stirring. The resultant platings exhibit the UDD dispersed uniformly enough to have a smooth surface where the shape of the UDD is unclear. FIG. 28 is an SEM photo of the surface of an electro nickel plating deposited by the same manner as of the example shown in FIG. 27 but not containing the UDD of the present invention. The plating shows its surface roughed. FIG. 29 is an SEM photo showing the cross section of a three layer printing of Ni, the UDD of the present invention, and a polymer deposited on a stainless substrate. As apparent, the UDD contained layer is uniformly provided between the Ni layer and the polymer layer. FIG. 30 is an SEM photo showing the cross section of a Cu plating which contains (0.234% of) the UDD of the present invention. It is apparent that the UDD particles are uniformly dispersed between the Cu particles.

Advantageous Effects of this Invention

As clearly understood from the above detailed and practical description, the present invention provides the microparticle diamond which is sized in nanometers, finely dressed, narrow in the range of particle sizes, and improved in the surface activity, the aqueous suspension liquid which contains the nano-diamond and is improved in the stability of its dispersion, the metal film which contains the nano-diamond, the method of favorably synthesizing the nano-diamond, the method of preparing the nano-diamond dispersed aqueous suspension liquid improved in the dispersion stability, and the method of fabricating the metal film.

The UDD of the present invention exhibits a high hardness as the primary property of diamond, a low dielectricity regardless of low electrical conductivity, high electromagnetic properties such as low magnetic sensitivity, a high lubricity, a low thermal conductivity and an improved thermal resistivity, improved dispersion properties as micro particles which are narrow in the range of particle sizes, a high surface activity, high ion or cation exchange properties, and a high affinity with metals and ceramics.

The UDD is also colorless and transparent, hardly visible when mixed in other materials, and less noticeable when dispersed in a solid composition. Accordingly, the UDD of the present invention can successfully be mixed with a lubricant composition, a fuel composition, a paste composition such as grease, a formed resin composition, a rubber composition, a metal material, or a ceramic composition for improvement of the sliding properties, the lubricity, the wear resistivity, the thermal resistivity, the resistance to thermal expansion, the peel resistivity, the water proof, the resistance to chemicals or corrosion by gas, the appearance, the touch feeling, the color, and the specific density of various industrial applications including automobiles or motorcycle component dies, space or aircraft components, chemical plant facilities, computer or electronic components, OA appliances, optical appliances such as cameras, and recording mediums such as magnetic tapes or CDs. The UDD in a power form can be provided in the sliding parts of a machinery or doped directly into a living object in the form of an adsorbent or ion exchange material, in addition to other appropriate applications. While any conventional UDD is required for storage at a temperature lower than 0° C. for ensuring the dispersion stability when dispersed in an aqueous suspension liquid, the UDD of the present invention in such an aqueous suspension liquid has an advantage of remaining stable with its maximum concentration of 16% under the condition of a room temperature (15 to 25° C.).

What is claimed is:

1. An aqueous suspension liquid of finely divided diamond particles comprising 0.05 to 160 parts by weight of a finely divided diamond particles in 1000 parts of water, wherein;

(i) the finely divided diamond particles have an element composition consisting mainly of 72 to 89.5% by weight of carbon, 0.8 to 1.5% of hydrogen, 1.5 to 2.5% of nitrogen, and 10.5 to 25.0% of oxygen;

(ii) and, about all of said diamond particles are in the range of 2 nm to 50 nm in diameters thereof (80% or more by number average, 70% or more by weight average), (iii) and, said finely divided diamond particles exhibit a strongest peak of the intensity of the Bragg angle at 43.9° (2θ±2°), strong and characteristic peaks at 73.5° (2θ±2°) and 95° (2θ±2°), a warped halo at 17° (2θ±2°), and no peak at 26.5°, by X-ray diffraction (XRD) spectrum analysis using Cu—Kα radiation when dried, (iv) and, specific surface area of said diamond particles when dry state powder is not smaller than $1.50\times10^5$ $m^2/kg$, and substantially all the surface carbon atoms of said particles are bonded with hetero atoms, and the total absorption space of said powder is 0.5 $m^3/kg$ or more, when dried.

2. An aqueous suspension liquid of finely divided diamond particles according to claim 1, wherein the pH value is 4.0 to 10.0.

3. An aqueous suspension liquid of finely divided diamond particles according to claim 1, wherein the pH value is 5.0 to 8.0.

4. An aqueous suspension liquid of finely divided diamond particles according to claim 2, wherein the pH value is 6.0 to 7.5.

5. An aqueous suspension liquid of finely divided diamond particles according to claim 1, wherein the concentration of said diamond particles in said suspension liquid is 0.1 to 36%.

6. An aqueous suspension liquid of finely divided diamond particles according to claim 1, wherein the concentration of said diamond particles in said suspension liquid is 0.5 to 16%.

7. An aqueous suspension liquid of finely divided diamond particles according to claim 1, wherein diamond particles of 40 nm or more in diameter are substantially absent, and diamond particles of 2 nm or less in diameter are absent, and content of diamond particles of small diameter not more than 16 nm in diameter is 50 weight % or more, for all diamond particles dispersed content.

8. An aqueous suspension liquid of finely divided diamond particles according to claim 1, wherein the specific density of said diamond particles is in the scope of $3.20\times10^3$ $kg/m^3$ to $3.40\times10^3$ $kg/m^3$, and absorption curve lines by infrared ray (IR) absorption analysis of said diamond powder show a strongest and broadly ranged absorption intensity about 3500 $cm^{-1}$ wavelength, and a strong and broad absorption intensity extended between 1730 and 1790 $cm^{-1}$ wavelengths which is warped in both absorption ends, and a strong and broad absorption intensity about 1170 $cm^{-1}$, and a medium strong and broad absorption intensity about 610 $cm^{-1}$.

9. An aqueous suspension liquid of finely divided diamond particles according to claim 1, wherein the specific density of said diamond particles is in the scope of $3.20\times10^{-3}$ $kg/m^3$ to $3.40\times10^{-3}$ $kg/m^3$, and absorption curve lines by infrared ray (IR) absorption analysis of said diamond powder show a strongest and broadly ranged absorption intensity about 3500 $cm^{-1}$ wavelength, and a strong and broad absorption intensity extended between 1730 and 1790 $cm^{-1}$ wavelengths which is warped in both absorption ends, and a strong and broad absorption intensity about 1170 $cm^{-1}$, and a medium strong and broad absorption intensity about 610 $cm^{-1}$, and two medium strong absorption intensities about 1740 $cm^{-1}$ and 1640 $cm^{-1}$, and a broad range absorption intensity about 1260 $cm^{-1}$.

10. An aqueous suspension liquid of finely divided diamond particles according to claim 1, wherein the ratio of an intensity level of said highest peak at 43.9° of the Bragg angles (2θ±2°) for the total intensity level of other peaks with the exception of the highest peak at 43.9°, in the X-ray diffraction (XRD) spectrum using Cu—Kα radiation, is in the range of 89/11 to 81/19.

11. An aqueous suspension liquid of finely divided diamond particles according to claim 1, wherein the specific surface area of said diamond particles measured by BET technique after heating to 1273° K is in the ranges of $1.95\times10^5$ $m^2/kg$ to $4.04\times10^5$ $m^2/kg$.

* * * * *